US006790492B2

(12) United States Patent
Shimomura et al.

(10) Patent No.: US 6,790,492 B2
(45) Date of Patent: Sep. 14, 2004

(54) MULTI-COLOR IMAGE-FORMING MATERIAL AND MULTI-COLOR IMAGE-FORMING PROCESS

(75) Inventors: Akihiro Shimomura, Fujinomiya (JP); Mitsuru Yamamoto, Fujinomiya (JP); Shinichi Yoshinari, Fujinomiya (JP); Akira Hatakeyama, Fujinomiya (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 365 days.

(21) Appl. No.: 10/054,864

(22) Filed: Jan. 25, 2002

(65) Prior Publication Data

US 2003/0035934 A1 Feb. 20, 2003

(30) Foreign Application Priority Data

| | | |
|---|---|---|
| Jan. 26, 2001 | (JP) | 2001-018768 |
| Feb. 5, 2001 | (JP) | 2001-028248 |
| Feb. 26, 2001 | (JP) | 2001-050351 |
| Mar. 19, 2001 | (JP) | 2001-078845 |
| Mar. 19, 2001 | (JP) | 2001-079223 |
| Mar. 19, 2001 | (JP) | 2001-079546 |
| Jan. 21, 2002 | (JP) | 2002-011885 |

(51) Int. Cl.[7] ..... B41M 5/40
(52) U.S. Cl. ..... 428/32.52; 428/32.77
(58) Field of Search ..... 428/32.52, 32.77

(56) References Cited

U.S. PATENT DOCUMENTS

| | | | |
|---|---|---|---|
| 4,580,142 | A | 4/1986 | Matsushita et al. |
| 5,053,381 | A | 10/1991 | Chapman et al. |
| 5,126,760 | A | 6/1992 | DeBoer |
| 5,300,398 | A | 4/1994 | Kaszczuk |
| 5,512,931 | A | 4/1996 | Nakajima et al. |
| 5,580,693 | A | 12/1996 | Nakajima et al. |
| 5,593,808 | A | 1/1997 | Ellis |
| 5,611,881 | A | 3/1997 | Kimura et al. |
| 6,027,850 | A | 2/2000 | Kawakami et al. |

FOREIGN PATENT DOCUMENTS

| | | | |
|---|---|---|---|
| JP | 6-115265 | A | 4/1994 |
| JP | 6-122280 | A | 5/1994 |
| JP | 8-112970 | A | 5/1996 |
| JP | 9-11646 | A | 1/1997 |
| JP | 2000-71634 | A | 3/2000 |
| JP | 118144 | A | 4/2000 |
| JP | 2000-141890 | A | 5/2000 |
| JP | 2000-351279 | A | 12/2000 |
| JP | 2002347360 | A * | 12/2002 |

OTHER PUBLICATIONS

European Search Report dated Oct. 9, 2003.

* cited by examiner

*Primary Examiner*—N. Edwards
(74) *Attorney, Agent, or Firm*—Sughrue Mion, PLLC

(57) ABSTRACT

A multi-color image-forming material is disclosed comprising image-receiving sheets each having an image-receiving layer and heat transfer sheets for at least four colors, including yellow, magenta, cyan and black, each having at least a light-to-heat conversion layer and an image-forming layer on a support, the heat transfer sheets and the image-receiving sheets being respectively laminated such that the image-forming layer of the heat transfer sheet and the image-receiving layer of the image-receiving sheet are opposed to each other, whereby the irradiation with laser beam causes the area irradiated with laser beam on the image-forming layer to be transferred onto the image-forming layer in the image-receiving sheet to effect image recording, wherein the thickness of the image-forming layer in the heat transfer sheets is from 0.01 $\mu$m to 1.5 $\mu$m and the width of lines in laser-transferred image is from 0.8 to 2.0 times a half of the half-width (i.e., the half width at half maximum) of the distribution in the direction of subsidiary scanning of the integration of the binary energy distribution of laser beam spot in the direction of main scanning.

32 Claims, 11 Drawing Sheets

ENLARGED VIEW OF DOTS IN PRINTED MATTER

MULTI-COLOR IMAGE-FORMING MATERIAL AND MULTI-COLOR IMAGE-FORMING PROCESS

FIELD OF THE INVENTION

The present invention relates to a multi-color image-forming material and a multi-color image-forming process for forming a full-color image having a high resolution using laser beam. More particularly, the present invention relates to a multi-color image-forming material and a multi-color image-forming process useful for the preparation of a color proof (DDCP: direct digital color proof) or mask image in the art of printing by laser recording from digital image signal.

BACKGROUND OF THE INVENTION

In graphic art, a printing plate is made from a set of color separation films prepared from a color original through a lithographic film. In general, in order to check error in the color separation step or necessity for color correction before the final printing (actual printing), a color proof is prepared from the color separation films. A color proof is required to realize a high resolving power allowing a high reproducibility of halftone image or a high step stability. In order to obtain a color proof approximating the actual printed matter, the color proof is preferably made of the material to be used in the actual printed matter, e.g., printing paper as a substrate and pigment as a colorant. It is extremely desirable that the color proof be prepared by a dry process in the absence of developer.

As a dry process for the preparation of a color proof, a recording system for preparing a color proof directly from a digital signal has been developed with the recent spread of an electronizing system in prepressing step. Such an electronizing system is particularly adapted for the preparation of a high quality color proof and normally reproduces a halftone image having a precision of not lower than 150 lines/inch. In order to record a high quality proof from a digital signal, laser beam, which can be modulated with a digital signal and can be converged to form a fine recording beam, is used as a recording head. To this end, it is necessary that an image-forming material be developed which exhibits a high recording sensitivity to laser beam and a high resolving power allowing reproduction of a high precision halftone.

As an image-forming material to be used in the transfer image forming process using laser beam there has been known a hot-melt transfer sheet comprising a light-to-heat conversion layer which absorbs light beam to generate heat and an image-forming layer having a pigment dispersed in a hot-melt wax, binder or the like provided in this order on a support (Japanese Patent Application (Laid-Open) No. 1993-58045). In the image forming process using such an image-forming material, heat generated in the laser beam-irradiated area on the light-to-heat conversion layer causes the image-forming layer corresponding to that area to be melted and transferred to the image-receiving sheet laminated on the transfer sheet to form a transfer image on the image-receiving sheet.

Japanese Patent Application (Laid-Open) No. 1994-219052 discloses a heat transfer sheet comprising a light-to-heat conversion layer containing a light-to-heat conversion material, a heat-peeling layer having a thickness as very small as 0.03 $\mu$m to 0.3 $\mu$m, and an image-forming layer containing a colorant provided in this order on a support.

When this heat transfer sheet is irradiated with laser beam, the adhesion between the image-forming layer and the light-to-heat conversion layer, which are bonded to each other with the heat-peeling layer provided interposed therebetween, is lowered to form a high precision image on the image-receiving sheet laminated on the heat transfer sheet. The image forming process using the heat transfer sheet involves so-called "ablation". In some detail, a phenomenon is used that the area which has been irradiated with laser beam is subject to decomposition and vaporization of a part of the heat-peeling layer that weakens the adhesion between the image-forming layer and the light-to-heat conversion layer, causing the image-forming layer on the area to be transferred to the image-receiving sheet laminated on the heat transfer sheet.

These image forming processes are advantageous in that a printing paper comprising an image-receiving layer (adhesive layer) provided therein may be used as an image-receiving sheet material and a multi-color image can be easily obtained by sequentially transferring images having different colors onto the image-receiving sheet. In particular, the image-forming process using ablation is advantageous in that a high precision image can be easily obtained and is useful for the preparation of a color proof (DDCP: direct digital color proof) or a high precision mask image.

With the progress of DTP environment, CTP (Computer to Plate) system has been needed more for DDCP process proof than for proof sheet or analog process proof because it requires no step of withdrawing intermediate film. In recent years, a large-sized DDCP having a high quality, a high stability and an excellent coincidence with desired printed matter has been desired.

A laser heat transfer process allows printing with a high resolution. A laser heat transfer process has heretofore been effected in various processes such as (1) laser sublimation process, (2) laser ablation process and (3) laser melt process. However, all these processes were disadvantageous in that the resulting recorded halftone is not sharp. In some detail, the laser sublimation process (1) involves the use of a dye as a colorant and thus is disadvantageous in that the approximation to desired printed matter is insufficient. This process also involves the sublimation of a colorant and thus is disadvantageous in that the resulting halftone has a blurred contour, giving an insufficient resolution. On the other hand, the laser ablation process (2) involves the use of a pigment as a colorant and thus provides a good approximation to desired printed matter. However, this process involves the scattering of a colorant and thus is disadvantageous in that the resulting halftone has a blurred contour, giving an insufficient resolution as in the laser sublimation process. Further, the laser melt process (3) involves the flow of molten material and thus is disadvantageous in that the resulting image has no clear contour.

Moreover, when a heat transfer sheet is used particularly for color proof, it is necessary that the thickness of the image-forming layer be raised to provide the image transferred to printing paper with a required reflection OD. As a result, the heat capacity of the image-forming layer increases, causing the deterioration of the recording sensitivity and resolving power of the system.

Japanese Patent Application (Laid-Open) No. 1996-300829 and Japanese Patent Application (Laid-Open) No. 1996-300830 disclose a process which comprises controlling the color power index of carbon black to not greater than 120 or not greater than 125 to obtain a transfer image having a sufficient blackness. It is described that the coloring power index is a value determined relative to that of standard black as 100 according to ASTM N-440 and is more preferably from 30 to 100.

However, even the use of such an index gave no solution to the foregoing problems.

SUMMARY OF THE INVENTION

It is therefore an object of the present invention to provide a large-sized DDCP having a high quality, a high stability and an excellent coincidence with desired printed matter. In some detail, the present invention has the following objects:

1) The heat transfer sheet can withstand comparison of pigment colorant with desired printed matter free from the effect (i.e., the influence) of the illuminating light source and allows transfer of thin colorant film resulting in the provision of dots with an excellent sharpness and stability;
2) The image-receiving sheet can securely receive the image-forming layer of laser energy heat transfer sheet in a stable manner;
3) An image can be transferred to printing paper and a close description of texture or accurate reproduction of paper white (high key portion) can be made according to a basis weight of at least 64 to 157 g/m$^2$ as in art (coated) paper, matted paper, slightly coated paper, etc.;
4) An extremely stable transfer peelability can be obtained.

It is another object of the present invention to provide a multi-color image-forming material and a multi-color image-forming process which can form an image having a good quality and a stable transfer density on an image-receiving sheet even when laser recording is effected with a multiple laser beam having a high energy under different temperature and humidity conditions.

In particular, in order to obtain a high color proof, it is important to attain a good approximation to desired printed matter taking into account its purpose. In other words, it is important that the color hue of color proof is substantially the same as that of desired printed matter. It is also necessary that the change of visual appreciation of colors of color proof under different illuminating light sources, e.g., from fluorescent lamp and incandescent lamp be the same as that of desired printed matter.

It is therefore a further object of the present invention to provide a multi-color image-forming material which can withstand comparison of pigment colorant with desired printed matter free from the effect (i.e., influence) of the illuminating light source and thus can provide a recorded image excellent in approximation to desired printed matter.

It is a still further object of the present invention to provide a multi-color image-forming material which exhibits a high recording sensitivity and resolving power and can provide a heat transfer image having an invariably high reflection density ($OD_r$).

It is a still further object of the present invention to provide a multi-color image-forming material which can provide a heat transfer image having an invariably good resolution.

These and other objects of the present invention will become apparent from the following detailed description and examples.

These and other objects of the present invention will become apparent from the following detailed description and examples.

These objects of the present invention are accomplished by the following as pets (1) to (32) of the present invention.

(1) A multi-color image-forming material comprising image-receiving sheets each having an image-receiving layer and heat transfer sheets for at least four colors, including yellow, magenta, cyan and black, each having at least a light-to-heat conversion layer and an image-forming layer on a support, the heat transfer sheets and the image-receiving sheets being respectively laminated such that the image-forming layer of the heat transfer sheet and the image-receiving layer of the image-receiving sheet are opposed to each other, whereby the irradiation with laser beam causes the area irradiated with laser beam on the image-forming layer to be transferred onto the image-forming layer in the image-receiving sheet to effect image recording, wherein the thickness of the image-forming layer in the heat transfer sheets is from 0.01 $\mu$m to 1.5 $\mu$m and the width of lines in laser-transferred image is from 0.8 to 2.0 times a half of the half-width (i.e., the half width at half maximum: HWHM) of the distribution in the direction of subsidiary scanning of the integration of the binary energy distribution of laser beam spot in the direction of main scanning.

(2) The multi-color image-forming material as described in the above item (1), wherein the heat transfer sheets are a yellow heat transfer sheet the maximum absorbance ($\lambda$max) of which in spectral distribution falls within a range of from 380 nm to 460 nm, a magenta heat transfer sheet the maximum absorbance ($\lambda$max) of which in spectral distribution falls within a range of from 540 nm to 600 nm, a cyan heat transfer sheet the maximum absorbance ($\lambda$max) of which in spectral distribution falls within a range of from 610 nm to 730 nm and a black heat transfer sheet.

(3) The multi-color image-forming material as defined in the above item (2), wherein the half-width measured when the maximum absorbance ($\lambda$max) is 1.0 is from 90 nm to 160 nm for the yellow heat transfer sheet, from 40 nm to 130 nm for the magenta heat transfer sheet and from 90 nm to 160 nm for the cyan heat transfer sheet.

(4) The multi-color image-forming material as defined in the above item (1), wherein the change of $\Delta E$ measured with $D_{65}$ or A as a light source is not greater than 2.0 for the cyan heat transfer sheet supposing that $\Delta E$ is the color difference between the color hue (L1*a1*b1*) and the desired color hue (L2*a2*b2*) of the image-forming layer represented by the following equation:

$$\Delta E\{(L1^*-L2^*)^2+(a1^*-a2^*)^2+(b1^*-b2^*)^2\}^{0.5}$$

(5) The multi-color image-forming material as defined in the above item (4), wherein $\Delta E$ of the cyan heat transfer sheet is not greater than 15.0.

(6) The multi-color image-forming material as defined in the above item (1), wherein the change width of $\Delta E$ measured with $D_{65}$ or A as a light source is not greater than 1.5 for the magenta heat transfer sheet supposing that $\Delta E$ is the color difference between the color hue (L1*a1*b1) and the desired color hue (L2*a2*b2*) of the image-forming layer represented by the following equation:

$$\Delta E=\{(L1^*-L2^*)^2+(a1^*-a2^*)^2+(b1^*-b2^*)2\}^{0.5}$$

(7) The multi-color image-forming material as defined in the above item (6), wherein $\Delta E$ of the magenta heat transfer sheet is not greater than 16.0.

(8) The multi-color image-forming material as defined in the above item (1), wherein the change width of $\Delta E$ measured with $D_{65}$ or A as a light source is not greater than 2.0 for the yellow heat transfer sheet supposing that $\Delta E$ is the color difference between the color hue (L1*a1*b1) and the desired color hue (L2*a2*b2*) of the image-forming layer represented by the following equation:

$$\Delta E=\{(L1^*-L2^*)^2+(a1^*-a2^*)^2+(b1^*-b2^*)^2\}^{0.5}$$

(9) The multi-color image-forming material as defined in the above item (8), wherein ΔE of the yellow heat transfer sheet is not greater than 5.0.

(10) The multi-color image-forming material as defined in the above item (1), wherein the value X obtained by dividing the reflection optical density ($OD_r$) of the image-forming layer constituting the yellow heat transfer sheet comprising at least one yellow organic pigment in the image-forming layer measured through a blue filter by the thickness (unit: μm) of the image-forming layer is not smaller than 1.6.

(11) The multi-color image-forming material as defined in the above item (10), wherein the value X is not smaller than 2.0.

(12) The multi-color image-forming material as defined in the above item (1), wherein the value X obtained by dividing the reflection optical density ($OD_r$) of the image-forming layer constituting the magenta heat transfer sheet comprising at least one magenta organic pigment in the image-forming layer measured through a green filter by the thickness (unit: μm) of the image-forming layer is not smaller than 1.6.

(13) The multi-color image-forming material as defined in the above item (12), wherein the value X is not smaller than 3.0.

(14) The multi-color image-forming material as defined in the above item (1), wherein the value X obtained by dividing the reflection optical density ($OD_r$) of the image-forming layer constituting the cyan heat transfer sheet comprising at least one cyan organic pigment in the image-forming layer measured through a red filter by the thickness (unit: μm) of the image-forming layer is not smaller than 2.0.

(15) The multi-color image-forming material as defined in the above item (14), wherein the value X is not smaller than 2.9.

(16) The multi-color image-forming material as defined in the above item (1), wherein the value X obtained by dividing the reflection optical density ($OD_r$) of the image-forming layer constituting the black heat transfer sheet comprising at least one black carbon in the image-forming layer measured through a visual filter by the thickness (unit: μm) of the image-forming layer is not smaller than 2.0.

(17) The multi-color image-forming material as defined in the above item (16), wherein the value X is not smaller than 2.7.

(18) The multi-color image-forming material as defined in the above item (1), wherein the ratio of the optical density (OD) of the image-forming layer in the various heat-transfer sheets to the thickness of the image-forming layer is not smaller than 1.50, the recording area of multi-color image in the various heat transfer sheets has a size of 515 mm×728 mm, the resolution of the transferred image is not smaller than 2,400 dpi, the image-forming layer in the heat transfer sheets each comprise a polymer pigment dispersant and/or phosphoric acid ester-based pigment dispersant incorporated therein, and the polymer pigment dispersant is a copolymer or polymer blend comprising ($(C_2H_5)_2N—(CH_2)_z—O—$) (in which z represents an integer of 2 or 3), ethylene glycol and propylene glycol at a ratio of 1:X:Y in which X and Y represent a number of from 10 to 20 and from 25 to 40, respectively.

(19) The multi-color image-forming material as defined in the above item (1), wherein the heat transfer sheets each comprise an organic pigment and/or carbon black incorporated as a colorant in the image-forming layer and the organic pigment and/or carbon black is monodisperse and has a particle diameter variation coefficient of not greater than 50%.

(20) The multi-color image-forming material as defined in the above item (19), wherein the organic pigment and/or carbon black has an average particle diameter of from 50 nm to 1,000 nm.

(21) The multi-color image-forming material as defined in any one of the above items (1) to (20), wherein the transferred image has a resolution of not smaller than 2,400 dpi.

(22) The multi-color image-forming material as defined in the above item (21), wherein the transferred image has a resolution of not smaller than 2,600 dpi.

(23) The multi-color image-forming material as defined in any one of the above items (1) to (22), wherein the ratio of the optical density (OD) of the image-forming layer in the various heat transfer sheets to the thickness of the image-forming layer is not smaller than 1.50.

(24) The multi-color image-forming material as defined in the above item (23), wherein the ratio of the optical density (OD) of the image-forming layer in the various heat transfer sheets to the thickness of the image-forming layer is not smaller than 1.80.

(25) The multi-color image-forming material as defined in the above item (24), wherein the ratio of the optical density (OD) of the image-forming layer in the various heat transfer sheets to the thickness of the image-forming layer is not smaller than 2.50.

(26) The multi-color image-forming material as defined in any one of the above items (1) to (25), wherein the image-forming layer in the various heat transfer sheets and the image-receiving layer in the image-receiving sheets each exhibit a contact angle of from 7.0° to 120.0° with respect to water.

(27) The multi-color image-forming material as defined in any one of the above items (1) to (22), wherein the ratio of the optical density (OD) of the image-forming layer in the various heat transfer sheets to the thickness of the image-forming layer is not smaller than 1.80 and the image sheets each exhibit a contact angle of not more than 860 with respect to water.

(28) The multi-color image-forming material as defined in any one of the above items (1) to (27), wherein the recorded area of multi-color image has a size of 515 mm×728 mm.

(29) The multi-color image-forming material as defined in the above item (28), wherein the recorded area of multi-color image has a size of 594 mm×841 mm.

(30) The multi-color image-forming material as defined in any one of the above items (1) to (29), wherein the image-forming layer comprises a pigment and an amorphous organic polymer having a softening point of from 40° to 150° incorporated therein each in an amount of from 20% to 80% by mass (i.e., by weight) and has a thickness of from 0.2 μm to 1.5 μm.

(31) A multi-color image-forming process which comprises laminating an image-receiving sheet as defined in any one of the above items (1) to (30) with each of at least four different color heat transfer sheets as defined in any one of the above items (1) to (30) such that the image-forming layer of the heat-transfer sheet and the image-receiving layer of the image-receiving sheet are opposed to each other, irradiating the laminate with laser beam, and then transferring the laser beam-irradiated area on the image-forming layer onto the image-receiving layer in the image-receiving sheet to effect image recording, wherein the image-forming layer on the laser beam-irradiated area is transferred to the image-receiving sheet in the form of thin film.

(32) The multi-color image-forming process as defined in the above item (31), wherein when irradiated with laser beam, the light-to-heat conversion layer softens so that the image-forming layer on the light-to-heat conversion layer is pushed up and transferred to the image-receiving sheet in the form of thin film.

(33) The multi-color image-forming process as defined in the above item (1), wherein the thickness of the image-forming layer in the heat transfer sheets is from 0.01 μm to 0.9 μm.

(34) The multi-color image-forming process as defined in the above item (1), wherein the width of lines in laser-transferred image is from 0.8 to 1.7 times a half of the half-width (i.e., the half width at half maximum: HWHM) of the distribution in the direction of subsidiary scanning of the integration of the binary energy distribution of laser beam spot in the direction of main scanning.

(35) The multi-color image-forming process as defined in the above item (1), wherein the width of lines in laser-transferred image is from 0.8 to 1.2 times a half of the half-width (i.e., the half width at half maximum: HWHM) of the distribution in the direction of subsidiary scanning of the integration of the binary energy distribution of laser beam spot in the direction of main scanning.

BRIEF DESCRIPTION OF THE DRAWINGS

By way of example and to make the description more clear, reference is made to the accompanying drawings in which.

DETAILED DESCRIPTION OF THE INVENTION

Figure 1A:
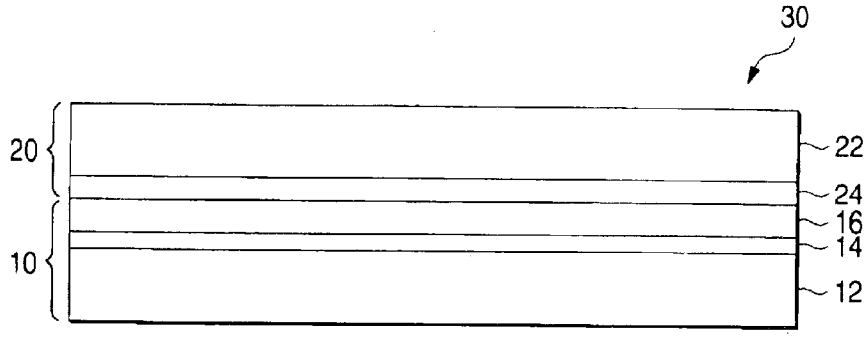
FIG. 1 is a diagram illustrating the outline of the mechanism of forming a multi-color image by a thin film heat transfer using laser.

The inventors made extensive studies of DDCP having a size as large as not smaller than B2/A2, even not smaller than B1/A1, which exhibits a high quality, a high stability and an excellent coincidence with desired printed matter. As a result, an image-forming material having a size of not smaller than B2 of the type allowing transfer to printing paper, output of actual halftone and use of pigment and a laser heat transfer recording system for DDCP comprising an outputting machine and a high quality CMS soft ware have been developed.

The features of performance, system arrangement and outline of technical points of the laser heat transfer recording system developed by the inventors will be described hereinafter. The features of performance of the laser heat transfer recording system are as follows:

(1) Since this system can print sharp dots, a halftone with an excellent approximation to desired printed matter can be reproduced;

(2) This system provides a color hue having a good approximation to desired printed matter; and (3) Since this system is little subject to the effect of ambient temperature and humidity on the record quality and provides a good reproducibility in repetition, a stable proof can be prepared.

One of the technical points of the material which can provide these features of performance is that a thin film transfer technique has been established. Another point is the improvement of retention of vacuum adhesion, responce to high resolution recording and heat resistance of the material required for laser heat transfer system. Specific examples of these technical points are as follows:

(1) To reduce the thickness of the light-to-heat conversion layer by employing an infrared-absorbing dye;

(2) To enhance the heat resistance of the light-to-heat conversion layer by employing a high Tg polymer;

(3) To stabilize color hue by employing a heat-resistant pigment;

(4) To control the adhesion/cohesive force by adding a low molecular component such as wax and inorganic pigment; and (5) To provide desired vacuum adhesion without image deterioration by incorporating a matting agent in the light-to-heat conversion layer.

The technical points of this system are as follows:

(1) The recording device performs air-aided conveyance to allow continuous accumulation of a plurality of sheets;

(2) The heat transferring device inserts a sheet over printing paper to minimize the occurrence of curling after transfer; and (3) A general-purpose output driver allowing expansion of system connection is connected to the system.

Thus, the laser heat transfer recording system developed by the inventors has various features of performance, system arrangements and technical points. However, these features of performance, system arrangements and technical points are only illustrative and don't restrict the present invention.

The inventors made this development on the basis of a concept that the individual materials, the various coat layers such as light-to-heat conversion layer, image-forming layer and image-receiving layer, and the heat transfer sheet and image-receiving sheet should not be provided separately but should be provided so as to give a comprehensive and functional performance and these image-forming materials should be combined with a recording device or a heat transferring device to accomplish the best performance. The inventors selected various coat layers of image-forming material and constituent materials with the greatest care to prepare coat layers of image-forming material which make the best use of the advantages of these materials and found a proper range of various physical properties within which these image-forming materials accomplish their performance at maximum. As a result, the inventors made an exhaustive study of the relationship between the various materials, coat layers and sheets and the physical properties and unexpectedly found a high performance image-forming material by allowing these image-forming materials to give a comprehensive and functional performance with a recording device or heat transferring device. The significance of the present invention in the system developed by the inventors is an invention defining a high performance image-forming material which supports the system developed by the inventors, i.e., a high quality image-forming material that gives a laser-recorded transfer image with little stain, and a thin film transfer process which is one of processes for obtaining such a high quality image-forming material.

In other words, the features of the present invention that the image area transferred to the image-receiving sheet faithfully reproduces the laser beam-irradiated area. In some detail, the width of lines in laser-transferred image is from 0.8 to 1.2 times, preferably from 0.95 to 1.05 times the half-width of the distribution in the direction of subsidiary scanning of the integration of the binary energy distribution of laser beam spot in the direction of main scanning. The image-forming material of the present invention differs from that for use in the conventional image forming process such as laser sublimation process, laser ablation process and laser melting process.

In the present invention, the half-width of energy distribution in the direction of subsidiary scanning of the integration in the direction of main scanning of the measurements of binary energy distribution of laser beam spot is defined as laser beam width for convenience. In the multicolor image-forming material of the present invention, the heat transfer sheet and the image-receiving sheet are arranged such that the image obtained by the transfer of the image-receiving layer in the heat transfer sheet onto the image-receiving layer in the image-receiving sheet caused by the irradiation with laser beam having a specific width is composed of lines having a width as great as 0.8 to 1.2 times the laser beam width.

The conditions of irradiation with laser beam under which a preferred laser beam width can be given in the present invention are as follows:

Atmosphere: 18° C. to 26° C.; 30 to 65% RH

Irradiation with laser beam:

Beam diameter: 10 $\mu$m to 30 $\mu$m

Main scanning speed: 1 to 20 m/sec

Light intensity at an exposed surface:

500 to 1,500 W/mm$^2$

In an embodiment of implication of the present invention, the heat transfer sheets are a yellow heat transfer sheet the maximum absorbance ($\lambda$max) of which in spectral distribution falls within a range of from 380 nm to 460 nm, a magenta heat transfer sheet the maximum absorbance ($\lambda$max) of which in spectral distribution falls within a range of from 540 nm to 600 nm, a cyan heat transfer sheet the maximum absorbance ($\lambda$max) of which in spectral distribution falls within a range of from 610 nm to 730 nm and a black heat transfer sheet. In this arrangement, a recorded image which is not affected by the illumination light source and is extremely close to the desired printed matter can be obtained as a high quality color proof.

In some detail, it is preferred that the image-forming layer in the various heat transfer sheets comprise selectively pigments, e.g., yellow pigment the maximum absorbance ($\lambda$max) of which in spectral distribution falls within a range of from 380 nm to 460 nm (more preferably from 380 nm to 430 nm), magenta pigment the maximum absorbance ($\lambda$max) of which in spectral distribution falls within a range of from 540 nm to 600 nm, cyan pigment the maximum absorbance ($\lambda$max) of which in spectral distribution falls within a range of from 630 nm to 730 nm (more preferably from 610 nm to 730 nm).

In particular, the half-width measured when the maximum absorbance ($\lambda$max) is 1.0 is preferably from 90 nm to 160 nm for the yellow pigment, preferably from 40 nm to 130 nm for the magenta pigment and preferably from 90 nm to 160 nm for the cyan pigment.

These pigments will be further described later.

In an embodiment of implication of the present invention, the cyan, magenta or yellow heat transfer sheet is arranged such that when exposed to light from light sources $D_{65}$ and A, the color difference (ΔE)of the various image-forming layers show a change of not greater than a specified value wherein ΔE is the color difference between the color hue (L1*a1*b1) and the color hue (L2*a2*b2*) in the L*a*b* space of the L*a*b* color representation system of the image-forming layer calculated by the following equation:

$$\Delta E=\{(L1^*-L2^*)^2+(a1^*-a2^*)^2+(b1^*-b2^*)^2\}^{0.5}$$

The color hue (L1*a1*b1) indicates the color hue of the image-forming layer. For the measurement of the color hue of the image-forming layer, the image-forming layer coating solution is applied to a PET base in such an amount that the thickness and OD of the various heat transfer sheets are the same as that of the heat transfer sheets actually produced in the production line, dried, and then transferred onto the image-receiving layer by means of a heat transferring device. The image-forming layer thus formed is then transferred to a paper (Tokubishi Art Paper; 128 g) together with the image-receiving layer to obtain a specimen. For the measurement of the color hue (L2*a2*b2*), Japan Color Version 2 is used.

The color difference is measured using two light sources, i.e., light source $D_{65}$ and light source A. The image-forming layer is preferably arranged such that the change of ΔE, i.e., the absolute value of difference between the former $\Delta E^1$ and the latter $\Delta E^2$ is not greater than 2.0, preferably not greater than 1.5, for the cyan heat transfer sheet, not greater than 1.5, preferably not greater than 1.0, for the magenta heat transfer sheet and not greater than 2.0, preferably not greater than 1.5, for the yellow heat transfer sheet.

For the measurement of ΔE under the various light sources, X-rite 938 (produced by X-rite Inc.) is used. The measurement is conducted at a view angle of 2° and 0/45 with black backing. The light source $D_{65}$ means a light source corresponding to daylight. The light source A means a light source corresponding to incandescent lamp.

In the present invention, by controlling the change of ΔE in the various color heat transfer sheets to not greater than the above defined value, how colors on the image transferred to paper from the actual system, i.e., heat transfer sheet preferably comprising an image-forming layer provided on a light-to-heat conversion layer through an image-receiving layer are viewed with various actual light sources (e.g., fluorescent lamp, incandescent lamp, sunshine) other than the foregoing specific light sources can be approximated to Japan Color Version 2, which is the color hue of the ideal system.

ΔE of the cyan heat transfer sheet is preferably not greater than 15.0, more preferably not greater than 4.0. ΔE of the magenta heat transfer sheet is preferably not greater than 16.0, more preferably not greater than 3.0. ΔE of the yellow heat transfer sheet is preferably not greater than 5.0, more preferably not greater than 2.0.

In an embodiment of implication of the present invention, the heat transfer sheet comprises a yellow, magenta or cyan organic pigment or carbon black incorporated as a colorant in the image-forming layer and has an X value falling within a specified range wherein X is obtained by dividing the reflection optical density ($OD_r$) of the image-forming layer through a blue, green, red or visual filter by the thickness of the image-forming layer (unit: μm).

For the measurement of reflection optical density ($OD_r$), solid image which has been heat-transferred onto the image-receiving layer is then transferred to paper. The specimen is then measured for reflection optical density through the foregoing filter by means of X-rite 938 (produced by X-rite Inc.).

By keeping X value to not smaller than a certain value for the various heat transfer sheets, even if the thickness of the image-forming layer is reduced, a transfer image having a high reflection optical density $OD_r$ can be obtained, making it possible to provide an image having a high recording sensitivity or resolution.

The specific value of X is not smaller than 1.6, more preferably not smaller than 2.0 with respect to $OD_r$ of yellow heat transfer sheet as measured through a blue filter, not smaller than 1.6, more preferably not smaller than 3.0 with respect to $OD_r$ of magenta heat transfer sheet as measured through a green filter, not smaller than 2.0, more preferably not smaller than 2.9 with respect to $OD_r$ of cyan heat transfer sheet as measured through a red filter, and not smaller than 2.0, more preferably not smaller than 2.7 with respect to $OD_r$ of black heat transfer sheet as measured through a visual filter.

Examples of the method for controlling the value X to the above defined range include a method involving the selection of a pigment having a high coloring power, and a method involving the adjustment of the amount of binder to be incorporated in the image-forming layer and the thickness of the image-forming layer.

In an embodiment of implication of the present invention, the image-forming layer of the heat transfer sheet comprises a polymer pigment dispersant having a specific structure and/or a phosphoric acid ester-based dispersant incorporated therein. In this arrangement, the dispersibility of pigment can be improved, making it possible to attain color reproducibility and coincidence with desired printed matter in color hue required for DDCP.

Further, the reduction of the thickness of the image-forming layer attained by the improvement of coloring power makes it possible to enhance sensitivity and resolving power. In some detail, combined with the use of the foregoing pigment dispersion, optional selection of a pigment having a proper chemical structure, increase of the proportion of pigment in the image-forming layer, etc., the predetermination of the ratio of the optical density (OD) of the image-forming layer of the various heat transfer sheets to the thickness of the image-forming layer (unit: μm) to not smaller than 1.50 as described later makes it possible to a sensitivity and resolving power high enough for DDCP.

Further, the use of the pigment dispersant during the production provides a coating solution having an improved stability that attains a high stability of quality.

Main representative examples of the pigment dispersant employable herein include low molecular and high molecular surface active agents. The incorporation of such a surface active agent in the mother liquor of pigment dispersion with the pigment causes the pigment dispersant to be adsorbed to the surface of the pigment, preventing the pigment from being reagglomerated and hence improving the pigment dispersibility. Referring to this mechanism, the pigment dispersant adsorbed to the surface of the pigment particles undergo steric hindrance with each other to prevent the pigment particles from approaching each other. Alternatively, the pigment dispersant having electric charge is adsorbed to the surface of the pigment to form an electrical double layer that prevents pigment particles from electrostatically approaching each other.

As the low molecular pigment dispersant there may be used a phosphoric acid ester-based dispersant. Specific examples of the phosphoric acid ester-based dispersant include Disparlon PW36 (phosphoric acid ester-based surface active agent produced by Kusumoto Chemicals Co., Ltd.).

The weight-average molecular weight of the high molecular pigment dispersant is preferably from 5,000 to 100,000. Examples of such a high molecular pigment dispersant include Disperser BYK (produced by BYKchemie) and Solsperse Series (produced ICI). Preferably, a copolymer or polymer blend comprising ($(C_2H_5)_2N—(CH_2)_z—O—$) (in which z represents an integer of 2 or 3), ethylene glycol and propylene glycol at a ratio of 1:X:Y in which X and Y represent a number of from 10 to 20 and from 25 to 40, respectively, is used.

The pigment dispersant of the present invention is used in an amount of from 1% to 50% by mass (i.e., by weight) based on the mass of the pigment.

In an embodiment of implication of the present invention, the image-forming layer comprises as a colorant an organic pigment and/or carbon black incorporated therein such that the state of the organic pigment particles and/or carbon black particles is monodisperse.

The fact that particles are monodisperse means that the distribution of particles has only one peak. However, the aggregate of organic pigment particles to be monodisperse comprises organic compounds having the same chemical structure. In this case, if a plurality of organic compound having the same color hue but different chemical structures are used, the aggregate of particles to be monodisperse comprises organic compound particles having the same chemical structure regardless of which it is dispersed in the same or different layers. In the case where as carbon black particles there are used a plurality of carbon black particles of different kinds (average particle diameter or variation coefficient), the same arrangement as in the organic pigment can be employed. Accordingly, in the present invention, a plurality of organic particulate pigments and/or particulate carbon blacks having different average particle diameters may be used so far as they are monodisperse. These organic particulate pigments and/or particulate carbon blacks may be incorporated in the same or different layers. The coefficient of variation of particle diameter of these organic particulate pigments or carbon blacks is preferably not greater than 50%, more preferably not greater than 35%. The term "particle diameter" as used herein is meant to indicate the diameter of secondary particle of pigment dispersion. The diameter of secondary particle is the diameter of particles formed by association of primary particles, which are unassociated independent particles. For the measurement of the coefficient of variation of particle diameter, a dynamic light scattering process (Type N-4 dynamic light scattering meter produced by Coal Tar Inc.) is employed. The coefficient of variation of particle diameter is defined by $100\times\sigma/d$ (%) wherein d represents the average particle diameter and $\sigma$ represents the target deviation of particle diameters.

The term "organic pigment" as used herein is meant to indicate a colorant made of an organic compound which assumes yellow, magenta, cyan or black color.

The average particle diameter of the organic pigment and/or carbon black is preferably from 50 nm to 1,000 nm, more preferably from 100 nm to 700 nm. When the average particle diameter of the organic pigment and/or carbon black falls below 50 $\mu$m, it can add to the dispersion cost or the resulting dispersion can undergo gelation or the like. On the contrary, when the average particle diameter of the organic pigment and/or carbon black exceeds 1,000 $\mu$m, it impairs the transparency of the image-forming layer or a sufficient coloring power cannot be obtained.

As a method for obtaining a monodisperse organic pigment and/or carbon black there may be used a method which comprises selecting the method for dispersing these particles as well as adjusting the dispersion time or the like.

In the present invention, the ratio of the optical density (OD) of the image-forming layer of the various heat transfer sheets to the thickness (unit: $\mu$m) of the image-forming layer (hereinafter occasionally referred to as "OD/T") can be controlled to not greater than 1.50, making it possible to obtain an image having a sufficient transfer density and a high resolving power to advantage. OD/T is preferably not smaller than 1.80, more preferably not smaller than 2.50.

By controlling OD/T to the above defined range, an image having a high transfer density and a good resolving power can be obtained. Further, the thickness of the image-forming layer can be further reduced, making it possible to improve the color reproducibility.

The term "optical density" as used herein is meant to indicate the value measured with various color modes such as yellow (Y), magenta (M), cyan (C) and black (K) on an image which has been transferred from the heat transfer sheet to the image-receiving sheet and then to Tokubishi art paper using a Type X-rite 938 densitometer (produced by X-rite Inc.).

In the present invention, the contact angle against water of the image-forming layer of the various heat transfer sheets and the image-receiving layer of the image-receiving sheets are each preferably controlled to a range of from 7.0° to 120.0° to lower the dependence of recording properties on temperature and humidity and enhance the transfer sensitivity. The contact angle against water is more preferably from 30.0° to 100.0°. When the contact angle is not greater than 7.0°, the effect of temperature and humidity during recording causes the deterioration of the stability of recorded image. On the contrary, when the contact angle is not smaller than 120.0°, the resulting transfer sensitivity is lowered.

For the measurement of the contact angle of the surface of these layers with respect to water, a Type CA-A contact angle meter (produced by Kyowa Interface Science Co., LTD.) is used.

It is also preferred that OD/T of the image-forming layer of the various heat transfer sheets be not smaller than 1.80 and the contact angle against water of the image-receiving sheet be not smaller than 86°.

Further, in the present invention, the ratio of the optical density ($OD_{LH}$) of the light-to-heat conversion layer of the various heat transfer sheets to the thickness ($\mu$m) of the light-to-heat conversion layer is preferably controlled to not smaller than 4.36, making it possible to efficiently convert laser beam to heat and hence provide a multi-color image-forming material having a high transfer sensitivity.

The multi-color image-forming process of the present invention comprises transferring an image-forming layer on the laser beam-irradiated area in the form of thin film using the foregoing multi-color image-forming material of the present invention.

In accordance with the present invention, the thin film transfer process developed by the inventors makes it possible to obtain a multi-color image-forming material having an excellent resolving power which provides a transfer image free of stain. This thin film transfer process is better than the conventional process such as (i) laser sublimation process, (ii) laser ablation process and (iii) laser melt process. It is a matter of course that the process to which the multi-color image-forming material of the present invention can be applied is not limited to these processes. At the same time, many of the various techniques incorporated in the system developed by the inventors can be applied to the foregoing conventional processes and improved, making it possible to contribute to the provision of a multi-color image-forming material and multi-color image-forming process having a high resolving power.

The entire system developed by the inventors, including the content of the present invention, will be described hereinafter. In the system of the present invention, a thin film heat transfer process was invented and employed to attain a high resolution and a high image quality. The system of the present invention can provide a transfer image having a resolution of not smaller than 2,400 dpi, preferably not smaller than 2,600 dpi. A thin film heat transfer process comprises transferring an image-forming layer having a thickness as small as 0.01 μm to 0.9 μmn to an image-receiving layer in partly unmelted form or little melted form. In other words, a heat transfer process having an extremely high resolution attained by the transfer of recorded area in the form of thin film was developed. A preferred method for efficiently effecting thin film heat transfer comprises effecting optical recording to deform the interior of the light-to-heat conversion layer into a dome so that the image-forming layer is pushed up to enhance the adhesion between the image-forming layer and the image-receiving layer, facilitating transferring. When the deformation is great, the resulting pushing power of the image-forming layer against the image-receiving layer is increased to facilitate transferring. On the contrary, when the deformation is small, the resulting pushing power of the image-forming layer against the image-receiving layer is small, leaving some areas insufficiently transferred. The deformation suitable for thin film transfer will be described hereinafter. The deformation is observed under a laser microscope (Type VK8500, produced by KEYENCE CORPORATION). The magnitude of deformation can be evaluated by percent deformation calculated by the multiplication of the division of the sum of the increase (a) of the section area of the recorded area on the light-to-heat conversion layer after recording and the section area (b) of the recorded area on the light-to-heat conversion layer before recording by the section area (b) by 100, i.e., $\{(a+b)/(b)\}\times 100$. The percent deformation is not smaller than 110%, preferably not smaller than 125%, more preferably not smaller than 150%. If the elongation at break of the sheet is predetermined great, the percent deformation may be greater than 250%. However, it is usually preferred that the percent deformation be kept to not greater than about 250%.

The technical points of the image-forming material in the transfer of thin film are as follows:

1. Both a high heat responce and storage properties are attained.

In order to attain a high image quality, it is necessary that a film having a thickness on the order of submicron be transferred. However, in order to provide a desired density, it is necessary that a layer having a pigment dispersed therein in a high concentration be prepared. This conflicts with heat responce. Heat responce conflicts with storage properties (adhesion). These conflicts were eliminated by the development of novel polymers/additives.

2. A high vacuum adhesion is secured.

In the thin film transfer in which high resolution is required, though it is preferred that the transfer interface is smooth, sufficient vacuum adhesion can not be yet obtained.

Without being free from the conventional common sense, when the matting agent having a relatively small particle size is incorporated in a large amount in the layer which is under the image-forming layer, the gap between the heat transfer sheet and the image-receiving layer is suitably uniformly kept, the generation of the image black spots due to the matting agent is prevented. As a result, the thin film transfer performance is ensured to impart the vacuum adhesion.

3. Use of a heat resisting organic material upon the laser recording, the temperature of the light-to-heat conversion layer in which the laser beam (i.e., the laser light) is converted to heat becomes about 700° C. and the temperature of the image-forming layer containing pigment colorants becomes about 500° C.

As the material for the light-to-heat conversion layer, the modified polyimide which can be dissolved in the organic solvent is developed and thereby the pigments high heat resistance and safe color hue as compared with the pigments for printing are developed as the pigment colorants.

4. Insurance of surface cleaning property

In the thin film transfer, the image defect is generated by dust which is present between the heat transfer sheet and the image-receiving layer, which becomes serious problem.

The dust is entered from outside of the device or the dust is generated by cutting of the material.

Accordingly, since the generation of the dust is not sufficient prevented by administration of the material, it is required that the system for removing the dust is equipped in the device.

Now, the inventors have been found out the material keeping suitable adhesion which can clean the surface of the transfer material and then the material is used for the conveying roll. As a result, the removal of dust can be achieved without decrease of productivity.

The entire system of the present invention will be further described hereinafter.

The present invention preferably realizes the formation of a heat transfer image by sharp dots and allows image transfer to paper and image recording on paper having a size of not smaller than B2 (515 mm×728 mm). More preferably, B2 size is 543 mm×841 mm. The system of the present invention allows image recording on paper having a size of not smaller than this B2 size.

One of the features of the system developed in the present invention is that sharp dots can be obtained. The heat transfer image obtained in this system has a resolution of not smaller than 2,400 dpi, preferably not smaller than 2,600 dpi, and thus can be a halftone image formed according to the number of printed lines. Since every dot has little or no stain and lacks and has a very sharp shape, halftone can be clearly formed over a wide range of from highlighted area to shadow. As a result, the system of the present invention can output a high quality halftone at the same resolution as in image setter or CTP setter, making it possible to reproduce halftone and gradation having a good approximation to desired printed matter.

The second feature f the system developed in the present invention is that the system of the present invention provides a good reproducibility in repetition. Since the heat transfer image thus reproduced has sharp dots, dots can be faithfully reproduced according to laser beam. Further, since the dependence of the recording properties on the ambient temperature and humidity is very small, a stable reproducibility in repetition can be obtained both with color hue and density in a wide temperature and humidity atmosphere.

The third feature of the system developed in the present invention is that the system of the present invention provides a good color reproducibility. The heat transfer image obtained in the system is formed by coloring pigments which are commonly incorporated in printing inks. Further, since this system provides a good reproducibility in repetition, a high precision CMS (color management system) can be realized.

Further, this heat transfer image can have substantially the same color hues as that of Japan Color, SWOP Color, etc., i.e., printed matter. This heat transfer image can also show the same change of visual appreciation of colors as desired printed matter with change of light sources such as fluorescent lamp and incandescent lamp.

The fourth feature of the system developed in the present invention is that the system of the present invention provides a good character quality. The heat transfer image obtained in this system has sharp dots and thus realizes sharp reproduction of fine lines constituting fine characters.

The features of the technique of material of the system of the present invention will be further described hereinafter. Examples of heat transfer process for DDCP include (i) sublimation process, (ii) ablation process, and (iii) heat melt process. The processes (i) and (ii) involve the sublimation or scattering of coloring material and are disadvantageous in that the resulting dots have a blurred contour. On the other hand, the process (iii), too, involves the flow of molten material and thus is disadvantageous in that the resulting dots cannot be provided with a clear contour. The inventors made clear new problems in the laser heat transfer system on the basis of thin film transfer technique and proposed the following technique for higher image quality. The first feature of the material technique is to sharpen the dot shape. In some detail, laser beam is converted to heat in the light-to-heat conversion layer. The heat is then transferred to the image-forming layer to allow the image-forming layer to be bonded to the image-receiving layer. In this manner, image recording is effected. In order to sharpen the dot shape, heat developed by laser beam is transferred to the transfer interface without being diffused horizontally so that the image-forming layer undergoes sharp break at the heated portion-unheated portion interface. In this arrangement, the thickness of the light-to-heat conversion layer in the heat transfer sheet can be reduced. Further, the dynamic properties of the image-forming layer can be controlled.

The first technique for sharpening the dot shape is to reduce the thickness of the light-to-heat conversion layer. A simulation of this mechanism shows that the temperature of the light-to-heat conversion layer momentarily reaches about 700° C. Thus, when the thickness of the light-to-heat conversion layer is too small, the light-to-heat conversion layer can easily undergo deformation or fracture. Once deformed or fractured, the light-to-heat conversion layer can be transferred to the image-receiving sheet with the image-forming layer. Other defectives include ununiform transfer image. On the other hand, in order to obtain a predetermined temperature, it is necessary that a light-to-heat conversion material be present in the light-to-heat conversion layer in a high concentration, causing the deposition of dyes or the migration of dyes to the adjacent layers. As the light-to-heat conversion material there has heretofore been often used carbon black. In the present invention, however, an infrared-absorbing dye, the required amount of which is smaller than that of carbon black, was used. As the binder there was used a polyimide-based compound which has a sufficient dynamic strength and can fairly retain an infrared-absorbing dye therein.

By thus selecting an infrared-absorbing dye having excellent light-to-heat conversion properties and a heat-resistant binder such as polyimide-based compound, the thickness of the light-to-heat conversion layer is preferably reduced to about not greater than 0.5 $\mu$m.

The second technique for sharpening the dot shape is to improve the properties of the image-forming layer. When the light-to-heat conversion layer undergoes deformation or the image-forming layer itself undergoes deformation when acted upon by high heat, the image-forming layer which has been transferred to the image-receiving layer undergoes unevenness corresponding to pattern of subsidiary scanning of laser beam, giving ununiform image and lowering apparent transfer density. This tendency becomes more remarkable as the thickness of the image-forming layer decreases. On the other hand, when the thickness of the image-forming layer increases, the resulting dots have impaired sharpness and the sensitivity is lowered.

In order to meet the two conflicting requirements at the same time, a low melting material such as wax is preferably incorporated in the image-forming layer to eliminate uneven transfer. Alternatively, an inorganic particulate material may be incorporated in the image-forming layer instead of binder to properly increase the thickness of the image-forming layer so that the image-forming layer can undergo sharp break at the heated portion-unheated portion interface, making it possible to eliminate uneven transfer while keeping desired sharpness of dots and sensitivity.

In general, a low melting material such as wax tends to ooze out of the surface of the image-forming layer or undergo crystallization and thus can impair the image quality or the age stability of the heat transfer sheet.

In order to solve this problem, a low melting material having a small difference in Sp value from that of the polymer of the image-forming layer is preferably used. Such a low melting material has a high compatibility with the polymer and thus can be prevented from being separated from the image-forming layer. Alternatively, several kinds of low melting materials having different structures are preferably mixed to prepare a eutectic mixture that prevents crystallization. As a result, an image having sharp dots and little unevenness is obtained.

The second feather of the material technique is the discovery of the fact that the recording sensitivity is dependent on temperature and humidity. In general, when moistened, the coat layer of heat transfer sheet shows a change of dynamic properties and thermal properties to render the recording conditions dependent on humidity.

In order to eliminate this dependence on temperature and humidity, the dye/binder system of the light-to-heat conversion layer and the binder system of the image-forming layer each are preferably an organic solvent system. As the binder to be incorporated in the image-receiving layer there is preferably used a polyvinyl butyral. At the same time, in order to lower the water absorption of the binder, a polymer hydrophobicizing technique is preferably employed. Examples of such a polymer hydrophobicizing technique include a method involving the reaction of hydroxyl group with hydrophobic group as described in Japanese Patent Application (Laid-Open) No. 1996-238858, and a method involving the crosslinking of two or more hydroxyl groups with a hardener.

The third feature of the material technique is that the approximation of color hue to desired printed matter has been improved. In addition to color matching of pigment in color proof (e.g., First Proof, produced by Fuji Photo Film Co., Ltd.) of thermal head process and technique for stable dispersion, the use of a laser heat transfer system made clear the following new problems. In some detail, the first technique for improving the approximation of color hue to desired printed matter is to use a highly heat-resistant pigment. In general, the image-forming layer, too, is heated to a temperature as high as about 500° C. or higher during printing by laser exposure. Thus, some of pigments which have heretofore been used for this purpose undergo thermal decomposition. This difficulty can be eliminated by using a pigment having a high heat resistance in the image-forming layer.

The second technique for improving the approximation of color hue to desired printed matter is to prevent the diffusion of an infrared-absorbing dye. In order to prevent the infrared-absorbing dye from migrating from the light-to-heat conversion layer to the image-forming layer to cause change of color hue when acted upon by high heat upon printing, the light-to-heat conversion layer is preferably designed by combining an infrared-absorbing dye and a dye having a strong retention as described above.

The fourth feature of the material technique is to enhance sensitivity. In general, energy runs short during high speed printing, causing the occurrence of a gap corresponding to the pitch of subsidiary scanning of laser beam. As previously described, the enhancement of the concentration of dye in the light-to-heat conversion layer and the reduction of the thickness of the light-to-heat conversion layer and the image-forming layer make it possible to enhance the efficiency of generation/transmission of heat. Further, for the purpose of allowing the image-forming layer to flow slightly and fill the gap upon heating and enhance the adhesion to the image-receiving layer, the image-forming layer preferably comprises a low melting material incorporated therein. In order to enhance the adhesion between the image-receiving layer and the image-forming layer and hence provide the transferred image with a sufficient strength, as the binder to be incorporated in the image-receiving layer there is preferably used a polyvinyl butyral as in the image-forming layer.

The fifth feature of the material technique is to improve vacuum adhesion. It is preferred that the image-receiving sheet and the heat transfer sheet be retained on a drum by vacuum suction. Vacuum adhesion is important because the formation of an image is carried out by controlling the adhesion between the two sheets and the transfer behavior of image is very sensitive to the clearance between the surface of the image-receiving layer of the image-receiving sheet and the surface of the image-forming layer of the transfer sheet. When the entrance of foreign matters such as dust causes the increase of clearance between the two materials, image defectives or uneven image transfer can occur.

In order to prevent the occurrence of these image defectives or uneven image transfer, the heat transfer sheet is preferably provided with uniform unevenness to facilitate the passage of air and hence obtain a uniform clearance.

The first technique for improving vacuum adhesion is to roughen the surface of the heat transfer sheet. In order to exert a sufficient effect of vacuum adhesion even in lap printing of two or more colors, the heat transfer sheet is provided with unevenness. The provision of the heat transfer sheet with unevenness is normally accomplished by post-treatment such as embossing or the incorporation of a matting agent in the coat layer. In order to simplify the production process or stabilize the age stability of the material, the incorporation of a matting agent in the coat layer is preferred. The matting agent to be used herein needs to be greater than the thickness of the coat layer. When a matting agent is incorporated in the image-forming layer, the resulting image lacks at the area where the matting agent exists. Thus, it is preferred that a matting agent having an optimum particle diameter be incorporated in the light-to-heat conversion layer. In this arrangement, the image-forming layer itself has a substantially uniform thickness, making it possible to obtain an image free of defects on the image-receiving sheet.

The features of the systematizing technique of the system of the present invention will be described hereinafter. The first feature of the systematizing technique is the arrangement of the recording device. In order to assure the realization of sharp dots as described above, the recording device, too, must be designed to a high precision. The basic arrangement of the system of the present invention is similar to that of conventional laser heat transfer recording device. This arrangement forms a so-called heat mode outer drum recording system in which a recording head provide with a plurality of high power lasers emits a laser beam to a heat transfer sheet and an image-receiving layer fixed to a drum to effect recording. Among these arrangements, the following embodiment is preferred.

The first arrangement of recording device is to avoid the entrance of dust. The supply of the image-receiving sheet and the heat transfer sheet is carried out by a full automatic roll supply system. The supply of a small number of sheets is carried out by a roll supply system because much dust produced from the human body enters in the recording device.

A roll is provided for four color heat transfer sheets. A loading unit is rotated to switch among the various color rolls. The various films are each cut into a predetermined length by a cutter during loading, and then fixed to the drum. The second arrangement of recording device is to enhance the adhesion the image-receiving sheet on the recording drum to the heat transfer sheet. The fixing of the image-receiving layer and the heat transfer sheet to the recording drum is accomplished by vacuum suction. This is because mechanical fixing cannot enhance the adhesion between the image-receiving sheet and the heat transfer sheet. The recording drum has a number of vacuum suction holes formed on the surface thereof such that the sheet is sucked by the drum when the pressure in the interior of the drum is reduced by a blower or vacuum pump. Since the heat transfer sheet is sucked by the image-receiving sheet which has been sucked by the drum, the heat transfer sheet is designed to have a greater size than the image-receiving sheet. The air occurring between the heat transfer sheet and the image-receiving sheet which has the greatest effect on the recording properties comes only from the area of the heat transfer sheet outside the image-receiving sheet.

The third arrangement of recording device is to pile up a plurality of sheets on the discharge-receiving tray in a stable manner. In the present recording device, a number of sheets having an area as large as B2 size or more can be piled up on the discharge-receiving tray. When a sheet B is outputted onto the image-receiving layer of a thermal adhesive film A which has been outputted on the discharge-receiving tray, the two sheets can be stuck to each other. This trouble prevents the subsequent sheet from being completely outputted onto the discharge-receiving tray, causing jamming. Sticking can be best prevented by preventing the films A and B from being in contact with each other. Several methods for preventing contact are known. Examples of these methods include (a) method which comprises providing the discharge-receiving tray with a difference in level so that the film outputted thereonto is not flat to make a gap between the films, (b) structure in which the outlet port is provided higher than the discharge-receiving tray so that the outputted film drops onto the discharge-receiving tray, and (c) method which comprises blowing air into the gap between the two films so that the upper film is floated up. In this system, since the maximum allowable sheet size is as very large as B2, the air blowing method (c) is employed rather than the methods (a) and (b), which require a very large structure. Accordingly, the method which comprises blowing air into the gap between the two films so that the upper film is floated up is employed herein.

Figure 2:
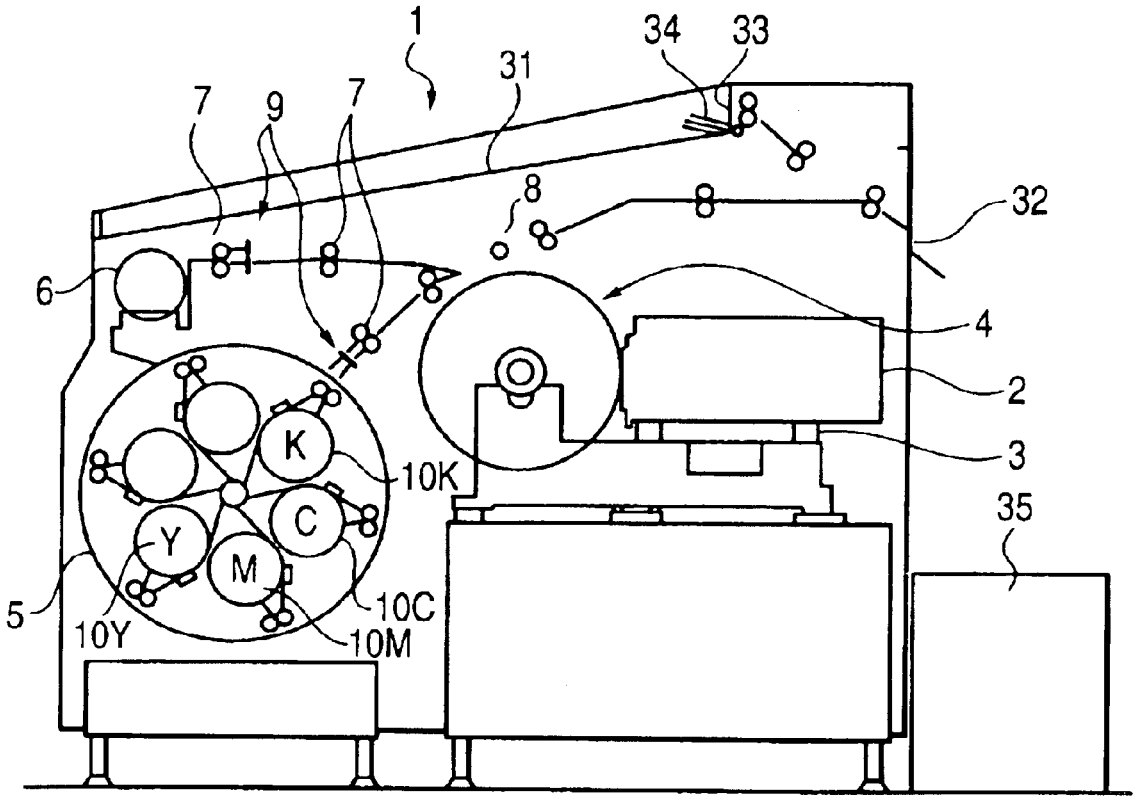
FIG. 2 is a diagram illustrating an example of the arrangement of laser heat transfer recording device.

An example of the structure of the device of the present invention will be shown in FIG. 2.

A sequence for the formation of a full-color image using an image-forming material in the foregoing device (hereinafter referred to as "image-forming sequence of the system of the present invention") will be described hereinafter.

1) The subsidiary scanning axis of a recording head 2 of a recording device 1 returns to the original point along the subsidiary scanning rail 3. Further, the main scanning rotary axis of a recording drum 4 and a heat transfer sheet loading unit 5 return to the original point.
2) An image-receiving roll 6 is unwound by a conveying roller 7, and then vacuum-sucked by the recording drum 4 at the forward end thereof through suction holes formed in the recording drum 4 so that it is fixed to the recording drum 4.
3) A squeeze roller 8 then comes down onto the recording drum 4. While being pressed by the squeeze roller 8, the recording drum 4 rotates until the image-receiving sheet is conveyed by a predetermined length at which it is then cut by a cutter.
4) The recording drum 4 then rotates by one turn to complete the loading of the image-receiving sheet.
5) A sequence similar to that of image-receiving sheet is performed so that a first color (black) heat transfer sheet K is drawn out from a heat transfer sheet roll 10K, cut and then charged onto the drum.
6) Subsequently, the recording drum 4 beings to rotate and the recording head 2 begins to move along the subsidiary scanning rail 3. When the recording starting point is reached, the recording head 2 causes the recording drum 4 to be irradiated with a recording laser beam according to a recording image signal. Irradiation ends at the recording termination point and the movement of the recording head 2 and the rotation of the recording drum stop. The recording head on the subsidiary scanning rail is returned to the original point.
7) The heat transfer sheet K alone is peeled off the recording drum leaving the image-receiving sheet behind. To this end, the heat transfer sheet K is caught by a nail at the forward end thereof, and then pulled out of the recording drum in the discharging direction. The heat transfer sheet K is then discharged into a waste box 35 through a waste port 32.
8) The foregoing procedures (5) to (7) are repeated for the remaining three colors. The order of colors to be recorded is black, cyan, magenta and yellow. In some detail, a second color (cyan) heat transfer sheet C, a third color (magenta) heat transfer sheet M and a fourth (color) heat transfer sheet Y are sequentially drawn out of a heat transfer sheet roll 10C, a heat transfer sheet roll 10M and a heat transfer sheet roll 10Y, respectively. This order of printing is reverse to the ordinary printing order. This is because these colors are transferred to printing paper in this order at the subsequent step.
9) When the procedures for four colors are completed, the image-receiving sheet on which image recording has been made is finally discharged onto the discharge-receiving tray 31. In order to peel the image-receiving sheet off the recording drum, the same method as used in the procedure (7) may be used. However, since the image-receiving sheet is not discarded unlike the heat transfer sheet, the image-receiving sheet is turned at the waste port 32 toward the discharge-receiving tray 31 by a switchback mechanism. The image-receiving sheet which is being outputted onto the discharge-receiving tray 31 is blown by air 34 from below through a discharge port 33 so that a plurality of image-receiving sheets can be piled up without any trouble.

As any of conveying rollers 7 to be provided at the supplying site or conveying site for the heat transfer sheet roll and image-receiving sheet roll there is preferably used an adhesive roller provided with an adhesive material on the surface thereof.

The provision of such an adhesive roller makes it possible to clean the heat transfer sheet and the image-receiving sheet.

Examples of the adhesive material to be provided on the surface of the adhesive roller include ethylene-vinyl acetate copolymer, ethylene-ethyl acrylate copolymer, polyolefin resin, polybutadiene resin, styrene-butadiene copolymer (SBR), styrene-ethylene-butene-styrene copolymer (SEBS), acrylonitrile-butadiene copolymer (NBR), polyisoprene resin (IR), styrene-isoprene copolymer (SIS), acrylic acid ester copolymer, polyester resin, polyurethane resin, acrylic resin, butyl rubber, and polynorbornene.

The adhesive roller comes in contact with the surface of the heat transfer sheet and the image-receiving sheet to clean them. The required contact is not specifically limited so far as the adhesive roller comes in contact with the surface of the heat transfer sheet and the image-receiving sheet.

The adhesive material to be used in the adhesive roller preferably has a Vickers hardness Hv of not greater than 50 $kg/mm^2$ (approximately equal to 490 MPa) to fully remove dust as foreign matter and hence inhibit the occurrence of image defects.

Vickers hardness is defined by the hardness value determined on a specimen under a static load of a pyramid diamond indenter having an angle of 136° between the opposite faces. Vickers hardness Hv can be determined by the following equation:

$$\text{Hardness } Hv=1.854P/d^2(\text{kg/mm}^2) \text{ (approximately equal to } 18.1692\ P/d^2 \text{ (MPa)}$$

wherein P is the magnitude of load (Kg); and d is the length of diagonal line of the square of indentation (mm).

In the present invention, the adhesive material to be used in the adhesive roller preferably exhibits an elastic modulus of 200 kg/cm2 (approximately equal to 19.6 MPa) at 20° C. to fully remove dust as foreign matter and hence inhibit the occurrence of image defects as described above.

The second feature of the systematizing technique is an arrangement of heat transferring device.

In order to effect a step of transferring the image-receiving sheet on which an image has been printed by the recording device onto printing paper, a heat transferring device is used. This step is quite the same as First Proof™. When heat and pressure are applied to a laminate of the image-receiving sheet and the printing paper, the two sheets are bonded to each other. Thereafter, when the image-receiving film is peeled off the printing paper, the support of the image-receiving sheet and the cushioning layer are removed leaving only the image and the adhesive layer behind on the printing paper. Accordingly, the image is practically transferred from the image-receiving sheet to the printing paper.

Figure 3:
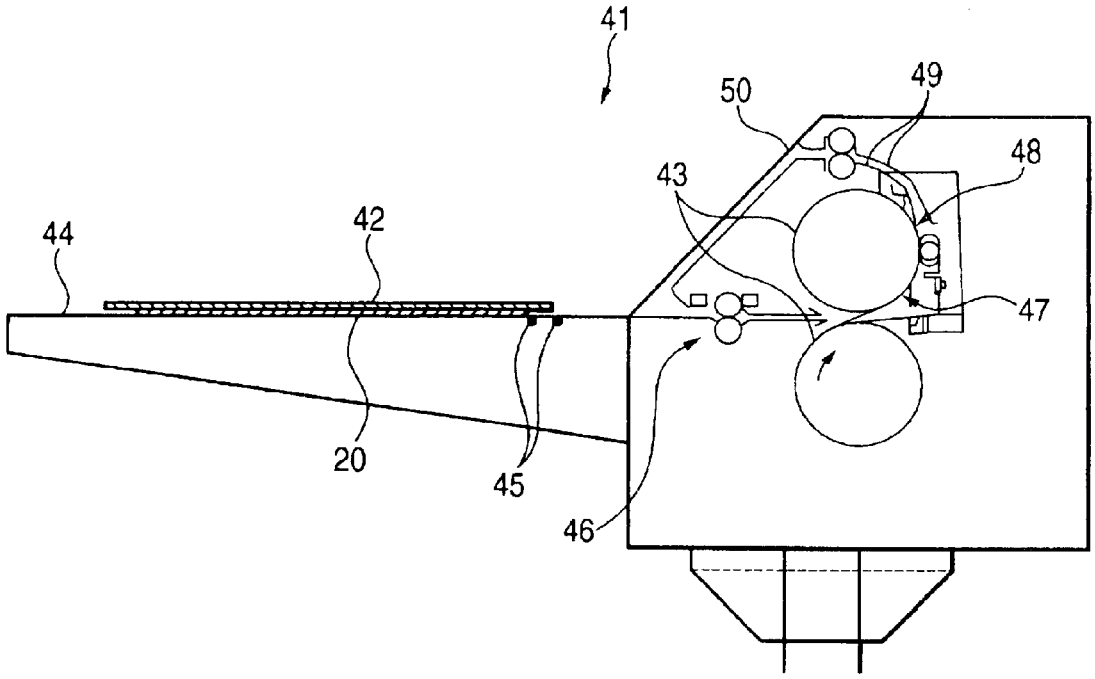
FIG. 3 is a diagram illustrating an example of the arrangement of heat transfer device.

In First Proof™, the printing paper and the image-receiving sheet are laminated on an aluminum guide plate. The laminate is then passed through the gap between heat rollers to effect transfer. The purpose of using such an aluminum guide plate is to prevent the deformation of the printing paper. However, when First Proof™ is employed in the system of the present invention, which allows image recording on B2 size paper at maximum, an aluminum guide plate having a size of greater than B2 is needed, requiring a larger facility installation space. Accordingly, the system of the present invention employs a structure allowing the rotation of the conveying path by 180° so that the printing paper is discharged toward the supply side instead of aluminum guide plate. In this arrangement, the required installation space is reduced (FIG. 3). However, since no aluminum guide plate is used, a problem arose that the printing paper is deformed. In some detail, the pair of printing paper and image-receiving sheet discharged is curled with the image-receiving sheet inside and rolls over on the discharge-receiving tray. It is a very difficult job to peel the image-receiving sheet off the curled printing paper.

To work out a method for preventing curling, a bimetal effect developed by the difference in shrinkage between the printing paper and the image-receiving sheet and an iron effect developed by the structure for winging on a heat roller should be taken into account. In the case where the image-receiving sheet is inserted while being laminated on the printing paper as in the conventional process, the thermal shrinkage of the image-receiving sheet in the direction of insertion is greater than that of the printing paper. Therefore, the bimetal effect causes the laminate to be curled with the upper sheet inside. This curling occurs in the same direction as that developed by the iron effect. The resulting synergistic effect adds to curling effect. However, when the image-receiving sheet is inserted while being disposed under the printing paper, downward curling developed by the bimetal effect and upward curling developed by the iron effect are compensated each other to advantage.

The sequence for image transfer to printing paper (hereinafter referred to as "process for image transfer to printing paper used in the system of the present invention") will be described hereinafter. A heat transfer device 41 shown in FIG. 3 used in this process is a device requiring manual job unlike the recording device.

1) Firstly, the temperature (100° C. to 110° C.) of a heat roller 43 and the conveying speed during transfer are predetermined by dialing (not shown) according to the kind of printing paper.
2) Subsequently, the image-receiving sheet 20 is disposed on the inserting tray with the image side facing upward. Dust is then removed from the image with a destaticizing brush (not shown). The printing paper 42 from which dust has been removed is then imposed on the image-receiving sheet 20. Since the printing paper 42 which is disposed above the image-receiving film 20 is grater in size than the image-receiving film 20, the position of the image-receiving sheet 20 cannot be seen, making it difficult to register the two sheets. In order to improve the efficiency of this job, the insertion tray 44 is provided with marks 45 indicating the predetermined position of the image-receiving sheet and the printing paper, respectively. The reason why the printing paper is larger than the image-receiving sheet is to prevent the image-receiving sheet from being displaced from the printing paper 42 to stain the heat roller 43 with the image-receiving layer.
3) When the laminate of the image-receiving sheet and the printing paper is pushed into the insertion port, an insertion roller 46 then rotates to convey the two sheets toward the heat roller 43.
4) When the forward end of the printing paper reaches the heat roller 43, the printing paper is nipped by the pair of heat rollers 43 to begin image transfer. The heat roller is a heat-resistant silicone rubber roller. When heat and pressure are simultaneously applied to the laminate, the image-receiving sheet and the printing paper are bonded to each other. There is provided a guide 47 downstream from the heat rollers. The laminate of image-receiving sheet and printing paper is then conveyed upward through the gap between the upper heat roller and the guide 47 while being heated. The laminate is then peeled off the heat roller at a peeling nail 48. The laminate is then introduced to a discharge port 50 along a guide plate 49.
5) The image-receiving sheet and the printing paper which have been discharged from the discharge port 50 are discharged onto the insertion tray while being still laminated. Thereafter, the image-receiving sheet 20 is manually peeled of the printing paper 42.

The second feature of the systematizing technique is an arrangement of the system.

By connecting the foregoing device to a plate-making system, a function of color proof can be performed. This system needs to output from the proof a printed matter having an image quality infinitely close to that of a printed matter outputted from a plate-making data. To this end, a soft ware for approximating the color and halftone of the output to that of printed matter is required. Specific examples of connection of the foregoing device to a plate-making system will be given below.

In the case where a proof of printed matter from a plate-making system called "Celebra™" (produced by Fuji Photo Film Co., Ltd.) is required, the following system connection is employed. To Celebra is connected a CTP (Computer to Plate) system. The printing plate thus outputted can then be mounted on a printing machine to obtain a final printed matter. To Celebra is connected Luxel FINALPROOF 5600 (hereinafter referred also to as "FINALPROOF") (produced by Fuji Photo Film Co., Ltd.) as the foregoing recording device. PD™ (produced by Fuji Photo Film Co., Ltd.) is provided in between Celebra and FINALPROOF for approximating the color and halftone of color to that of desired printed matter.

Figure 4:
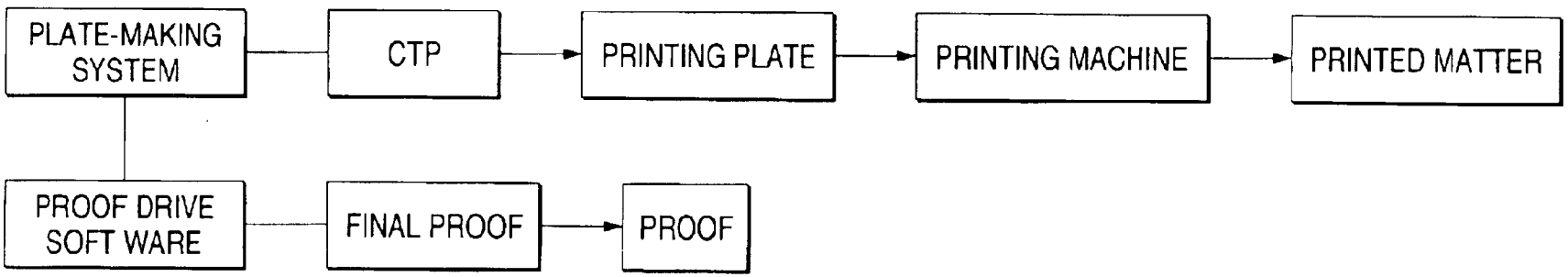
FIG. 4 is a diagram illustrating an example of the arrangement of system comprising laser heat recording device FINALPROOF.
Figure 5:
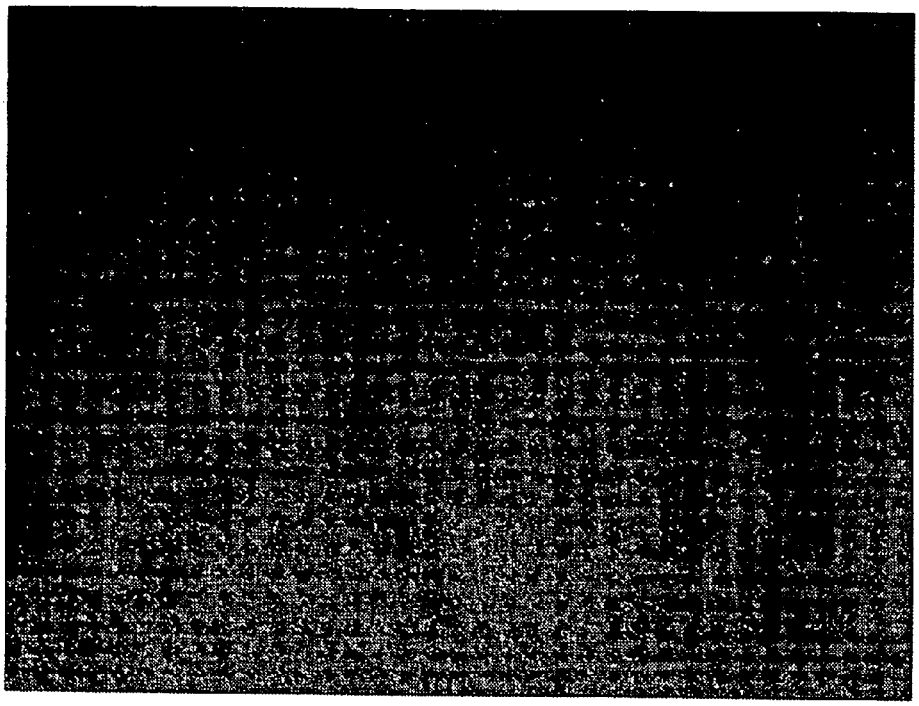
FIG. 5 illustrates the shape of dots of an image obtained in an example wherein the distance between the center of the dots is 125 μm.
Figure 6:
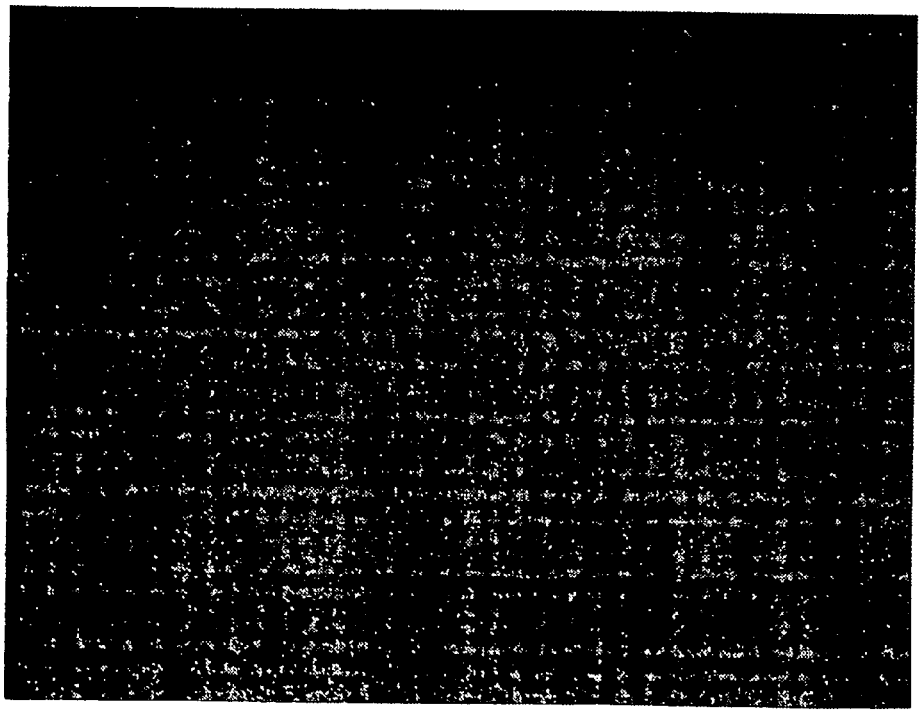
FIG. 6 illustrates the shape of dots of an image obtained in another example wherein the distance between the center of the dots is 125 μm.
Figure 7:
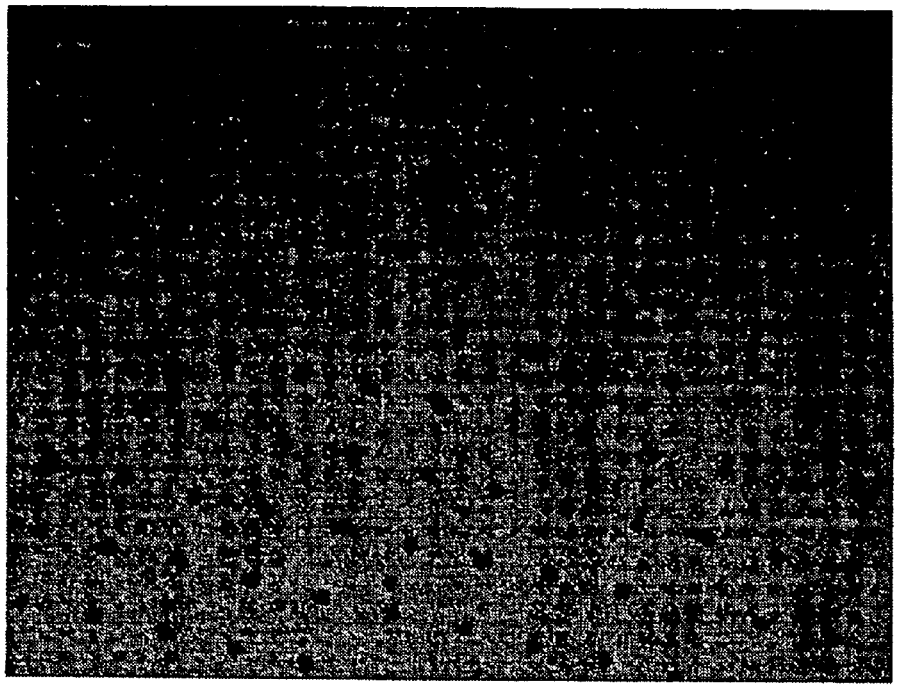
FIG. 7 illustrates the shape of dots of an image obtained in a further example wherein the distance between the center of the dots is 125 μm.
Figure 8:
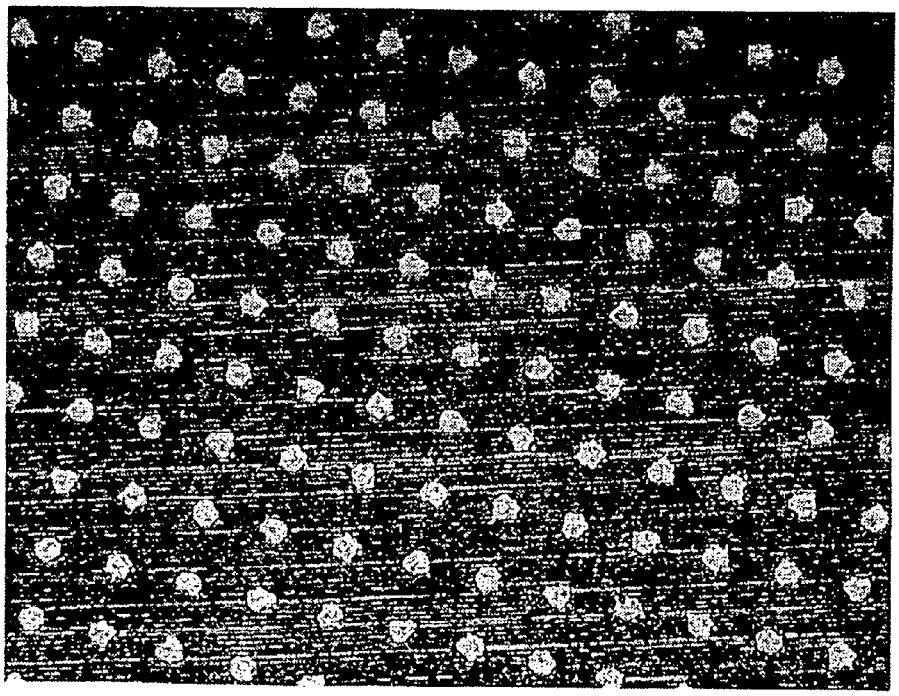
FIG. 8 illustrates the shape of dots of an image obtained in a still further example wherein the distance between the center of the dots is 125 μm.
Figure 9:
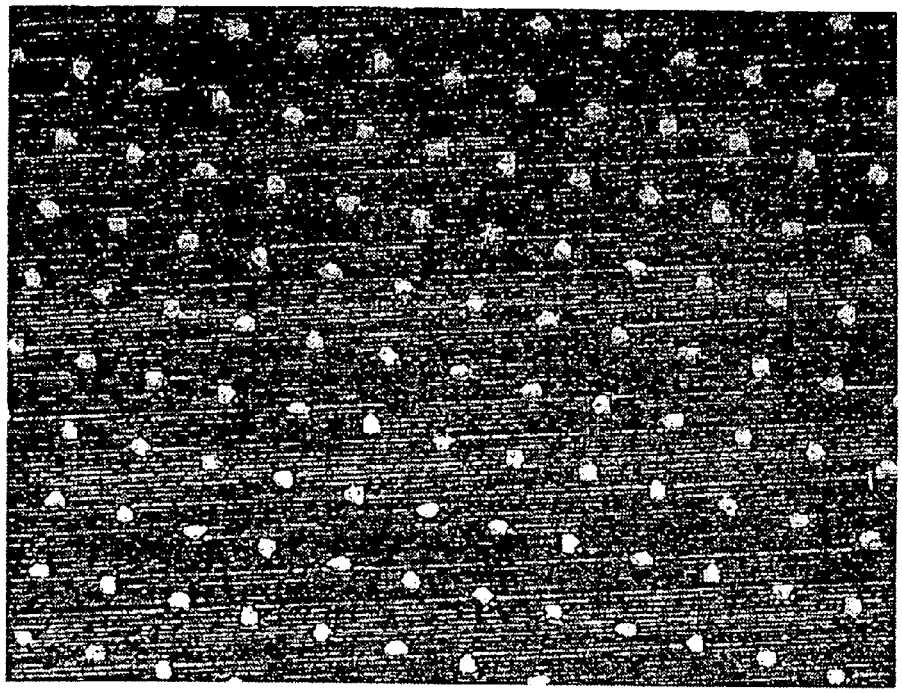
FIG. 9 illustrates the shape of dots of an image obtained in a still further example wherein the distance between the center of the dots is 125 μm.
Figure 10:
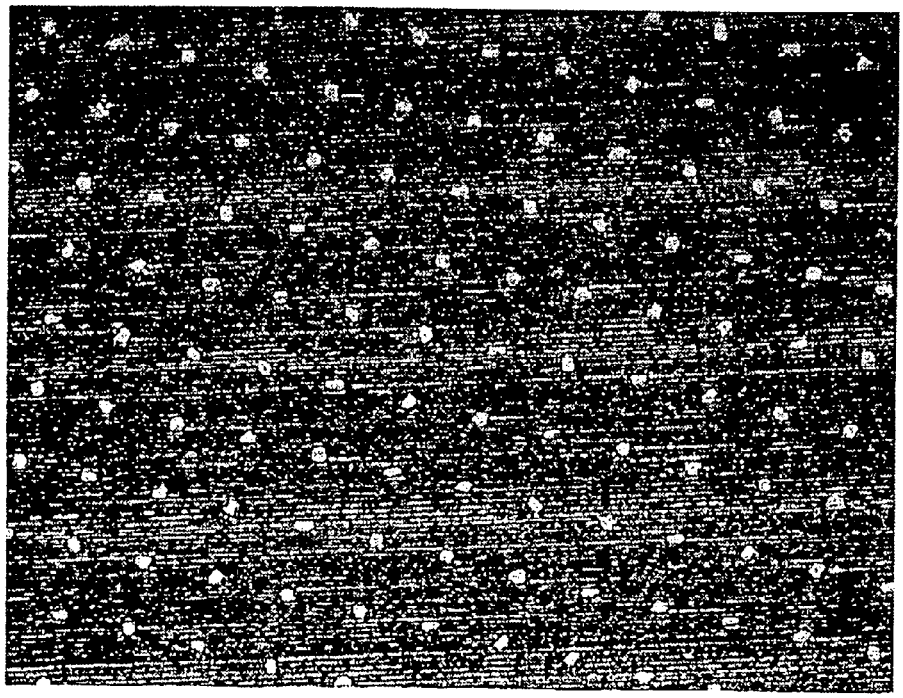
FIG. 10 illustrates the shape of dots of an image obtained in a still further example wherein the distance between the center of the dots is 125 μm.
Figure 11:
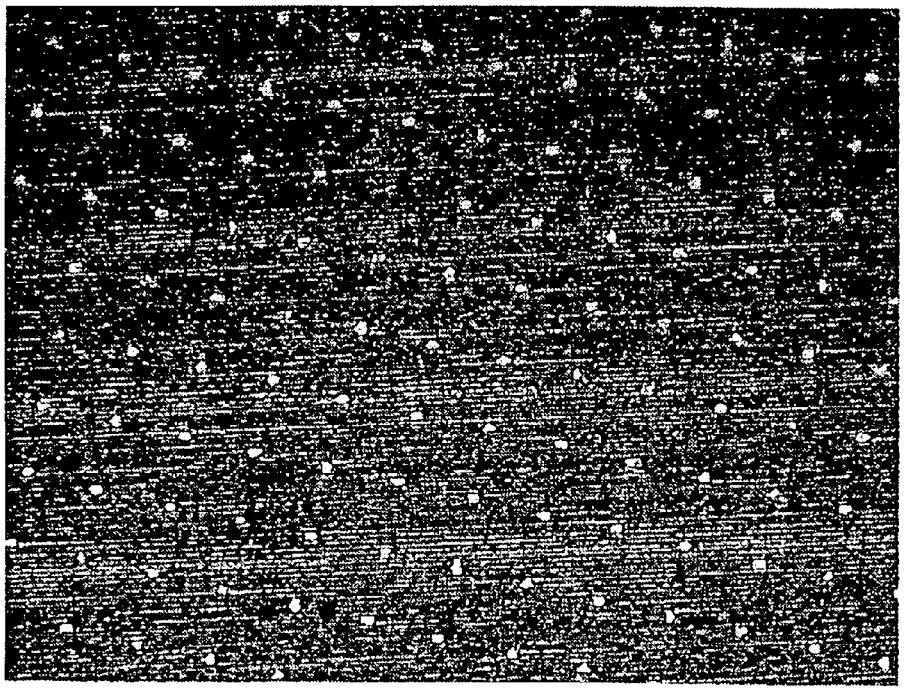
FIG. 11 illustrates the shape of dots of an image obtained in a still further example wherein the distance between the center of the dots is 125 μm.
Figure 12:
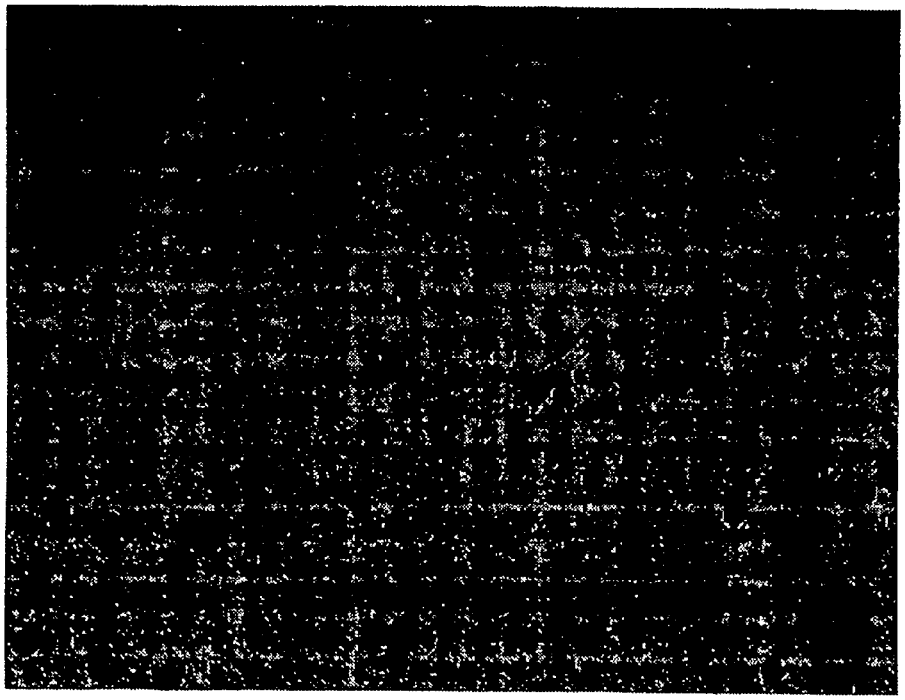
FIG. 12 illustrates the shape of dots of an image obtained in a still further example wherein the distance between the center of the dots is 125 μm.

The continuous tone data which has been converted to raster data at Celebra is then converted to a binary data for halftone which is then outputted to a CTP system by which it is finally printed. On the other hand, the continuous tone data is also outputted to the PD system. The PD system then converts the data received such that their colors coincide with that of the printed matter according to a four-dimensional (black, cyan, magenta, yellow) table. The data is finally converted to a binary data for halftone so as to coincide with the halftone of the desired printed matter, and then outputted to FINALPROOF (FIG. 4).

The four-dimensional table has previously been experimentally prepared, and then stored in the system. The experiment for preparation is as follows. In some detail, an important color data is printed via a CTP system to prepare an image. On the other hand, the important color data is outputted to FINALPROOF via a PD system to prepare another image. The color of the two images are then measured and compared. The four-dimensional table is then prepared such that the difference in color between the two images is minimum.

As described above, the present invention realized a system arrangement allowing full performance of the function of a material having a high resolving power.

The heat transfer sheet as a material to be used in the system of the present invention will be described hereinafter.

It is preferred that the absolute value of the difference between the surface roughness Ra of the surface of the image-forming layer of the heat transfer sheet and the surface roughness of the back surface of the image-forming layer be not greater than 3.0 and the absolute value of the difference between the surface roughness Ra of the surface of the image-receiving layer of the heat transfer sheet and the surface roughness of the back surface of the image-receiving layer be not greater than 3.0. This arrangement, combined with the action of the foregoing cleaning unit, can prevent the occurrence of image defects, eliminate jamming during conveyance and improve dot gain stability.

The term "surface roughness Ra" as used herein is meant to indicate the surface roughness averaged over 10 points corresponding to Rz (maximum height) according to JIS. This value can be determined by inputting and converting the distance between the value averaged over the height of the highest to fifth highest mountains and the value averaged over the depth of the deepest to fifth deepest valleys relative to the average level on a reference area extracted from the roughened curve. For the measurement of surface roughness Ra, a tracer type three-dimensional roughness meter (Surfcom 570A-3DF, produced by TOKYO SEIKI CO., LTD.) is used. The measurement is conducted longitudinally. The cutoff value is 0.08 mm. The area to be measured is 0.6 mm×0.4 mm. The feed pitch is 0.005 mm. The measurement speed is 0.12/s.

From the standpoint of further enhancement of the foregoing effect, it is preferred that the absolute value of the difference between the surface roughness Ra of the surface of the image-forming layer of the heat transfer sheet and the surface roughness of the back surface of the image-forming layer be not greater than 1.0 and the absolute value of the difference between the surface roughness Ra of the surface of the image-receiving layer of the heat transfer sheet and the surface roughness of the back surface of the image-receiving layer be not greater than 1.0.

In another embodiment, it is preferred that the surface roughness Rz of the image-forming layer side and the other side of the heat transfer sheet and/or the surface roughness Rz of the both sides of the image-receiving sheet be from 2 μm to 30 μm. This arrangement, combined with the action of the foregoing cleaning unit, can prevent the occurrence of image defects, eliminate jamming during conveyance and improve dot gain stability.

The gloss of the image-forming layer of the heat transfer sheet is preferably from 80 to 99.

The gloss of the image-forming layer greatly depends on the surface smoothness of the image-forming layer, which affects the uniformity in the thickness of the image-forming layer. The greater the gloss of the image-forming layer is, the more uniform is the thickness of the image-forming layer and the more suitable for the purpose of high precision image is the heat transfer sheet. However, as the smoothness of the image-forming layer increases, the resistance in conveyance increases. Thus, the two factors are trade-off factors. When the gloss of the image-forming layer is from 80 to 99, the two requirements can be met at the same time and well balanced.

The outline of the mechanism of forming a multi-color image by a thin film heat transfer using laser will be described hereinafter in connection with FIG. 1.

Figure 1B:
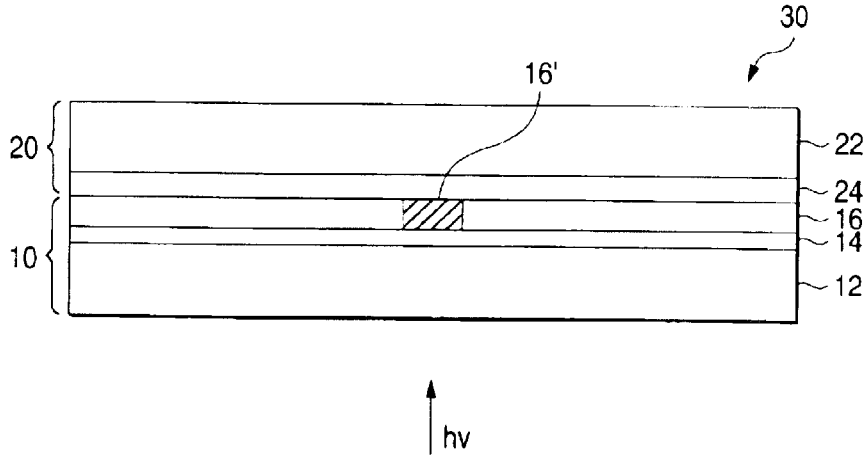
Figure 1C:
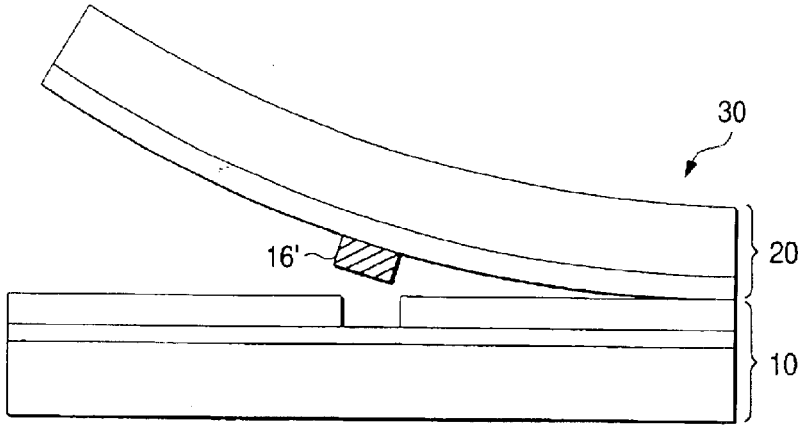

An image-forming laminate 30 having an image-receiving sheet 20 laminated on the surface of an image-receiving layer 16 containing a black (K), cyan (C), magenta (M) or yellow pigment in a heat transfer sheet 10 is prepared. The heat transfer sheet 10 comprises a support 12, a light-to-heat conversion layer 14 provided on the support 12, and an image-receiving layer 16 provided on the light-to-heat conversion layer 14. The image-receiving sheet 20 comprises a support 22, and an image-receiving layer 24 provided on the support 22. The heat transfer sheet 10 and the image-receiving sheet 20 are laminated in such an arrangement that the image-forming layer 16 and the image-receiving layer 24 come in contact with each other (FIG. 1A). When the laminate 30 is sequentially imagewise irradiated with laser beam on the support 12 of the heat transfer sheet 10, the laser beam-irradiated area of the light-to-heat conversion layer 14 of the heat transfer sheet 10 generates heat to lower the adhesion of the light-to-heat conversion layer 14 to the image-forming layer 16 (FIG. 1B). Thereafter, when the image-receiving sheet and the heat transfer sheet 10 are peeled off each other, the laser beam-irradiated area 16' of the image-forming layer 16 is transferred to the image-receiving layer 24 of the image-receiving sheet 20 (FIG. 1C).

In the formation of a multi-color image, the laser beam to be used in irradiation is preferably a multi-beam, particularly a binary arrangement of multi-beams. The term "binary arrangement of multi-beams" as used herein is meant to indicate that recording by irradiation with laser beam is carried out by the use of a plurality of laser beams and the spot arrangement of these laser beams forms a binary plane arrangement consisting of a plurality of lines in the direction of main scanning and a plurality of rows in the direction of subsidiary scanning.

By using a laser beam in a binary arrangement, the time required for laser recording can be reduced.

The laser beam for this purpose is not specifically limited. For example, a gas laser beam such as argon ion laser beam, helium neon laser beam and helium cadmium laser beam, solid laser beam such as YAG laser beam or a direct laser beam such as semiconductor laser beam, dye laser beam and eximer laser beam may be used. Alternatively, a light beam obtained by passing such a laser beam through a second order higher harmonics element to halve the wavelength thereof may be used. In the formation of a multi-color image, a semiconductor laser beam is preferably used taking into account the output power or modulatability. In the formation of a multi-color image, the laser beam is preferably emitted in such an arrangement that the diameter of beam spot on the light-to-heat conversion layer is from 10 μm to 30 μm, and the scanning speed is preferably not smaller than from 1 to 20 m/sec.

In the formation of a multi-color image, it is preferred that the thickness of the image-forming layer of the black heat transfer sheet be greater than that of the image-forming layer of the yellow, magenta and cyan heat transfer sheets and be from 0.5 μm to 0.7 μm. In this arrangement, when the black heat transfer sheet is irradiated with laser beam, the reduction of density due to uneven transfer can be inhibited.

In accordance with the foregoing arrangement that the thickness of the image-forming layer of the black heat transfer sheet is not smaller than 0.5 μm, a high energy recording can be effected without uneven transfer to maintain desired image density, making it possible to attain an image density required for print proof. Since this tendency becomes more remarkable under high temperature and humidity conditions, the density change due to environmental factor can be inhibited. On the other hand, by the predetermining the thickness of the image-forming layer of the black heat transfer sheet to not greater than 0.7 μm, desired transfer sensitivity can be maintained during laser recording, facilitating printing of small points and fine lines. This tendency becomes more remarkable under low temperature and humidity conditions. Further, the resolving power can be enhanced. The thickness of the image-forming layer of the black heat transfer sheet is more preferably from 0.55 μm to 0.65 μm, particularly 0.60 μm.

Further, it is preferred that the thickness of the image-forming layer in the foregoing black heat transfer sheet be from 0.5 μm to 0.7 μm and the thickness of the image-forming layer in the foregoing yellow, magenta and cyan heat transfer sheets be from not smaller than 0.2 μm to less than 0.5 μm.

By predetermining the thickness of the image-forming layer in the foregoing yellow, magenta and cyan heat transfer sheets to not smaller than 0.2 μm, laser recording can be effected free from uneven transfer to maintain desired density. On the contrary, by predetermining the thickness of the image-forming layer in the foregoing yellow, magenta and cyan heat transfer sheets to not greater than 0.5 μm, the transfer sensitivity or resolution can be improved. More preferably, the thickness of the image-forming layer in the foregoing yellow, magenta and cyan heat transfer sheets is from 0.3 μm to 0.45 μm.

The image-forming layer in the foregoing black heat transfer sheet preferably comprises carbon black incorporated therein. The carbon black preferably consists of at least two carbon blacks having different coloring powers to adjust properly the reflection density while keeping P/B (pigment/binder) ratio constant.

The coloring power of carbon black can be represented by various methods. For example, PVC blackness as disclosed in Japanese Patent Application (Laid-Open) No. 1998-140033 may be employed. For the definition of PVC blackness, carbon black is added to a PVC resin. The PVC resin is then subjected to dispersion and formation into sheet through a twin roll. The blackness of Carbon Black #40 and #45 (produced by Mitsubishi Chemical Corporation) are defined to be 1 and 10, respectively, as reference. The blackness of samples are each visually judged on the basis of these reference values. Two or more carbon blacks having different PVC blacknesses may be properly selected and used depending on the purpose.

A specific example of the process for the preparation of sample will be described hereinafter.

Process For the Preparation of Sample

ALDPE (low density polyethylene) resin and a ample carbon black in an amount of 40% by mass (i.e., by weight) are blended and kneaded at a temperature of 115° C. for 4 minutes in a 250 ml Banbury mixer.

Blending Conditions

| | |
|---|---|
| LDPE resin | 101.89 g |
| Calcium stearate | 1.39 g |
| Irganox 1010 | 0.87 g |
| Sample carbon black | 69.43 g |

Subsequently, the mixture is diluted at a temperature of 120° C. by means of a twin-roll mill such that the carbon black concentration reaches 1% by mass (i.e., by weight). Conditions for the preparation of diluted compound:

| | |
|---|---|
| LDPE resin | 58.3 g |
| Calcium stearate | 0.2 g |
| Resin having 40% by mass of carbon black incorporated therein | 1.5 g |

The diluted compound thus obtained is then extruded through a slit having a width of 0.3 mm to form a sheet. The sheet thus formed is cut into chips which are then heated over a hot plate to form a film having a thickness of 65±3 μm.

The formation of a multi-color image can be accomplished by a process which comprises imposing a number of image layers (image-forming layer having an image formed thereon) on the same image-receiving sheet one after another using the foregoing heat transfer sheet as described above. Alternatively, a multi-color image may be formed by a process which comprises forming an image on the image-receiving layer of a plurality of image-receiving sheets, and then transferring the images to the printing paper.

Referring to the latter process, heat transfer sheets having an image-forming layer comprising coloring materials having different color hues are prepared. Four laminates of such a heat transfer sheet with an image-receiving sheet (four colors: cyan, magenta, yellow, black) are independently prepared. These laminates are each then irradiated with laser beam according to digital signal based on the image through a color separation filter. Subsequently, the heat transfer sheet and the image-receiving sheet are peeled off each other so that color separation images are independently formed on the respective image-receiving sheet. These color separation images are then sequentially laminated on an actual support such as printing paper separately prepared or analogue to form a multi-color image.

The heat transfer sheet to be irradiated with laser beam is preferably adapted to convert laser beam to heat energy by which an image-forming layer containing a pigment is transferred to the image-receiving sheet by a thin film transfer process to form an image on the image-receiving sheet. The technique used to develop the image-forming material comprising such a heat transfer sheet and image-receiving sheet can be properly applied to the development of heat transfer sheet and/or image-receiving sheet of melting transfer process, ablation transfer process, sublimation transfer process, etc. The system of the present invention may include image-forming materials for use in these processes.

The heat transfer sheet and image-receiving sheet will be further described hereinafter.

Heat Transfer Sheet

The heat transfer sheet comprises at least a light-to-heat conversion layer and an image-forming layer and optionally other layers provided on a support.

Support

The material constituting the support of the heat transfer sheet is not specifically limited. Various support materials may be used depending on the purpose. The support material preferably is rigid, dimensionally stable and resistant to heat developed upon the formation of image. Preferred examples of the support material include synthetic resin materials such as polyethylene terephthalate, polyethylene-2,6-naphthalate, polycarbonate, polymethyl methacrylate, polyethylene, polypropylene, polyvinyl chloride, polyvinylidene chloride, polystyrene, styrene-acrylonitrile copolymer, polyamide (aromatic or aliphatic), polyimide, polyamideimide and polysulfone. In particular, a biaxially oriented polyethylene terephthalate is preferred taking into account its mechanical strength or dimensional stability to heat. In the case where the present invention is used to prepare a color proof utilizing laser recording, the support of the heat transfer sheet is preferably formed by a transparent synthetic resin which transmits laser beam. The thickness of the support is preferably from 25 μm to 130 μm, particularly from 50 μm to 120 μm. The support preferably has a central line average surface roughness Ra (measured by means of a surface roughness meter (Surfcom, produced by TOKYO SEIKI CO., LTD.) according to JIS B0601) of less than 0.1 μm on the image-forming layer side thereof.

The support preferably exhibits a Young's modulus of from 200 to 1,200 Kg/mm$^2$ (approximately equal to 2 to 12 GPa) in the longitudinal direction (i.e., the machine direction) and from 250 to 1,600 Kg/mm$^2$ (approximately equal to 2.5 to 16 GPa) in the crosswise direction (i.e., the transverse direction) The support preferably exhibits an F-5 value of from 5 to 50 Kg/mm$^2$ (approximately equal to 49 to 490 MPa) in the longitudinal direction and from 3 to 30 Kg/mm$^2$ (approximately equal to 29.4 to 294 MPa) in the crosswise direction. It is usual that the support exhibits a higher F-5 value in the longitudinal direction than in the crosswise direction unless in the case where the crosswise strength needs to be enhanced. The percent thermal shrinkage of the support in the longitudinal direction and crosswise direction is preferably not greater than 3%, more preferably not greater than 1.5% after 30 minutes of heating to 100° C., or preferably not greater than 1%, more preferably not greater than 0.5% after 30 minutes of heating to 80° C. The support preferably exhibits a breaking strength of from 5 to 100 Kg/mm$^2$ (approximately equal to 49 to 980 MPa) and an elastic modulus of from 100 to 2,000 Kg/mm$^2$ (approximately equal to 0.98 to 19.6 GPa) in both the longitudinal and crosswise directions.

The support of the heat transfer sheet may be subjected to surface activation treatment and/or provided with one or more undercoating layers to improve the adhesion to the light-to-heat conversion layer provided thereon. Examples of the surface activation treatment include glow discharge treatment, corona discharge treatment, etc. As the material constituting the undercoating layer there is preferably used one having a high adhesion to both the surface of the support and the light-to-heat conversion layer, a small heat conductivity and an excellent heat resistance. Examples of the material of the undercoating layer include styrene, styrene-butadiene copolymer, and gelatin. The total thickness of the undercoating layers is normally from 0.01 $\mu$m to 2 $\mu$m. If necessary, the heat transfer sheet may be provided with various functional layers such as anti-reflection layer and antistatic layer or subjected to surface treatment on the surface thereof opposite the light-to-heat conversion layer.

Back Layer

The heat transfer sheet of the present invention preferably comprises aback layer provided on the surface thereof opposite the light-to-heat conversion layer. The back layer preferably consists of two layers, i.e., 1st back layer adjacent to the support and 2nd back layer provided on the side of the support opposite the 1st back layer. In the present invention, the ratio (B/A) of the mass A of the antistatic agent contained in the 1st back layer to the mass B of the antistatic agent contained in the 2nd back layer is preferably less than 0.3. When B/A is not smaller than 0.3, the resulting back layer tends to exhibit deteriorated slipperiness and be more subject to powder falling.

The thickness C of the 1st back layer is preferably from 0.01 $\mu$m to 1 $\mu$m, more preferably from 0.01 $\mu$m to 0.2 $\mu$m. The thickness D of the 2nd back layer is preferably from 0.01 $\mu$m to 1 $\mu$m, more preferably from 0.01 $\mu$m to 0.2 $\mu$m. The ratio of the thickness C of the 1st back layer to the thickness D of the 2nd back layer (C:D) is preferably 1:2 to 5:1.

Examples of the antistatic agent to be incorporated in the 1st and 2nd back layers include nonionic surface active agents such as polyoxyethylene alkylamine and glycerinaliphatic acid ester, cationic surface active agents such as quaternary ammonium salt, anionic surface active agents such as alkyl phosphate, amphoteric surface active agents, and compounds such as electrically-conductive resin.

An electrically-conductive particulate material may be used also as an antistatic agent. Examples of such an electrically-conductive particulate material include oxides such as ZnO, $TiO_2$, $SnO_2$, $Al_2O_3$, $In_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_{13}$, $NaCaP_2O_{18}$ and $MgB_2O_5$, sulfides such as CuS and ZnS, carbides such as SiC, TiC, ZrC, VC, NbC, MoC and WC, nitrides such as $Si_3N_4$, TiN, ZrN, VN, NbN and $Cr_2N$, borides such as $TiB_2$, $ZrB_2$, $NbB_2$, $TaB_2$, CrB, MoB, WB and $LaB_5$, silicides such as $TiSi_2$, $ZrSi_2$, $NbSi_2$, $TaSi_2$, $CrSi_2$, $MoSi_2$ and $WSi_2$, metal salts such as $BaCO_3$, $CaCO_3$, $SrCO_3$, $BaSO_4$ and $CaSO_4$, and composites such as $SiN_4$—SiC and $9Al_2O_3$-$2B_2O_3$. These materials may be used singly or in combination of two or more thereof. Preferred among these materials are $SnO_2$, ZnO, $Al_2O_3$, $TiO_2$, $In_2O_3$, MgO, BaO and $MoO_3$. Even more desirable among these materials are $SnO_2$, ZnO, $In_2O_3$ and $TiO_2$. Particularly preferred among these materials is $SnO_2$.

In the case where the electrically-conductive metal oxide is used as an antistatic agent, the particle diameter of the electrically-conductive metal oxide is preferably as small as possible to minimize light scattering. The particle diameter of the electrically-conductive metal oxide should be determined according to the ratio of refractive index of particle and binder as a parameter. Mie's theory can be used to determine the optimum particle diameter of the electrically-conductive metal oxide. The particle diameter of the electrically-conductive metal oxide is normally from 0.001 $\mu$m to 0.5 $\mu$m, preferably from 0.003 $\mu$m to 0.2 $\mu$m. The term "average particle diameter" as used herein is meant to indicate not only primary particle diameter of electrically-conductive metal oxide but also particle diameter of particles having a high order structure.

The 1st and 2nd back layers may comprise various additives such as surface active agent, lubricant and matting agent or a binder incorporated therein besides the antistatic agent. The amount of the antistatic agent to be incorporated in the 1st back layer is preferably from 10 to 1,000 parts by mass (i.e., by weight), more preferably from 200 to 800 parts by mass based on 100 parts by mass of the binder. The amount of the antistatic agent to be incorporated in the 2nd back layer is preferably from 0 to 300 parts by mass, more preferably from 0 to 100 parts by mass based on 100 parts by mass of the binder.

Examples of the binder to be used in the formation of the 1st and 2nd back layers include homopolymer and copolymer of acrylic acid monomer such as acrylic acid, methacrylic acid, acrylic acid ester and methacrylic acid ester, cellulose-based polymer such as nitrocellulose, methyl cellulose, ethyl cellulose and cellulose acetate, vinyl polymer and copolymer of vinyl compound such as polyethylene, polypropylene, polystyrene, vinyl chloride-based copolymer, vinyl chloride-vinyl acetate copolymer, polyvinyl pyrrolidone, polyvinyl butyral and polyvinyl alcohol, condensed polymer such as polyester, polyurethane and polyamide, rubber-based thermoplastic polymer such as butadiene-styrene copolymer, polymer obtained by the polymerization or crosslinking of a photo-polymerizable or heat-polymerizable compound such as epoxy compound, and melamine compound.

Light-to-heat Conversion Layer

The light-to-heat conversion layer comprises a light-to-heat conversion material, a binder and optionally a matting agent incorporated therein. The light-to-heat conversion layer further comprises other components incorporated therein as necessary.

The light-to-heat conversion material is a material capable of converting light energy irradiated to heat energy. The light-to-heat conversion material is normally a dye (the term "dye" is hereinafter referred to as "pigment") capable of absorbing laser beam. In the case where infrared laser is used to effect image recording, an infrared-absorbing dye is preferably used as a light-to-heat conversion material. Examples of such a dye include black pigments such as carbon black, macrocyclic compound pigments having absorption in the range of from visible light to near infrared such as phthalocyanine and naphthalocyanine, organic dyes used as laser-absorbing material for high density laser recording on optical disk, etc. (e.g., cyanine dye such as indolenine dye, anthraquinone dye, azulene dye, phthalocyanine dye), and organic metal compound dyes such as dithiol-nickel complex. Among these dyes, the cyanine dye exhibits a high absorption factor with respect to light in the infrared range. Thus, when the cyanine dye is used as a light-to-heat conversion material, the thickness of the light-to-heat conversion layer can be reduced, resulting in further enhancement of the recording sensitivity of the heat transfer sheet to advantage.

As the light-to-heat conversion material there may be used an inorganic material such as particulate metal material (e.g., blacked silver) besides these dyes.

As the binder to be incorporated in the light-to-heat conversion layer there is preferably used a resin having at least a strength high enough to form a layer on the support and a thermal conductivity. More preferably, the resin is heat-resistant enough to undergo no decomposition due to heat produced from the light-to-heat conversion material because it can maintain desired surface smoothness of the light-to-heat conversion layer even after irradiation with high energy light. In some detail, the resin preferably exhibits a thermal decomposition temperature (temperature at which the material shows a 5% mass (i.e., a 5% weight) drop in an air stream at a temperature rising rate of 10° C./min according to TGA process (thermogravimetric analysis)) of not lower than 400° C., more preferably not lower than 500° C. The binder preferably exhibits a glass transition temperature of from 200° C. to 400° C., more preferably from 250° C. to 350° C. When the glass transition temperature of the binder falls below 200° C., the resulting image can be fogged. On the contrary, when the glass transition temperature of the binder exceeds 400° C., the solubility of the resin lowers, occasionally deteriorating the production efficiency.

The heat resistance (e.g., thermal decomposition temperature or thermal decomposition temperature) of the binder to be incorporated in the light-to-heat conversion layer is preferably higher than that of the materials to be used in other layers provided on the light-to-heat conversion layer.

Specific examples of the binder employable herein include acrylic resins such as methyl polymethacrylate, vinyl resins such as polycarbonate, polystyrene, vinyl chloride-vinyl acetate copolymer and polyvinyl alcohol, polyvinyl butyral, polyester, polyvinyl chloride, polyamide, polyimide, polyetherimide, polysulfone, polyether sulfone, aramide, polyurethane, epoxyresin, and urea/melamine resin. Preferred among these materials is polyimide resin.

In particular, polyimide resins represented by the following general formulae (I) to (VII) are soluble in an organic solvent. Thus, these polyamide resins are preferably used to enhance the productivity of heat transfer sheet. These polyamide resins are preferred also because they improve the viscosity stability, storage properties and humidity resistance of the light-to-heat conversion layer coating solution.

(I)

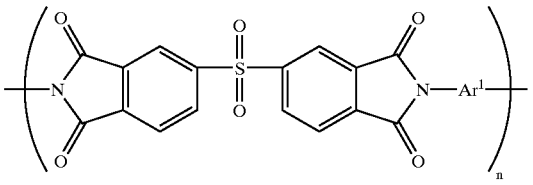

(II)

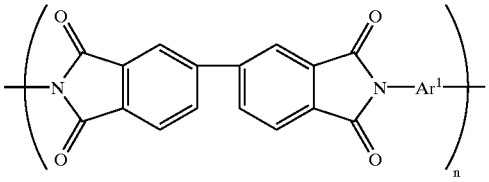

wherein $Ar^1$ represents an aromatic group represented by the following structural formula (1), (2) or (3); and n represents an integer of from 10 to 100.

(1)

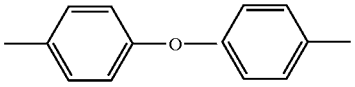

(2)

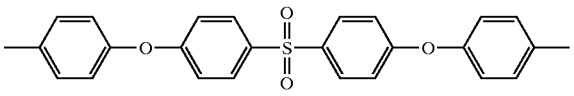

(3)

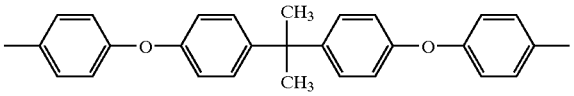

(III)

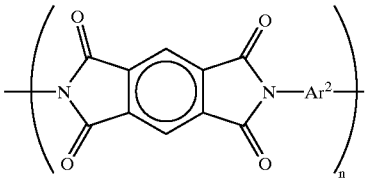

(IV)

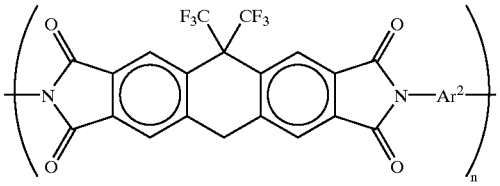

wherein $Ar^2$ represents an aromatic group represented by the following structural formula (4), (5), (6) or (7); and n represents an integer of from 10 to 100.

(4)
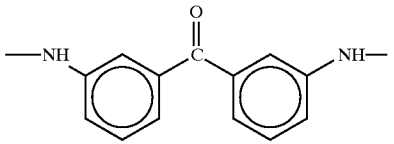
(5)
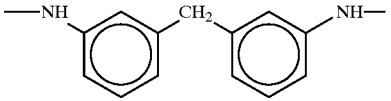
(6)
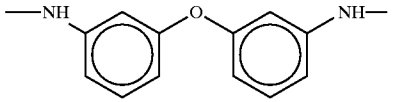
(7)
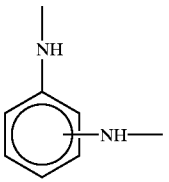
(V)
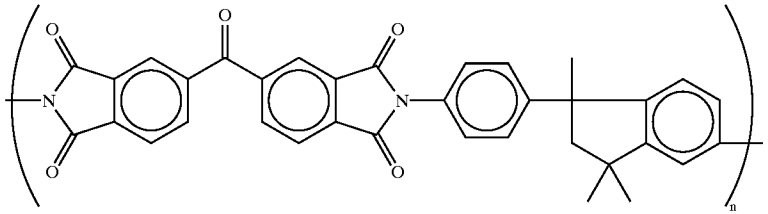
(VI)
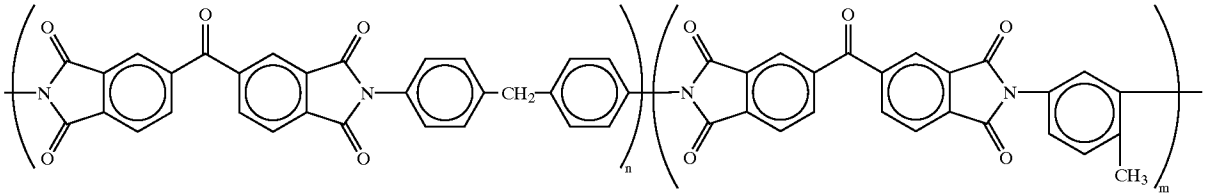
(VII)
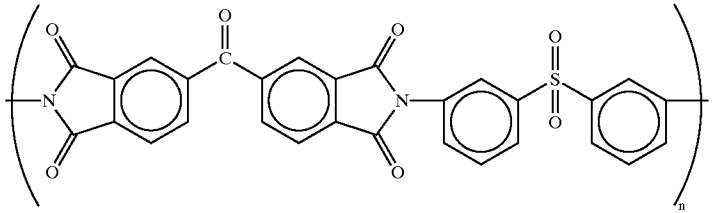

In the general formulae (V) to (VII), n and m each represent an integer of from 10 to 100. In the general formula (VI), the ratio of n:m is from 6:4 to 9:1.

The measure of whether or not the resin is soluble in an organic solvent is whether or not the resin can be dissolved in N-methylpyrrolidone at 25° C. in an amount of not smaller than 10 parts by mass (i.e., by weight) based on 100 parts of N-methylpyrrolidone. A resin which can be dissolved in N-methylpyrrolidone in an amount of not smaller than 10 parts by mass can be preferably used as a resin for light-to-heat conversion layer. More preferably, the resin is dissolved in N-methylpyrrolidone in an amount of not smaller than 100 parts by mass based on 100 parts by mass of N-methylpyrrolidone.

As the matting agent to be incorporated in the light-to-heat conversion layer there may be used an inorganic or organic particulate material. Examples of the inorganic particulate material include silica, metal salt such as titanium oxide, aluminum oxide, zinc oxide magnesium oxide, barium oxide, magnesium sulfate, aluminum oxide, magnesium hydroxide and boron nitride, kaolin, clay, talc, zinc white, white lead, zeeklite, quartz, diatomaceous earth, pearlite, bentonite, mica, and synthetic mica. Examples of the organic particulate material include particulate resin such as particulate fluororesin, particulate guanamine resin, particulate acrylic resin, particulate styrene-acryl copolymer resin, particulate silicone resin, particulate melamine resin and particulate epoxy resin.

The particle diameter of the matting agent is normally from 0.3 $\mu$m to 30 $\mu$m, preferably from 0.5 $\mu$m to 20 $\mu$m. The amount of the matting agent to be incorporated is preferably from 0.1 to 100 mg/m$^2$.

The light-to-heat conversion layer may further comprise a surface active agent, a thickening agent, an antistatic agent, etc., incorporated therein as necessary.

The light-to-heat conversion layer can be provided by a process which comprises dissolving a light-to-heat conversion material and a binder, optionally adding a matting agent and other components to the solution to prepare a coating solution, applying the coating solution to a support, and then drying the coated material. Examples of the organic solvent for dissolving the polyimide resin therein include n-hexane, cyclohexane, diglyme, xylene, toluene, ethyl acetate, tetrahydrofurane, methyl ethyl ketone, acetone, cyclohexanone, 1,4-dioxane, 1,3-dioxane, dimethyl acetate, N-methyl-2-pyrrolidone, dimethyl sulfoxide, dimethyl formamide, dimethyl acetamide, γ-butyrolactone, ethanol, and methanol. Coating and drying can be carried out by ordinary methods. Drying is normally effected at a temperature of not higher than 300° C., preferably not higher than 200° C. In the case where as the support there is used a polyethylene terephthalate, drying is preferably effected at a temperature of from 80° C. to 150° C.

When the amount of the binder incorporated in the light-to-heat conversion layer is too small, the resulting light-to-heat conversion layer exhibits a deteriorated cohesive force and thus can be easily transferred with the formed image to the image-receiving sheet, causing the image to be stained. When the amount of the polyimide resin to be incorporated is too great, the thickness of the light-to-heat conversion layer must be raised to attain a desired absorbance, causing sensitivity drop. The ratio of solid content of light-to-heat conversion material to binder in the light-to-heat conversion layer by mass is preferably from 1:20 to 2:1, particularly preferably from 1:10 to 2:1.

The thickness of the light-to-heat conversion layer is preferably reduced to enhance the sensitivity of the heat transfer sheet. The thickness of the light-to-heat conversion layer is preferably from 0.03 $\mu$m to 1.0 $\mu$m, more preferably from 0.05 $\mu$m to 0.5 $\mu$m. The light-to-heat conversion layer preferably exhibits an optical density of from 0.80 to 1.26, more preferably from 0.92 to 1.15 with respect to light having a wavelength of 808 nm to enhance the transfer sensitivity of the image-forming layer. When the optical density of the light-to-heat conversion layer at a laser peak wavelength falls below 0.80, the light-to-heat conversion layer can insufficiently convert incident light to heat, causing drop of transfer sensitivity. On the contrary, when the optical density of the light-to-heat conversion layer at a laser peak wavelength exceeds 1.26, the function of the light-to-heat conversion layer can be affected during recording, causing fogging. The term "optical density of the light-to-heat conversion layer of the heat transfer sheet" as used herein is meant to indicate the absorbance of the light-to-heat conversion layer at a peak wavelength of laser beam used. The absorbance of the light-to-heat conversion layer can be measured by means of any known spectrophotometer. In the present invention, a Type UV-240 ultraviolet spectrophotometer (produced by Shimadzu Corp.) was used. The optical density is obtained by subtracting the value of the support from the value of the light-to-heat conversion layer including the support.

Image-forming Layer

The image-forming layer comprises at least a pigment incorporated therein for forming an image after being transferred to the image-receiving sheet. Further, the image-forming layer comprises a binder for forming a layer, and optionally other components incorporated therein.

Pigments are generally roughly divided into two groups, i.e., inorganic pigment and organic pigment. The former pigment is excellent in the transparency of coating layer. The latter pigment is generally excellent in the opacity. Thus, pigments may be selected depending on the purpose. In the case where the foregoing heat transfer sheet is used for color correction of print, organic pigments coincident with or close in color tone to yellow, magenta, cyan and black commonly used in printing ink may be used. Besides these pigments, metal powders, fluorescent pigments, etc. may be used. Examples of pigments which are preferably used herein include azo-based pigments, phthalocyanine-based pigments, anthraquinone-based pigments, dioxazine-based pigments, quinacridone-based pigments, isoindolinone-based pigments, and nitro-based pigments. Pigments which can be incorporated in the image-forming layer will be listed below by color hues, but the present invention should not be construed as being limited thereto.

In image-forming layer of the present invention, one kind or at least two kinds of these pigments may be used.

1) Yellow Pigment

Pigment Yellow12 (C. I. No. 21090) (e.g., Permanent Yellow DHG (produced by Clariant Japan Co., Ltd.), Lionol Yellow 1212B (produced by TOYO INK MFG. CO., LTD.), Irgalite Yellow LCT (produced by Ciba Specialty Chemicals Co., Ltd.), Symuler Fast Yellow GTF 219 (produced by DAINIPPON INK & CHEMICALS, INC.));

Pigment Yellow13 (C. I. No. 21100) (e.g., Permanent Yellow GR (produced by Clariant Japan Co., Ltd.), Lionol Yellow 1313 (produced by TOYO INK MFG. CO., LTD.));

Pigment Yellow14 (C. I. No. 21095) (e.g., Permanent Yellow G (produced by Clariant Japan Co., Ltd.), Lionol Yellow 1401-G (produced by TOYO INK MFG. CO., LTD.), Seika Fast Yellow 2270 (produced by DAINICHISEIKA COLOUR & CHEMICALS MFG. CO., LTD.), Symuler Fast Yellow 4400 (produced by DAINIPPON INK & CHEMICALS, INC.));

Pigment Yellow 17(C. I. No. 21105) (e.g., Permanent Yellow GG02 (produced by Clariant Japan Co., Ltd.), Symuler Fast Yellow 8GF (produced by DAINIPPON INK & CHEMICALS, INC.), Pigment Yellow 155 (e.g., Graphtol Yellow 3GP (produced by Clariant Japan Co., Ltd.));

Pigment Yellow180 (C. I. No. 21290) (e.g., Novoperm Yellow P-HG (produced by Clariant Japan Co., Ltd.), PV Fast Yellow HG (produced by Clariant Japan Co., Ltd.), Pigment Yellow 139 (C. I. No. 56298) (e.g., Novoperm Yellow M2R 70 (produced by Clariant Japan Co., Ltd.))

2) Magenta Pigment

Pigment Red 57:1 (C. I. No. 15850:1) (e.g., Graphtol Rubine L6B (produced by Clariant Japan Co., Ltd.), Lionol Red 6B-4290G (produced by TOYO INK MFG. CO., LTD.), Irgalite Rubine 4BL (produced by Ciba Specialty Chemicals Co., Ltd.), Symuler Brilliant Carmine 6B-229 (produced by DAINIPPON INK & CHEMICALS, INC.));

Pigment Red 122 (C. I. No. 73915) (e.g., Hosterperm Pink E (produced by Clariant Japan Co., Ltd.), Lionogen Magenta 5790 (produced by TOYO INK MFG. CO., LTD.), Fastogen Super Magenta RF (produced by DAINIPPON INK & CHEMICALS, INC.));

Pigment Red 53:1 (C. I. No. 15585:1) (e.g., Permanent Lake Red LCY (produced by Clariant Japan Co., Ltd.), Symuler Lake Red C conc (produced by DAINIPPON INK & CHEMICALS, INC.))

Pigment Red 48:1 (C. I. No. 15865:1) (e.g., Lionol Red 2B 3300 (produced by TOYO INK MFG. CO., LTD.), Symuler Red NRY (produced by DAINIPPON INK & CHEMICALS, INC.));

Pigment Red 48:2 (C. I. No. 15865:2) (e.g., Permanent Red W2T (produced by Clariant Japan Co., Ltd.), Lionol Red LX235 (produced by TOYO INKMFG. CO., LTD.), Symuler Red 3012 (produced by DAINIPPON INK & CHEMICALS, INC.));

Pigment Red 48:3 (C. I. No. 15865:3) (e.g., Permanent Red 3RL (produced by Clariant Japan Co., Ltd.), Symuler Red 2BS (produced by DAINIPPON INK & CHEMICALS, INC.));

Pigment Red 177 (C. I. No. 65300) (e.g., Cromophtal Red A2B (produced by Ciba Specialty Chemicals Co., Ltd.))

3) Cyan Pigment

Pigment Blue 15 (C. I. No. 74160) (e.g., Lionol Blue 7027 (produced by TOYO INK MFG. CO., LTD.), Fastogen Blue BB (produced by DAINIPPON INK & CHEMICALS, INC.));

Pigment Blue 15:1 (C. I. No. 74160) (e.g., Hosterperm Blue A2R (produced by Clariant Japan Co., Ltd.), Fastogen Blue 5050 (produced by DAINIPPON INK & CHEMICALS, INC.));

Pigment Blue 15:2 (C. I. No. 74160) (e.g., Hosterperm Blue AFL (produced by Clariant Japan Co., Ltd.), Irgalite Blue BSP (produced by Ciba Specialty Chemicals Co., Ltd.), Fastogen Blue GP (produced by DAINIPPON INK & CHEMICALS, INC.));

Pigment Blue 15:3 (C. I. No. 74160) (e.g., Hosterperm Blue B2G (produced by Clariant Japan Co., Ltd.), Lionol Blue FG7330 (produced by TOYO INK MFG. CO., LTD.), Cromophtal Blue 4GNP (produced by Ciba Specialty Chemicals Co., Ltd.), Fastogen Blue FGF (produced by DAINIPPON INK & CHEMICALS, INC.)

Pigment Blue 15:4 (C. I. No. 74160) (e.g., Hosterperm Blue BFL (produced by Clariant Japan Co., Ltd.), Cyanine Blue 700-10FG (produced by TOYO INK MFG. CO., LTD.), Irgalite Blue GLNF (produced by Ciba Specialty Chemicals Co., Ltd.), Fastogen Blue FGS (produced by DAINIPPON INK & CHEMICALS, INC.));

Pigment Blue 15:6 (C. I. No. 74160) (e.g., Lionol Blue ES (produced by TOYO INK MFG. CO., LTD.));

Pigment Blue 60 (C. I. No. 69800) (e.g., Hosterperm Blue RL01 (produced by Clariant Japan Co., Ltd.), Lionogen Blue 6501 (produced by TOYO INK MFG. CO., LTD.))

4) Black Pigment

Pigment Black 7 (Carbon Black C. I. No. 77266) (e.g., Mitsubishi Carbon Black MA100 (produced by Mitsubishi Chemical Corporation), Mitsubishi Carbon Black #5 (produced by Mitsubishi Chemical Corporation), Black Pearls 430 (produced by Cabot Co., Ltd.))

For pigments employable herein, reference can be made to "Ganryou Binran (Handbook of Pigments)", Japan Association of Pigment Technology, Seibundo Shinkosha, 1989, "COLOUR INDEX", THE SOCIETY OF DYES & COLOURIST, THIRD EDTION, 1987, etc. Proper pigments can be selected from these commercial products.

The average particle diameter of the pigment is preferably from 0.03 $\mu$m to 1 $\mu$m, more preferably from 0.05 $\mu$m to 0.5 $\mu$m.

When the particle diameter of the pigment is not smaller than 0.03 $\mu$m, it doesn't add to the dispersion cost or prevents the dispersion from undergoing gelation. On the contrary, when the particle diameter of the pigment is not greater than 1 $\mu$m, the resulting pigment is free of coarse particles, giving a good adhesion between the image-forming layer and the image-receiving layer or improving the transparency of the image-forming layer.

As the binder to be incorporated in the image-forming layer there is preferably used an amorphous organic high molecular polymer having a softening point of from 40° C. to 150° C. Examples of the amorphous organic high molecular polymer employable herein include butyral resin, polyamide resin, polyethyleneimine resin, sulfonamide resin, polyester polyol resin, petroleum resin, and homopolymer or copolymer of styrene such as styrene, vinyl toluene, $\alpha$-methylstyrene, 2-methylstyrene, chlorostyrene, vinylbenzoic acid, sodium vinylbenzenesulfonate, and aminostyrene, derivative or substitution product thereof, and homopolymer or copolymer of vinyl monomers such as methacrylic acid ester (e.g., methyl methacrylate, ethyl methacrylate, butyl methacrylate, hydroxyethyl methacrylate), methacrylic acid, acrylic acid ester (e.g., methyl acrylate, ethyl acrylate, butyl acrylate, $\alpha$-ethylhexyl acrylate), acrylic acid, diene (e.g., butadiene, isoprene), acrylonitrile, vinylether, maleic acid, maleic acid ester, maleic anhydride, cinnamic acid, vinyl chloride and vinyl acetate. Two or more of these resins may be used in admixture.

The image-forming layer preferably comprises a pigment incorporated therein in an amount of from 20% to 80% by mass (i.e., by weight), more preferably from 30% to 70% by mass, even more preferably from 30% to 50% by mass. The image-forming layer also preferably comprises a resin which is an amorphous polymer in an amount of from 20% to 80% by mass, more preferably from 30% to 70% by mass, even more preferably from 40% to 70% by mass.

The image-forming layer may comprise the following components (i) to (iii) incorporated therein as the other components.

(i) Wax

Examples of wax employable herein include mineral wax, natural wax, and synthetic wax. Examples of the mineral wax include petroleum wax such as paraffin wax, microcrystalline wax, ester wax and oxidized wax, montan wax, ozokerite, and ceresine wax. Particularly preferred among these waxes is paraffin wax. A paraffin wax is separated from petroleum. Various paraffin waxes having different melting points are commercially available.

Examples of the natural wax include vegetable waxes such as carnauba wax, Japan wax, Ouricury wax and esparto wax, and animal waxes such as beeswax, insect wax, Shellac wax and whale wax.

The synthetic wax is generally used as a lubricant. The synthetic wax is normally made of a higher aliphatic compound. Examples of such a synthetic wax will be given below.

1) Aliphatic Acid-based Waxes

Straight-chain saturated aliphatic acid represented by the following general formula:

$$CH_3(CH_2)_nCOOH$$

wherein n represents an integer of from 6 to 28. Specific examples of such a straight-chain saturated aliphatic acid include stearic acid, behenic acid, palmitic acid, 12-hydroxystearic acid, and azelaic acid.

Other examples of aliphatic acid-based waxes include salts of these aliphatic acids with metal (e.g., K, Ca, Zn, Mg).

2) Aliphatic Acid Ester-based Waxes

Specific examples of the aliphatic acid ester employable herein include ethyl stearate, lauryl stearate, ethyl behenate, hexyl behenate, and behenyl myristate.

3) Aliphatic Acid Amide-based Waxes

Specific examples of the aliphatic acid amide-based waxes employable herein include stearic acid amide, and lauric acid amide.

4) Aliphatic Alcohol-based Waxes

Straight-chain saturated aliphatic alcohol represented by the following general formula:

$$CH_3(CH_2)_nOH$$

wherein n represents an integer of from 6 to 28. Specific examples of the straight-chain saturated aliphatic alcohol employable herein include stearyl alcohol.

Particularly preferred among the synthetic waxes (1) to (4) are higher aliphatic acid amides such as stearic acid amide and lauric acid amide. These wax-based compounds may be used singly or in proper combination as necessary.

(ii) Plasticizer

As the plasticizer there is preferably used an ester compound. Examples of such an ester compound include known plasticizers such as phthalic acid ester (e.g., dibutyl phthalate, di-n-octyl phthalate, di(2-ethylhexyl) phthalate, dinonyl phthalate, dilauryl phthalate, butyllauryl phthalate and butylbenzyl phthalate, aliphatic dibasic acid ester (e.g., di(2-ethylhexyl) adipate and di(2-ethylhexyl) sebacate, phosphoric acid triester (e.g., tricresyl phosphate, tri(2-ethylhexyl) phosphate), polyolpolyester (e.g., polyethylene glycolester), and epoxy (e.g., epoxyaliphatic acid ester) Preferred among these plasticizers is ester of vinyl monomer. Particularly preferred among these plasticizers is ester of acrylic acid or methacrylic acid because it exerts a great effect of enhancing transfer sensitivity, eliminating uneven transfer and adjusting elongation at break.

Examples of the acrylic or methacrylic acid ester compound employable herein include polyethylene glycol dimethacrylate, 1,2,4-butanetriol trimethacrylate, trimethylolethane triacrylate, pentaerythritol acrylate, pentaerythritol tetraacrylate, and dipentaerythritol polyacrylate.

The plasticizer may be high molecular. In particular, a polyester is preferred because it exerts a great plasticizing effect and can be difficultly diffused during storage. Examples of the polyester include sebacic acid-based polyester, and adipic acid-based polyester.

The additives to be incorporated in the image-forming layer are not limited to the foregoing compounds. The foregoing plasticizers may be used singly or in combination of two or more thereof.

When the content of the additives in the image-forming layer is too great, the resolution of transfer image can be deteriorated. Further, the film strength of the image-forming layer itself can be deteriorated. Moreover, the resulting deterioration of the adhesion between the light-to-heat conversion layer and the image-forming layer can cause the unexposed area to be transferred to the image-receiving sheet. From the foregoing standpoint of view, the content of the wax is preferably from 0.1% to 30% by mass, more preferably from 1 to 20% by mass based on the total solid content in the image-forming layer. The content of the plasticizer is preferably from 0.1% to 20% by mass (i.e., by weight), more preferably from 1 to 10% by mass based on the total solid content in the image-forming layer.

(iii) Others

The image-forming layer may further comprise a surface active agent, an inorganic or organic particulate material (e.g., metal powder, silica gel), an oil (e.g., linseed oil, mineral oil), a thickening agent, an antistatic agent, etc. incorporated therein besides the foregoing components. The incorporation of a material capable of absorbing light having the wavelength of light source for use in image recording in the image-forming layer makes it possible to minimize the energy required for transfer except in the case where a black image is obtained. As the material capable of absorbing light having the wavelength of light source there may be used either a pigment or a dye. In the case where a color image is obtained, it is preferred from the standpoint of color reproducibility that an infrared light source such as semiconductor laser be used for image recording and a dye having little absorption in the visible light range and a great absorption in the range of wavelength of light source be used. Examples of the near infrared dyes include compounds disclosed in Japanese Patent Application (Laid-Open) No. 1991-103476.

The image-forming layer can be provided by a process which comprises preparing a coating solution containing a pigment and the foregoing binder dissolved or dispersed therein, applying the coating solution to the light-to-heat conversion layer (or to the heat-sensitive peeling layer, if any provided on the light-to-heat conversion layer), and then drying the coated material. Examples of the solvent to be used in the preparation of the coating solution include n-propyl alcohol, methyl ethyl ketone, propylene glycol monomethyl ether (MFG), methanol, and water. Coating and drying can be carried out by ordinary methods.

On the light-to-heat conversion layer in the heat transfer sheet may be provided a heat-sensitive peeling layer comprising a heat-sensitive material which produces a gas or releases water or the like when acted upon by heat generated in the light-to-heat conversion layer to lower the adhesion between the light-to-heat conversion layer and the image-forming layer. Examples of such a heat-sensitive material employable herein include compound (polymer or low molecular compound) which itself undergoes decomposition or modification to produce a gas when acted upon by heat, and compound (polymer or low molecular compound) which absorbs or adsorbs a volatile liquid such as water in a considerable amount. These compounds may be used in combination.

Examples of the polymer which undergoes decomposition or modification to produce a gas when acted upon heat include self-oxidative polymer such as nitrocellulose, halogen-containing polymer such as chlorinated polyolefin, chlorinated rubber, polyrubber chloride, polyvinyl chloride and polyvinylidene chloride, acrylic polymer such as polyisobutyl methacrylate having a volatile compound such as water adsorbed thereto, cellulose ester such as ethyl cellulose having a volatile compound such as water adsorbed thereto, and natural polymer compound such as gelatin having a volatile compound such as water adsorbed thereto. Examples of the low molecular compound which undergoes decomposition or modification to produce a gas when acted upon by heat include a compound which undergoes thermal decomposition to produce a gas such as diazo compound and azide compound.

The thermal decomposition or modification of the heat-sensitive material preferably occurs at a temperature of not higher than 280° C., more preferably not higher than 230° C.

In the case where as the heat-sensitive material of the light-to-heat conversion layer there is used a low molecular compound, the low molecular compound is preferably used in combination with a binder. As the binder there may be used the foregoing polymer which itself undergoes decomposition or modification to produce a gas when acted upon by heat. However, an ordinary binder having no such properties may be used. In the case where a heat-sensitive low molecular compound and a binder are used in combination, the ratio of former to latter by mass is preferably from 0.02:1 to 3:1, more preferably from 0.05:1 to 2:1. The heat-sensitive peeling layer is preferably covered by the light-to-heat conversion layer almost on the entire surface thereof. The thickness of the heat-sensitive peeling layer is normally from 0.03 $\mu$m to 1 $\mu$m, preferably from 0.05 $\mu$m to 0.5 $\mu$m.

In the case of heat transfer sheet comprising a light-to-heat conversion layer, a heat-sensitive peeling layer and an image-forming layer laminated in this order on a support, the heat-sensitive peeling layer undergoes decomposition or modification to produce a gas when acted upon by a heat transferred from the light-to-heat conversion layer. The decomposition or gas production causes the heat-sensitive peeling layer to partly disappear or the occurrence of cohesive failure in the heat-sensitive peeling layer, deteriorating the adhesion between the light-to-heat conversion layer and the image-forming layer. Therefore, when the heat-sensitive peeling layer shows some behavior, a part of the heat-sensitive peeling layer adheres to the image-forming layer and appears on the surface of the finally formed image, occasionally causing stain on the image. Accordingly, it is preferred that the heat-sensitive peeling layer be little colored, that is, a high transparency is shown with respect to visible light to prevent visual stain from appearing on the image formed even if the transfer of heat-sensitive peeling layer occurs. In some detail, the absorbance of the heat-sensitive peeling layer is not greater than 50%, preferably not greater than 10% with respect to visible light.

The heat transfer sheet may have a light-to-heat conversion layer made of a light-to-heat conversion layer coating solution having the foregoing heat-sensitive material added thereto to provide a layer which acts as both a light-to-heat conversion layer and a heat-sensitive layer instead of having an independent heat-sensitive peeling layer.

It is preferred that the heat transfer sheet exhibits a static friction coefficient of not greater than 0.35, preferably not greater than 0.20 on the uppermost layer on the image-forming layer side thereof. When the static friction coefficient of the outermost layer is not greater than 0.35, the roll can be prevented from being stained during the conveyance of the heat transfer sheet, making it possible to enhance the quality of the image thus formed. The measurement of static friction coefficient can be carried out by the method disclosed in Japanese Patent Application (Laid-Open) No. 2001-47753 (paragraph (0011).

The surface of the image-forming layer preferably has a Smooster value of from 0.5 to 50 mmHg (approximately equal to 0.0665 to 6.65 KPa) and Ra of from 0.05 to 0.4 $\mu$m at 23° C. and 55% RH. In this arrangement, the number of microvoids at which the image-receiving layer and the image-forming layer don't come in contact with each other can be reduced to facilitate transfer and improve image quality. The value of Ra can be measured using a surface roughness meter (Surfcom, produced by TOKYO SEIKI CO., LTD.) according to JIS B0601. The surface hardness of the image-forming layer is not smaller than 10 g with a sapphire needle. The charged potential of the image-forming layer is preferably from −100 V to 100 V after 1 second of grounding following electrification according to Test Standard 4046 of Federal Government of U.S.A. The surface resistivity of the image-forming layer is preferably not greater than $10^9$ Ω at 23° C. and 55% RH.

The image-receiving sheet to be used in combination with the heat transfer sheet will be further described hereinafter.

Image-receiving Sheet

Layer Configuration

The image-receiving sheet normally comprises one or more image-receiving layers provided on a support. If necessary, one or more of any of cushioning layer, peeling layer and interlayer are provided interposed between the support and the image-receiving layer. The image-receiving sheet preferably comprises aback layer provided on the support on the side thereof opposite the image-receiving layer from the standpoint of conveyability.

Support

As the support there may be used an ordinary sheet-shaped substrate such as plastic sheet, metal sheet, glass sheet, resin-coated paper, paper and composite thereof. Examples of the plastic sheet employable herein include polyethylene terephthalate sheet, polycarbonate sheet, polyethylene sheet, polyvinyl chloride sheet, polyvinylidene chloride sheet, polystyrene sheet, styrene-acrylonitrile sheet, and polyester sheet. Examples of paper employable herein include printing paper, and coated paper.

The support preferably has microvoids to improve image quality. The support can be prepared by a process which comprises melt-extruding a molten mixture of a thermoplastic resin, an inorganic pigment and a filler made of a polymer incompatible with the thermoplastic resin into a single-layer or multi-layer film, and then biaxially or biaxially orienting the film. In this case, the voids can be determined by properly selecting the resin and filler or predetermining the mixing proportion, orienting conditions, etc.

As the thermoplastic resin there is preferably used a polyolefin resin such as polypropylene or polyethylene terephthalate resin because it has a good crystallinity and orientability and can easily form voids therein. The polyolefin resin or polyethylene terephthalate resin is preferably used as a main component properly in combination with a small amount of other thermoplastic resins. The inorganic pigment to be used as filler preferably has an average particle diameter of from 1 μm to 20 μm. Examples of the inorganic pigment employable herein include calcium carbonate, clay, diatomaceous earth, titanium oxide, aluminum hydroxide, and silica. As the incompatible resin to be used as filler there is preferably used a polyethylene terephthalate if a polypropylene is used as thermoplastic resin. For the details of the support having microvoids, reference can be made to Japanese Patent Application (Laid-Open) No. 2001-105752.

The content of the filler such as inorganic pigment in the support is normally from about 2% to 30% by volume.

The thickness of the image-receiving sheet is normally from 10 μm to 400 μm, preferably from 25 μm to 200 μm. The support may be subjected to surface treatment such as corona discharge treatment and glow discharge treatment to enhance its adhesion to the image-receiving layer (or cushioning layer) or the adhesion of the heat transfer sheet to the image-forming layer.

Image-receiving Layer

The image-receiving sheet may comprise one or more image-receiving layers provided on the support so that the image-forming layer is transferred to and fixed on the surface thereof. The image-receiving layer is preferably a layer mainly composed of an organic polymer binder. The binder is preferably a thermoplastic resin. Examples of the thermoplastic resin employable herein include homopolymer and copolymer of acrylic monomers such as acrylic acid, methacrylic acid, acrylic acid ester and methacrylic acid ester, cellulose polymer such as methyl cellulose, ethyl cellulose and cellulose acetate, homopolymer and copolymer of vinyl monomers such as polystyrene, polyvinyl pyrrolidone, polyvinyl butyral, polyvinyl alcohol and polyvinyl chloride, condensed polymer such as polyester and polyamide, and rubber polymer such as butadiene-styrene copolymer. The binder to be incorporated in the image-receiving layer is preferably a polymer having a glass transition temperature (Tg) of lower than 90° C. to provide a proper adhesion to the image-forming layer. To this end, the image-receiving layer can comprise a plasticizer incorporated therein. The binder polymer preferably has Tg of not lower than 30° C. to prevent blocking between sheets. It is particularly preferred that the binder polymer to be incorporated in the image-receiving layer be the same as or analogous to that of the image-forming layer to enhance the adhesion to the image-forming layer during laser recording and hence the sensitivity or image strength.

The surface of the image-receiving layer preferably has a Smooster value of from 0.5 to 50 mmHg (approximately equal to 0.0665 to 6.65 KPa) and Ra of from 0.05 to 0.4 μm at 23° C. and 55% RH. In this arrangement, the number of microvoids at which the image-receiving layer and the image-forming layer don't come in contact with each other can be reduced to facilitate transfer and improve image quality. The value of Ra can be measured using a surface roughness meter (Surfcom, produced by TOKYO SEIKI CO., LTD.) according to JIS B0601. The charged potential of the image-receiving layer is preferably from −100 V to 100 V after 1 second of grounding following electrification according to Test Standard 4046 of Federal Government of U.S.A. The surface resistivity of the image-receiving layer is not greater than $10^9$ Ω at 23° C. and 55% RH. The image-receiving layer has a surface static friction coefficient of preferably not greater than 0.2. The image-receiving layer preferably has a surface energy of from 23 to 35 mJ/m$^2$.

In the case where an image which has been transferred to the image-receiving layer is transferred to printing paper or the like, at least one of the image-receiving layers is preferably formed by a photo-setting material. As the composition of the photo-setting material there may be used a combination of (a) a photopolymerizable monomer made of at least one polyfunctional vinyl or vinylidene compound capable of producing a photopolymerization product upon addition polymerization, (b) an organic polymer, (c) a photopolymerization initiator and optionally a heat polymerization inhibitor. As the polyfunctional vinyl monomer there may be used an unsaturated ester of polyol, particularly acrylic or methacrylic acid ester (e.g., ethylene glycol diacrylate, pentaerythritol tetraaacrylate).

As the organic polymer there may be used the polymer for the image-receiving layer. As the photopolymerization initiator there may be used an ordinary photoradical polymerization initiator such as benzophenone and Michler's ketone in an amount of from 0.1% to 20% by mass (i.e., by weight) based on the mass of the image-receiving layer.

The thickness of the image-receiving layer is from 0.3 μm to 7 μm, preferably from 0.7 μm to 4 μm. When the thickness of the image-receiving layer is not smaller than 0.3 μm, desired film strength can be secured during the retransfer to printing paper. By predetermining the thickness of the image-receiving layer to not greater than 4 μm, the gloss of the image which has been retransferred to paper can be suppressed to improve the approximation to desired printed matter.

Other Layers

A cushioning layer may be provided interposed between the support and the image-receiving layer. The provision of such a cushioning layer makes it possible to enhance the adhesion between the image-forming layer and the image-receiving layer during transfer by laser heat and hence improve image quality. Further, even when foreign matters enter into the gap between the heat transfer sheet and the image-receiving layer during recording, the deformation of the cushioning layer causes the reduction of the gap between the image-receiving layer and the image-forming layer, making it possible to reduce the size of image defects such as white mark. Moreover, in the case where an image which has been transferred and formed is transferred to printing paper separately prepared, the surface of the image-receiving layer deforms according to the unevenness on the surface of paper, making it possible to improve the transferability of the image-receiving layer. Further, the cushioning layer can lower the gloss of the transferred material, making it possible to enhance the approximation to desired printed matter.

The cushioning layer is preferably formed by a material having a low elastic modulus, a material having rubber elasticity or a thermoplastic resin which easily softens when heated so as to easily undergo deformation when the image-receiving layer is stressed and attain the foregoing effect. The elastic modulus of the cushioning layer is preferably from 0.5 MPa to 1.0 GPa, particularly from 1 MPa to 0.5 GPa, more preferably from 10 to 100 MPa at room temperature. In order to allow foreign matters such as dust to sink thereinto, the cushioning layer preferably exhibits a penetration (25° C., 100 g, 5 seconds) of not smaller than 10 according to JISK2530. The glass transition temperature of the cushioning layer is not higher than 80° C., preferably not higher than 25° C. The softening point of the cushioning layer is preferably from 50° C. to 200° C. It is preferably practiced to incorporate a plasticizer in the binder to adjust the physical properties, e.g., Tg of the cushioning layer. Specific examples of the material to be used as the binder for the cushioning layer include rubbers such as urethane rubber, butadiene rubber, nitrile rubber, acryl rubber and natural rubber, polyethylene, polypropylene, polyester, styrene-butadiene copolymer, ethylene-vinyl acetate copolymer, ethylene-acryl copolymer, vinyl chloride-vinyl acetate copolymer, vinylidene chloride resin, plasticizer-containing vinyl chloride resin, polyamide resin, and phenolic resin.

The thickness of the cushioning layer depends on the resin used and other conditions but is normally from 3 μm to 100 μm, preferably from 10 μm to 52 μm.

The image-receiving layer and the cushioning layer need to be bonded to each other until the step of laser recording. In order to transfer an image to printing paper, the two layers are preferably provided such that they can be peeled off each other. In order to facilitate peeling, a peeling layer is preferably provided interposed between the cushioning layer and the image-receiving layer to a thickness of from 0.1 μm to 2 μm. When the thickness of the peeling layer is too great, the desired properties of the cushioning layer can difficultly appear. Thus, the properties of the cushioning layer need to be adjusted by the kind of the peeling layer.

Specific examples of the binder for the peeling layer include polyolefin, polyester, polyvinyl acetal, polyvinyl formal, polyparabanic acid, methyl polymethacrylate, polycarbonate, ethyl cellulose, nitrocellulose, methyl cellulose, carboxymethyl cellulose, hydroxypropyl cellulose, polyvinyl alcohol, polyvinyl chloride, urethane resin, fluororesin, styrene such as polystyrene and acrylonitrile, crosslinking product thereof, thermosetting resin having Tg of not lower than 65° C. such as polyamide, polyimide, polyetherimide, polysulfone, polyethersulfone and aramide, and hardening product thereof. As the hardening agent there may be used an ordinary hardening agent such as isocyanate and melamine.

Taking into account the foregoing physical properties, a polycarbonate, acetal or ethyl cellulose can be preferably used as a binder for the peeling layer from the standpoint of storage properties. Further, it is particularly preferred that the image-receiving layer be formed by an acrylic resin to provide a good peelability during the retransfer of the image formed by laser heat transfer.

Alternatively, a layer which exhibits an extremely lowered adhesion to the image-receiving layer during cooling can be used as a peeling layer. In some detail, such a layer may be mainly composed of a hot-melt compound such as wax and binder or a thermoplastic resin.

As the hot-melt compound there may be used a material as described in Japanese Patent Application (Laid-Open) No. 1988-193886. Particularly preferred examples of such a material include microcrystalline wax, paraffin wax, and carnauba wax. As the thermoplastic resin there is preferably used an ethylene copolymer such as ethylene-vinyl acetate resin or cellulose resin.

The peeling layer may comprise a higher aliphatic acid, higher alcohol, higher aliphatic acid ester, amide, higher amine, etc. incorporated therein as additives as necessary.

Another structure of the peeling layer is a layer which melts or softens upon heating to undergo cohesive failure itself. Such a peeling layer preferably comprises a supercooling material incorporated therein.

Examples of such a supercooling material include poly-ε-caprolactone, polyoxyethylene, benzotriazole, tribenzylamine, and vanilin.

The other structure of peeling layer further comprises a compound for lowering the adhesion to the image-receiving layer incorporated therein. Examples of such a compound include silicone resin such as silicone oil, fluororesin such as teflon and fluorine-containing acrylic resin, polysiloxane resin, acetal resin such as polyvinyl butyral, polyvinyl acetal and polyvinyl formal, solid wax such as polyethylene wax and amide wax, and fluorine-based and phosphoric acid ester-based surface active agents.

As the method for forming a peeling layer there may be used a method which comprises applying a solution or latex dispersion of the foregoing material in a solvent to the cushioning layer by a coating method such as blade coating, roll coating, bar coating, curtain coating and gravure coating or extrusion lamination method such as hot melt method. Alternatively, a method may be used which comprises applying a solution or latex dispersion of the foregoing material in a solvent to a tentative base by the foregoing method, laminating the laminate with the cushioning layer, and then peeling the tentative base off the laminate.

The image-receiving layer to be combined with the heat transfer sheet may have an image-receiving layer which also acts as a cushioning layer. In this structure, the image-receiving sheet may consist of a support and a cushioning image-receiving layer or a support, an undercoating layer and a cushioning image-receiving layer. In this case, too, the cushioning image-receiving layer is preferably provided peelably such that the image can be retransferred to printing paper. In this arrangement, the image which has been retransferred to printing paper has an excellent gloss.

The thickness of the cushioning image-receiving layer is from 5 μm to 100 μm, preferably from 10 μm to 40 μm.

The image-receiving sheet preferably comprises a back layer provided on the side of the support opposite the image-receiving layer to have an improved conveyability. The back layer preferably comprises an antistatic agent such as surface active agent and particulate tin oxide and a matting agent such as silicon oxide and particulate PMMA incorporated therein to improve the conveyability of the image-receiving sheet in the recording device.

The foregoing additives may be incorporated not only in the back layer but also in the image-receiving layer and other layers as necessary. The kind of these additives cannot be unequivocally defined depending on the purpose. For example, a matting agent having an average particle diameter of from 0.5 μm to 10 μm may be incorporated in the layer in an amount of from about 0.5% to 80%. As an antistatic agent there may be used one properly selected from the group consisting of various surface active agents and electrically-conducting agents such that the surface resistivity of the layer is not higher than $10^{12}$ Ω, preferably not higher than $10^{9}$ Ω at 23° C. and 50% RH.

Examples of the binder to be incorporated in the back layer include various general-purpose polymers such as gelatin, polyvinyl alcohol, methyl cellulose, nitrocellulose, acetyl cellulose, aromatic polyamide resin, silicone resin, epoxy resin, alkydresin, phenolic resin, melamine resin, fluororesin, polyimide resin, urethane resin, acrylic resin, urethane-modified silicone resin, polyethylene resin, polypropylene resin, polyester resin, teflon resin, polyvinyl butyral resin, vinyl chloride-based resin, polyvinyl acetate, polycarbonate, organic borone compound, aromatic ester, fluorinated polyurethane and polyethersulfone.

The back layer is preferably formed by crosslinking a crosslinkable water-soluble binder to prevent the powder of matting agent from falling or improve the damage resistance of the back layer. This arrangement also has a great effect on blocking during storage.

This crosslinking process may be carried out by the action of heat, active rays and pressure, singly or in combination, depending on the properties of the crosslinking agent used. In some cases, the support may comprise an arbitrary adhesive layer provided on the back layer side thereof to render itself adhesive.

As the matting agent which is preferably incorporated in the back layer there may be used an organic or inorganic particulate material. Examples of the organic matting agent employable herein include particulate polymethyl methacrylate (PMMA), polystyrene, polyethylene, polypropylene and other radically polymerized polymer, and particulate condensed polymers such as particulate polyester and polycarbonate.

The back layer is preferably provided in an amount of from about 0.5 to 5 g/m$^2$. When the amount of the back layer falls below 0.5 g/m$^2$ the resulting coatability is unstable, causing troubles such as falling of powder of matting agent. On the contrary, when the amount of the back layer greatly exceeds 5 g/m$^2$, the preferred particle diameter of the matting agent greatly increases, causing the back layer to emboss the image-receiving layer during storage and hence causing lack or unevenness in the recorded image particularly in the heat transfer process involving the transfer of a thin image-forming layer.

The matting agent preferably has a number-average particle diameter of from 2.5 $\mu$m to 20 $\mu$m greater than the thickness of the binder layer in the back layer. The matting agent needs to comprise particles having a particle diameter of not smaller than 8 $\mu$m in an amount of not smaller than 5 mg/m$^2$, preferably from 6 to 600 mg/m$^2$. In this arrangement, defectives due to foreign matter can be eliminated. By using a matting agent having a particle diameter distribution such that the value $\sigma$/rn (coefficient of variation of particle diameter) obtained by dividing the standard deviation of particle diameter by the number-average particle diameter is not greater than 0.3, defectives caused by particles having an abnormally great particle diameter can be eliminated. Further, desired properties can be obtained even when the matting agent is used in a smaller amount. The variation coefficient is more preferably not greater than 0.15.

The back layer preferably comprises an antistatic agent incorporated therein to prevent the triboelectric charge with the conveyor roll that causes the attraction of foreign matter. Examples of the antistatic agent employable herein include cationic surface active agents, anionic surface active agents, nonionic surface active agents, polymer antistatic agents, electrically-conductive particulate materials, and compounds as described in "11290 no Kagaku Shohin "11290 Chemical Products)", Kagaku Kogyo Nipposha, pp. 875–876.

As the antistatic agent to be incorporated in the back layer there may be used carbon black, a metal oxide such as zinc oxide, titanium oxide and tin oxide or an electrically-conductive particulate material such as organic semiconductor among the foregoing materials. In particular, the electrically-conductive particulate material cannot undergo dissociation from the back layer, making it possible to exert a stable antistatic effect regardless of atmosphere.

The back layer may further comprise a release agent such as active agent, silicone oil and fluororesin incorporated therein to render itself coatable or releasable.

It is particularly preferred that the back layer exhibit a softening point of not higher than 70° C. as measured by TMA (Thermomechanical Analysis) of the cushioning layer and image-receiving layer.

TMA softening point is determined by observing the phase of the object to be measured while being heated at a constant rate under a constant load. In the present invention, TMA softening point is defined by the temperature at which the object to be measured begins to show a phase change. For the measurement of TMA softening point, a measuring instrument such as Thermoflex (produced by Rigaku Corp.) may be used.

The heat transfer sheet and the image-receiving sheet can be then processed such that the image-forming layer of the heat transfer sheet and the image-receiving layer of the image-receiving sheet are combined to form a laminate which can be used to form an image.

The laminate of heat transfer sheet and image-receiving sheet can be formed by any method. For example, the laminate can be easily obtained by laminating the image-forming layer of the heat transfer sheet and the image-receiving layer of the image-receiving sheet, and then passing the laminate over a pressure heat roller. In this process, the heating temperature is preferably not higher than 160° C. or not higher than 130° C.

Alternatively, the laminate can be obtained by the foregoing vacuum contact method. The vacuum contact method comprises winding the image-receiving sheet on a drum having suction holes for vacuum suction provided therein, and then allowing a heat transfer sheet having a size of slightly greater than that of the image-receiving sheet to come in vacuum-contact with the image-receiving sheet while air is being uniformly pushed out by a squeeze roller. A further method comprises mechanically sticking the image-receiving sheet to a metal drum under tension, and then similarly sticking the heat transfer sheet to the image-receiving sheet under tension so that they come in close contact with each other. Particularly preferred among these methods is vacuum contact method because any temperature controlling means such as heat roller is not required, facilitating rapid and uniform lamination.

EXAMPLE

The present invention will be further described in the following examples, but the present invention should not be construed as being limited thereto. The term "parts" as used hereinafter is meant to indicate "parts by mass" unless otherwise specified.

Example 1-1

Preparation of Heat Transfer Sheet K (Black)

Preparation of Back Layer

| [Preparation of 1st back layer coating solution] | |
|---|---|
| Aqueous dispersion of acrylic resin (Julymer ET410; solid content: 20% by mass; produced by Nihon Junyaku Co., Ltd.) | 2 parts |
| Antistatic agent (aqueous dispersion of tin oxide-antimony oxide) (average particle diameter: 0.1 $\mu$m; 17% by mass(by weight)) | 7.0 parts |
| Polyoxyethylene phenyl ether | 0.1 parts |
| Melamine compound (Sumitix Resin M-3, produced by SUMITOMO CHEMICAL CO., LTD.) | 0.3 parts |
| Distilled water to make | 100 parts |

Formation of 1st Back Layer

A biaxially oriented polyethylene terephthalate support (Ra on both sides: 0.01 $\mu$m) having a thickness of 75 $\mu$m was subjected to corona discharge treatment on one side (back surface) thereof. The 1st back layer coating solution was applied to the corona discharge-treated side of the polyethylene terephthalate support to a dry thickness of 0.03 μm, and then dried at a temperature of 180° C. for 30 seconds to form a 1st back layer thereon. The support had a Young's modulus of 450 Kg/mm$^2$ (approximately equal to 4.4 GPa) in the longitudinal direction and 500 Kg/mm$^2$ (approximately equal to 4.9 GPa) in the crosswise direction. The support had an F-5 value of 10 Kg/mm2 (approximately equal to 98 MPa) in the longitudinal direction and 13 Kg/mm2 (approximately equal to 127.4 MPa) in the crosswise direction. The support had a thermal shrinkage coefficient of 0.3% and 0.1% in the longitudinal direction and crosswise direction, respectively, at 100° C. for 30 minutes. The support had a breaking strength of 29 Kg/mm$^2$ (approximately equal to 196 MPa) in the longitudinal direction and 25 Kg/mm$^2$ (approximately equal to 245 MPa) in the crosswise direction and an elastic modulus of 400 Kg/mm$^2$ (approximately equal to 3.9 GPa).

| [Preparation of 2nd back layer] | |
|---|---|
| Polyolefin (Chemipearl S-120; 27% by mass, produced by Mitsui Petrochemical Industries, Ltd.) | 3.0 parts |
| Antistatic agent (aqueous dispersion of tin oxide-antimony oxide) (average particle diameter: 0.1 μm; 17% by mass) | 2.0 parts |
| Colloidal silica (Snowtex C; 20% by mass; produced by Nissan Chemical Industries, Ltd.) | 2.0 parts |
| Epoxy compound (Dinacoal EX-614B, produced by Nagase Kasei Co., Ltd.) | 0.3 parts |
| Distilled water to make | 100 parts |

Formation of 2nd Back Layer

The 2nd back layer coating solution was applied to the 1st back layer to a dry thickness of 0.03 μm, and then dried at a temperature of 170° C. for 30 seconds to form a 2nd back layer thereon.

Formation of Light-to-heat Conversion Layer

Preparation of Light-to-heat Conversion Layer Coating Solution

The following components were mixed with stirring by a stirrer to prepare a light-to-heat conversion layer coating solution.

Formulation of Light-to-heat Conversion Layer Coating Solution

| | |
|---|---|
| Infrared-absorbing dye ("NK-2014", cyanine dye having the following structure produced by Nihon Kanko Shikiso Co., Ltd.) | 7.6 parts |

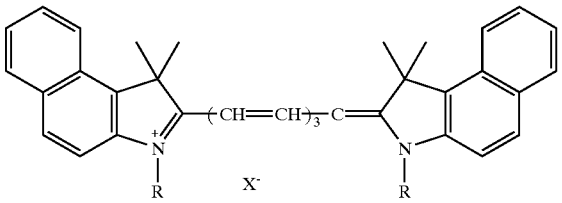

wherein R represents $CH_3$; and $X^-$ represents $ClO_4^-$.

| | |
|---|---|
| Polyimide resin having the following structure | 29.3 parts |

-continued ("Rikacoat SN-20F"; thermal decomposition temperature: 510° C.; produced by New Japan Chemical Co., Ltd.)

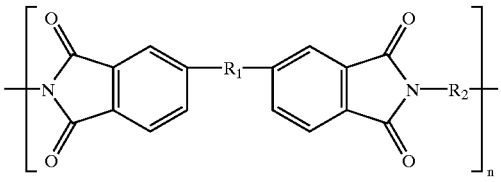

wherein $R_1$ represents $SO_2$; and $R_2$ represents

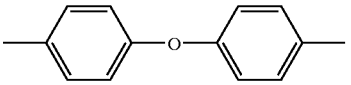

or

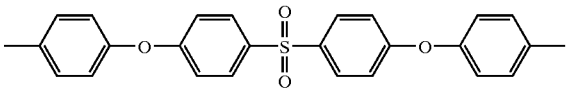

| | |
|---|---|
| Exon naphtha | 5.8 parts |
| N-methylpyrrolidone (NMP) | 1,500 parts |
| Methyl ethyl ketone | 360 parts |
| Surface active agent ("Megafac F-176PF"; F-based surface active agent produced by DAINIPPON INK & CHEMICALS, INC.) | 0.5 parts |
| Matting agent having the following formulation | 14.1 parts |

Preparation of Matting Agent Dispersion 10 parts of a spherically particulate silica having an average particle diameter of 1.5 μm (Seahostar KE-P150, produced by NIPPON SHOKUBAI CO., LTD.), 2 parts of a dispersant polymer (acrylic acid ester-styrene copolymer; Johncryl 611, produced by Johnson Polymer Co., Ltd.), 16 parts of methyl ethyl ketone and 64 parts of N-methylpyrrolidone were mixed. The mixture and 30 parts of glass beads having a diameter of 2 mm were then put into a 200 ml polyethylene vessel. The mixture was then subjected to dispersion by means of a pain shaker (produced by Toyo Seiki Seisakusho, Ltd.) for 2 hours to obtain a dispersion of a particulate silica.

Formation of Light-to-heat Conversion Layer on the Surface of Support

The foregoing light-to-heat conversion layer coating solution was applied to one surface of a polyethylene terephthalate film having a thickness of 75 μm (support) by means of a wire bar. The coated material was then dried in a 120° C. oven for 2 minutes to form a light-to-heat conversion layer on the support. The light-to-heat conversion layer thus obtained was then measured for optical density at a wavelength of 808 nm by means of a Type UV-2400 ultraviolet spectrophotometer (produced by Shimadzu Corp.). As a result, the light-to-heat conversion layer exhibited OD of 1.03. For the measurement of the thickness of the light-to-heat conversion layer, a section of the light-to-heat conversion layer was observed under a scanning electron microscope. As a result, the light-to-heat conversion layer was confirmed to have a thickness of 0.3 μm on the average.

Formation of Image-forming Layer

Preparation of Black Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill for 2 hours to obtain a mother liquor of pigment dispersion.

Formulation of Mother Liquor of Black Pigment Dispersion

| Formulation 1 | |
|---|---|
| Polyvinyl butyral ("Eslec B BL-SH", produced by SEKISUI CHEMICAL CO., LTD.) | 12.6 parts |
| Pigment Black 7 (Carbon Black C. I. No. 77266) ("Mitsubishi Carbon Black #5", PVC blackness: 1, produced by Mitsubishi Chemical Corporation) | 4.5 parts |
| Dispersing aid (high molecular pigment dispersant) ("Solsperse S-20000", produced by ICI Co., Ltd.; comprising $(C_2H_5)_2N$-$(CH_2)_z$-O-) (in which z represents 2, ethylene glycol and propylene glycol at a ratio of 1:13:32) | 0.8 parts |
| n-Propyl alcohol | 79.4 parts |
| **Formulation 2** | |
| Polyvinyl butyral ("Eslec B BL-SH", produced by SEKISUI CHEMICAL CO., LTD.) | 12.6 parts |
| Pigment Black 7 (Carbon Black C. I. No. 77266) ("Mitsubishi Carbon Black MA100", PVC blackness: 10, produced by Mitsubishi Chemical Corporation) | 10.5 parts |
| Dispersing aid (high molecular pigment dispersant) ("Solsperse S-20000", produced by ICI Co., Ltd.) | 0.8 parts |
| n-Propyl alcohol | 79.4 parts |

Subsequently, the following components were mixed with stirring by a stirrer to prepare a black image-forming layer coating solution.

| [Formulation of black image-forming layer coating solution] | |
|---|---|
| Mother liquor of black pigment dispersion described above Formulation 1:Formulation 2 = 70:30 | 185.7 parts |
| Polyvinyl butyral ("Eslec B BL-SH", produced by SEKISUI CHEMICAL CO., LTD.) | 11.9 parts |
| Wax-based compound | |
| Neutron 2 (amide stearate, produced by (produced by Nippon Fine chemical Co., Ltd.) | 1.7 parts |
| Diamide BM (amide behenate, produced by Nippon Chemical Co., Ltd.) | 1.7 parts |
| Diamide Y (amide laurate, produced by Nippon Chemical Co., Ltd.) | 1.7 parts |
| Diamide KP (amide palmitate, produced by Nippon Chemical Co., Ltd.) | 1.7 parts |
| Diamide L-200 (amide erucate, produced by Nippon Chemical Co., Ltd.) | 1.7 parts |
| Diamide O-200 (amide oleate, produced by Nippon Chemical Co., Ltd.) | 1.7 parts |
| Rosin ("KE-311", produced by Arakawa Chemical Industries, Ltd.) (formulation: resin acid: 80 to 97%; resin acid components: abietic acid: 30 to 40$; neoabietic acid: 10 to 20%; dihydroabietic acid: 14%; tetrahydroabietic acid: 14%) | 11.4 parts |
| Surface active agent ("Megafac F-176PF"; F-based surface active agent produced by DAINIPPON INK & CHEMICALS, INC.) | 2.1 parts |
| Inorganic pigment ("MEK-ST", 30% methyl ethyl ketone solution, | 7.1 parts |

-continued

| [Formulation of black image-forming layer coating solution] | |
|---|---|
| produced by Nissan Chemical Industries, Ltd.) | |
| n-Propyl alcohol | 1,050 parts |
| Methyl ethyl ketone | 295 parts |

The black image-forming layer coating solution thus obtained was then measured for average particle diameter and proportion of particles having a diameter of not greater than 1 μm using a laser scattering process particle size distribution meter. As a result, the average particle diameter was 0.25 μm and the proportion of particles having a diameter of not greater than 1 μm was 0.5%.

Formation of Black Image-forming Layer on the Surface of Light-to-heat Conversion Layer The foregoing black image-forming layer coating solution was applied to the surface of the light-to-heat conversion layer by means of a wire bar for 1 minute. The coated material was then dried in a 100° C. oven for 2 minutes to form a black image-forming layer on the light-to-heat conversion layer. In this manner, a heat transfer sheet having a light-to-heat conversion layer and a black image-forming layer provided in this order on a support (hereinafter referred to as "heat transfer sheet K"; one having a yellow image-forming layer also provided on the support will be hereinafter referred to as "heat transfer sheet Y", one having a magenta image-forming layer also provided on the support will be hereinafter referred to as "heat transfer sheet M", one having a cyan image-forming layer also provided on the support will be hereinafter referred to as "heat transfer sheet C") was prepared.

The heat transfer sheet K was then measured for the optical density (optical density: OD) of black image-forming layer using a Type TD-904 Macbeth densitometer (with a W filter). As a result, the heat transfer sheet K was confirmed to have OD of 0.91. The black image-forming layer was then measured for thickness. As a result, the black image-forming layer was confirmed to have a thickness of 0.60 μm on the average.

The image-forming layer thus obtained had the following physical properties.

The image-forming layer has a surface hardness of preferably not smaller than 10 g with a sapphire needle. In some detail, the image-forming layer had a surface hardness of not smaller than 200 g.

The image-forming layer has a surface Smooster value of preferably from 0.5 to 50 mmHg (approximately equal to 0.0665 to 6.65 kPa) at 23° C. and 55%RH. In some detail, the image-forming layer had a surface Smooster value of 9.3 mmHg (approximately equal to 1.24 kPa).

The image-forming layer has a surface static friction coefficient of preferably not greater than 0.8. In some detail, the image-forming layer had a surface static friction coefficient of 0.08.

The image-forming layer had a surface energy of 29 $mJ/m^2$. The image-forming layer had a contact angle of 94.8° with respect to water.

The image-forming layer exhibited a percent deformation of 168% in the light-to-heat conversion layer when recording was effected at a linear rate of not smaller than 1 m/sec with a laser beam having a luminous intensity of not smaller than 1,000 $W/mm^2$ on the exposed surface.

Preparation of Heat Transfer Sheet Y

A heat transfer sheet Y was prepared in the same manner as the heat transfer sheet K except that the yellow image-forming layer coating solution having the following formulation was used instead of the black image-forming layer coating solution. The heat transfer sheet Y thus obtained had an image-forming layer having a thickness of 0.42 μm.

| [Formulation of mother liquor of yellow pigment dispersion] | |
|---|---|
| Formulation 1 of yellow pigment | |
| Polyvinyl butyral ("Eslec B BL-SH", produced by SEKISUI CHEMICAL CO., LTD.) | 7.1 parts |
| Pigment Yellow 180 (C. I. No. 21290) ("Novoperm Yellow P-HG", Clariant Japan Co., Ltd.) | 12.9 parts |
| Dispersing aid ("Solsperse S-20000", produced by ICI Co., Ltd.) | 0.6 parts |
| n-Propyl alcohol | 79.4 parts |
| Formulation 2 of yellow pigment | |
| Polyvinyl butyral ("Eslec B BL-SH", produced by SEKISUI CHEMICAL CO., LTD.) | 7.1 parts |
| Pigment Yellow 139 (C. I. No. 56298) ("Novoperm Yellow M2R 70", Clariant Japan Co., Ltd.) | 12.9 parts |
| Dispersing aid ("Solsperse S-20000", produced by ICI Co., Ltd.) | 0.6 parts |
| n-Propyl alcohol | 79.4 parts |
| [Formulation of yellow image-forming layer coating solution] | |
| Mother liquor of yellow pigment dispersion described above Formulation 1 of yellow pigment:Formulation 2 of yellow pigment = 95:5 (parts) | 126 parts |
| Polyvinyl butyral ("Eslec B BL-SH", produced by SEKISUI CHEMICAL CO., LTD.) | 4.6 parts |
| Wax-based compound | |
| Neutron 2 (amide stearate, produced by (produced by Nippon Fine chemical Co., Ltd.) | 0.7 parts |
| Diamide BM (amide behenate, produced by Nippon Chemical Co., Ltd.) | 0.7 parts |
| Diamide Y (amide laurate, produced by Nippon Chemical Co., Ltd.) | 0.7 parts |
| Diamide KP (amide palmitate, produced by Nippon Chemical Co., Ltd.) | 0.7 parts |
| Diamide L-200 (amide erucate, produced by Nippon Chemical Co., Ltd.) | 0.7 parts |
| Diamide O-200 (amide oleate, produced by Nippon Chemical Co., Ltd.) | 0.7 parts |
| Nonionic surface active agent ("Chemistat 1100", produced by SANYO CHEMICAL INDUSTRIES, LTD.) | 0.4 parts |
| Rosin ("KE-311", produced by Arakawa Chemical Industries, Ltd.) | 2.4 parts |
| Surface active agent ("Megafac F-176PF"; solid content: 20%, produced by DAINIPPON INK & CHEMICALS, INC.) | 0.8 parts |
| n-Propyl alcohol | 793 parts |
| Methyl ethyl ketone | 198 parts |

The image-forming layer thus obtained had the following physical properties.

The image-forming layer has a surface hardness of preferably not smaller than 10 g with a sapphire needle. In some detail, the image-forming layer had a surface hardness of not smaller than 200 g.

The image-forming layer has a surface Smooster value of preferably from 0.5 to 50 mmHg (approximately equal to 0.0665 to 6.65 kPa) at 23° C. and 55%RH. In some detail, the image-forming layer had a surface Smooster value of 2.3 mmHg (approximately equal to 0.31 kPa).

The image-forming layer has a surface static friction coefficient of preferably not greater than 0.8. In some detail, the image-forming layer had a surface static friction coefficient of 0.1.

The image-forming layer had a surface energy of 24 $mJ/m^2$. The image-forming layer had a contact angle of 108.1° with respect to water.

The image-forming layer exhibited a percent deformation of 150% in the light-to-heat conversion layer when recording was effected at a linear rate of not smaller than 1 m/sec with a laser beam having a luminous intensity of not smaller than 1,000 $W/mm^2$ on the exposed surface.

Preparation of Heat Transfer Sheet M

A heat transfer sheet M was prepared in the same manner as the heat transfer sheet K except that the magenta image-forming layer coating solution having the following formulation was used instead of the black image-forming layer coating solution. The heat transfer sheet M thus obtained had an image-forming layer having a thickness of 0.38 μm.

| [Formulation of mother liquor of magenta pigment dispersion] | |
|---|---|
| Formulation 1 of magenta pigment | |
| Polyvinyl butyral ("Denkabutyral #2000-L, produced by DENKI KAGAKU KOGYO K.K.; Vicat softening point: 57° C.) | 12.6 parts |
| Pigment Red 57:1 (C. I. No. 15850:1) ("Symuler Brilliant Carmine 6B-229", produced by DAINIPPON INK & CHEMICALS, INC.) | 15.0 parts |
| Dispersing aid ("Solsperse S-20000", produced by ICI Co., Ltd.) | 0.6 parts |
| n-Propyl alcohol | 80.4 parts |
| Formulation 2 of magenta pigment | |
| Polyvinyl butyral ("Denkabutyral #2000-L, produced by DENKI KAGAKU KOGYO K.K.; Vicat softening point: 57° C.) | 12.6 parts |
| Pigment Red 57:1 (C. I. No. 15850:1) ("Lionol Red 6B-4290F", produced by TOYO INK MFG. CO., LTD.) | 15.0 parts |
| Dispersing aid ("Solsperse S-20000", produced by ICI Co., Ltd.) | 0.6 parts |
| n-Propyl alcohol | 79.4 parts |
| [Formulation of magenta image-forming layer coating solution] | |
| Mother liquor of magenta pigment dispersion described above Formulation 1 of magenta pigment:Formulation 2 of magenta pigment = 95:5 (parts) | 163 parts |
| Polyvinyl butyral ("Denkabutyral #2000-L, produced by DENKI KAGAKU KOGYO K.K.; Vicat softening point: 57° C.) | 4.0 parts |
| Wax-based compound | |
| Neutron 2 (amide stearate, produced by (produced by Nippon Fine chemical Co., Ltd.) | 1.0 parts |
| Diamide BM (amide behenate, produced by Nippon Chemical Co., Ltd) | 1.0 parts |
| Diamide Y (amide laurate, produced by Nippon Chemical Co., Ltd.) | 1.0 parts |
| Diamide KP (amide palmitate, produced by Nippon Chemical Co., Ltd.) | 1.0 parts |
| Diamide L-200 (amide erucate, produced by Nippon Chemical Co., Ltd.) | 1.0 parts |
| Diamide O-200 (amide oleate, produced by Nippon Chemical Co., Ltd.) | 1.0 parts |
| Nonionic surface active agent ("Chemistat 1100", produced by SANYO | 0.7 parts |

-continued

| | |
|---|---|
| CHEMICAL INDUSTRIES, LTD.) | |
| Rosin | 4.6 parts |
| ("KE-311", produced by Arakawa Chemical Industries, Ltd.) | |
| Pentaerythritol tetraacrylate | 2.5 parts |
| ""NK Ester A-TMMT", produced by Shinnakamura Chemical Co., Ltd.) | |
| Surface active agent | 1.3 parts |
| ("Megafac F-176PF"; solid content: 20%, produced by DAINIPPON INK & CHEMICALS, INC.) | |
| n-Propyl alcohol | 848 parts |
| Methyl ethyl ketone | 246 parts |

The image-forming layer thus obtained had the following physical properties.

The image-forming layer has a surface hardness of preferably not smaller than 10 g with a sapphire needle. In some detail, the image-forming layer had a surface hardness of not smaller than 200 g.

The image-forming layer has a surface Smooster value of preferably from 0.5 to 50 mmHg (approximately equal to 0.0665 to 6.65 kPa) at 23° C. and 55%RH. In some detail, the image-forming layer had a surface Smooster value of 3.5 mmHg (approximately equal to 0.47 kPa).

The image-forming layer has a surface static friction coefficient of preferably not greater than 0.8. In some detail, the image-forming layer had a surface static friction coefficient of 0.08.

The image-forming layer had a surface energy of 25 $mJ/m^2$. The image-forming layer had a contact angle of 98.80 with respect to water.

The image-forming layer exhibited a percent deformation of 160% in the light-to-heat conversion layer when recording was effected at a linear rate of not smaller than 1 m/sec with a laser beam having a luminous intensity of not smaller than 1,000 $W/mm^2$ on the exposed surface.

Preparation of Heat Transfer Sheet C

A heat transfer sheet C was prepared in the same manner as the heat transfer sheet K except that the cyan image-forming layer coating solution having the following formulation was used instead of the black image-forming layer coating solution. The heat transfer sheet C thus obtained had an image-forming layer having a thickness of 0.45 $\mu$m.

[Formulation of mother liquor of cyan pigment dispersion]

| | |
|---|---|
| Formulation 1 of cyan pigment | |
| Polyvinyl butyral ("Eslec B BL-SH", produced by SEKISUI CHEMICAL CO., LTD.) | 12.6 parts |
| Pigment Blue 15:4 (C. I. No. 74160) ("Cyanine Blue 700-10FG", produced by TOYO INK MFG. Co., Ltd.) | 15.0 parts |
| Dispersing aid ("PW-36", phosphoric acid ester-based surface active agent, produced Kusumoto Chemicals Co., Ltd.) | 0.8 parts |
| n-Propyl alcohol | 110 parts |
| Formulation 2 of yellow pigment | |
| Polyvinyl butyral ("Eslec B BL-SH", produced by SEKISUI CHEMICAL CO., LTD.) | 12.6 parts |
| Pigment Blue 15 (C. I. No. 74160) ("Lionol Blue 7027)", produced by TOYO INK MFG. Co., LTD.) | 15.0 parts |
| Dispersing aid ("PW-36", phosphoric acid ester-based surface active agent, produced Kusumoto Chemicals Co., Ltd.) | 0.8 parts |
| n-Propyl alcohol | 110 parts |

-continued

[Formulation of cyan image-forming layer coating solution]

| | |
|---|---|
| Mother liquor of cyan pigment dispersion described above Formulation 1 of cyan pigment:Formulation 2 of cyan pigment = 90:10 (parts) | 118 parts |
| Polyvinyl butyral ("Eslec B BL-SH", produced by SEKISUI CHEMICAL CO., LTD.) | 5.2 parts |
| Inorganic pigment "MEK-ST" | 1.3 parts |
| Wax-based compound | |
| Neutron 2 (amide stearate, produced by (produced by Nippon Fine chemical Co., Ltd.) | 1.0 parts |
| Diamide BM (amide behenate, produced by Nippon Chemical Co., Ltd.) | 1.0 parts |
| Diamide Y (amide laurate, produced by Nippon Chemical Co., Ltd.) | 1.0 parts |
| Diamide KP (amide palmitate, produced by Nippon Chemical Co., Ltd.) | 1.0 parts |
| Diamide L-200 (amide erucate, produced by Nippon Chemical Co., Ltd.) | 1.0 parts |
| Diamide O-200 (amide oleate, produced by Nippon Chemical Co., Ltd.) | 1.0 parts |
| Rosin ("KE-311", produced by Arakawa Chemical Industries, Ltd.) | 2.8 parts |
| Pentaerythritol tetraacrylate ("NK Ester A-TMMT", produced by Shinnakamura Chemical Co., Ltd.) | 1.7 parts |
| Surface active agent ("Megafac F-176PF"; solid content: 20%, produced by DAINIPPON INK & CHEMICALS, INC.) | 1.7 parts |
| n-Propyl alcohol | 890 parts |
| Methyl ethyl ketone | 247 parts |

The image-forming layer thus obtained had the following physical properties.

The image-forming layer has a surface hardness of preferably not smaller than 10 g with a sapphire needle. In some detail, the image-forming layer had a surface hardness of not smaller than 200 g.

The image-forming layer has a surface Smooster value of preferably from 0.5 to 50 mmHg (approximately equal to 0.0665 to 6.65 kPa) at 23° C. and 55%RH. In some detail, the image-forming layer had a surface Smooster value of 7.0 mmHg (approximately equal to 0.93 kPa).

The image-forming layer has a surface static friction coefficient of preferably not greater than 0.2. In some detail, the image-forming layer had a surface static friction coefficient of 0.08.

The image-forming layer had a surface energy of 25 $mJ/m^2$. The image-forming layer had a contact angle of 98.8° with respect to water.

The image-forming layer exhibited a percent deformation of 165% in the light-to-heat conversion layer when recording was effected at a linear rate of not smaller than 1 m/sec with a laser beam having a luminous intensity of not smaller than 1,000 $W/mm^2$ on the exposed surface.

Preparation of Image-receiving Layer

The cushioning layer coating solution and the image-receiving layer coating solution having the following formulation were prepared.

| 1) Cushioning layer coating solution | |
|---|---|
| Vinyl chloride-vinyl acetate copolymer (Main binder) ("MPR-TSL", produced by NISSHIN CHEMICAL INDUSTRY CO., LTD.) | 20 parts |
| Plasticizer ("Pallaplex G-40", produced by CP. HALL. COMPANY) | 10 parts |
| Surface active agent (fluorine-based surface active agent; coating aid) ("Megafac F-177, produced by DAINIPPON INK & CHEMICALS, INC.) | 0.5 parts |
| Antistatic agent (quaternary ammonium salt) ("SAT-5 Supper (IC)", Nihon Junyaku Co., Ltd.) | 0.3 parts |
| Methyl ethyl ketone | 60 parts |
| Toluene | 10 parts |
| N,N-dimethylformamide | 3 parts |
| 2) Image-forming layer coating solution | |
| Polyvinyl butyral ("Eslec B BL-SH", produced by SEKISUI CHEMICAL CO., LTD.) | 8 parts |
| Antistatic agent ("Sanstat 2012A", produced by SANYO CHEMICAL INDUSTRIES, LTD.) | 0.7 parts |
| Surface active agent ("Megafac F-177, produced by DAINIPPON INK & CHEMICALS, INC.) | 0.1 parts |
| n-Propyl alcohol | 20 parts |
| Methanol | 20 parts |
| 1-Methoxy-2-propanol | 50 parts |

Using a small width coating machine, the foregoing cushioning layer coating solution was applied to a white PET support ("Lumirror #130E58"; thickness: 130 μm, produced by TORAY INDUSTRIES, INC.). The coated material was then dried. Subsequently, the foregoing image-receiving layer coating solution was applied to the cushioning layer, and then dried. The coated amount of these coating solutions were adjusted such that the dry thickness of the cushioning layer and the image-receiving layer were about 20 μm and about 2 μm, respectively. The white PET support used was a plastic support having voids made of a laminate (total thickness: 130 μm; specific gravity: 0.8) of a polyethylene terephthalate layer having voids (thickness: 116 μm; voids: 20%) and a titanium oxide-containing polyethylene terephthalate layer (thickness: 7 μm; titanium oxide content: 2%) provided on the surface thereof. The material thus prepared was wound in the form of roll, and then stored at room temperature for 1 week before used for image recording by the following laser beam.

The image-receiving layer thus obtained had the following physical properties.

The image-receiving layer has a surface roughness Ra of preferably from 0.01 to 0.4 μm. In some detail, the image-receiving layer had a surface roughness of 0.02 μm.

The image-receiving layer has a surface waviness of preferably not greater than 2 μm. In some detail, the image-receiving layer had a surface waviness of 1.2 μm.

The image-receiving layer has a surface Smooster value of preferably from 0.5 to 50 mmHg (approximately equal to 0.0665 to 6.65 kPa) at 23° C. and 55%RH. In some detail, the image-receiving layer had a surface Smooster value of 0.8 mmHg (approximately equal to 0.11 kPa).

The image-receiving layer has a surface static friction coefficient of preferably not greater than 0.8. In some detail, the image-receiving layer had a surface static friction coefficient of 0.37.

The image-receiving layer had a surface energy of 29 $mJ/m^2$. The image-receiving layer had a contact angle of 85.0° with respect to water.

Formation of Transfer Image

As an image-forming system there was used one shown in FIG. 4 having as a recording device Luxel FINALPROOF 5600. Using the image forming sequence of the system and the transferring process of the system, an image was transferred to paper.

The image-receiving sheet (567 cm×79 cm) prepared as described above was wound on a rotary drum having a diameter of 38 cm having vacuum section holes having a diameter of 1 mm formed therein (face density of 1 hole per area of 3 cm×8 cm) so that it was vacuum-sucked thereby. Subsequently, the foregoing heat transfer sheet K (black) which had been cut into an area of 61 cm×84 cm was superimposed on the foregoing image-receiving sheet in such an arrangement that it protruded uniformly from the image-receiving sheet. While being squeezed by a squeeze roller, the two sheets were adhered to and laminated with each other by air suction through the section holes. The vacuum degree developed when the section holes are blocked was −150 mmHg (approximately equal to 81.13 kPa) with respect to 1 atm. While the drum was being rotated, the surface of the laminate on the drum was externally irradiated with a beam having a wavelength of 808 nm from a semiconductor laser in such a manner that the beam was converged onto the surface of the light-to-heat conversion layer in a spot having a diameter of 7 μm. The beam was moved in the direction (subsidiary canning) perpendicular to the direction of rotation of the rotary drum (main scanning direction). In this manner, laser image (line image) recording was made on the laminate. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Rotary speed of drum: 500 rpm

Subsidiary scanning pitch: 6.35 μm

Ambient temperature and humidity: 20° C./40%; 23° C./50%; 26° C./65%

The exposure drum has a diameter of preferably not smaller than 360 mm. In some detail, the exposure drum had a diameter of 380 mm.

The image size was 515 mm×728 mm. The resolution was 2,600 dpi.

The laminate on which laser recording had been made was removed from the drum. The heat transfer sheet K was peeled off the image-receiving sheet by hand. As a result, it was confirmed that only the light-irradiated area on the image-forming layer of the heat transfer sheet K had been transferred from the heat transfer sheet K to the image-receiving sheet.

An image was transferred from the various heat transfer sheets, i.e., heat transfer sheet Y, heat transfer sheet M and heat transfer sheet C to the image-receiving sheet in the same manner as described above. The four color images thus transferred were each then transferred to the recording paper to form a multi-color image. As a result, even when laser recording was effected with a laser beam comprising a binary multi-beam arrangement at a high energy under different temperature and humidity conditions, a multi-color image having a high quality and a stable transfer density was formed.

In order to transfer the image to paper, a heat transferring device having a dynamic friction coefficient of from 0.1 to 0.7 with respect to the material of the insertion table, i.e., polyethylene terephthalate and a conveying speed of from 15 to 50 mm/sec was used. The Vickers hardness of the material of the heat roll of the heat transferring device is preferably from 10 to 100. In some detail, the heat roll had a Vickers hardness of 70.

The image thus obtained exhibited good properties under all the three ambient temperature and humidity conditions.

For the evaluation of the optical density of the image-forming layer of the various heat transfer sheets, the image transferred to Tokubishiart paper was measured for optical density of Y, M, C and K with Y mode, M mode, C mode and K mode, respectively, using a Type X-rite 938 densitometer (produced by X-rite Inc.).

The optical density and the ratio of optical density to thickness of image-forming layer ($\mu$m) of the various colors are set forth in Table 1 below.

TABLE 1

| Color | Optical density | Optical density/thickness of image-forming layer |
|---|---|---|
| Y | 1.01 | 2.40 |
| M | 1.51 | 3.97 |
| C | 1.59 | 3.03 |
| K | 1.82 | 3.03 |

Example 1-2

A transfer image was formed in the same manner as in Example 1-1 except that as the recording device there was used Proof Setter Spectrum (produced by CreoScitex Inc.). As a result, a good image was obtained similarly to Example 1-1.

Comparative Example 1-2

A transfer image was formed in the same manner as in Example 1-1 except that the formulation of the various color image-forming layer coating solutions were changed as described later.

[Formulation of black image-forming layer coating solution]

| | |
|---|---|
| Mother liquor of black pigment dispersion | 185.7 parts |
| Formulation 1:Formulation 2 = 70:30 | |
| Wax-based compound | |
| Neutron 2 (amide stearate, produced by (produced by Nippon Fine chemical Co., Ltd.) | 3.7 parts |
| Diamide BM (amide behenate, produced by Nippon Chemical Co., Ltd.) | 3.7 parts |
| Diamide Y (amide laurate, produced by Nippon Chemical Co., Ltd.) | 3.7 parts |
| Diamide KP (amide palmitate, produced by Nippon Chemical Co., Ltd.) | 3.7 parts |
| Diamide L-200 (amide erucate, produced by Nippon Chemical Co., Ltd.) | 3.7 parts |
| Diamide O-200 (amide oleate, produced by Nippon Chemical Co., Ltd.) | 3.7 parts |
| Rosin ("KE-311", produced by Arakawa Chemical Industries, Ltd.) (formulation: resin acid: 80 to 97%; resin acid components: abietic acid: 30 to 40$; neoabietic acid: 10 to 20%; dihydroabietic acid: 14%; tetrahydroabietic acid: 14%) | 13.5 parts |
| Surface active agent ("Megafac F-176PF"; solid content: 20%; produced by DAINIPPON INK & CHEMICALS, INC.) | 2.1 parts |
| n-Propyl alcohol | 1,050 parts |
| Methyl ethyl ketone | 295 parts |

-continued

[Formulation of yellow image-forming layer coating solution]

| | |
|---|---|
| Mother liquor of yellow pigment dispersion described above | 126 parts |
| Formulation 1 of yellow pigment:Formulation 2 of yellow pigment = 95:5 (parts) | |
| Wax-based compound | |
| Neutron 2 (amide stearate, produced by (produced by Nippon Fine chemical Co., Ltd.) | 1.5 parts |
| Diamide BM (amide behenate, produced by Nippon Chemical Co., Ltd.) | 1.5 parts |
| Diamide Y (amide laurate, produced by Nippon Chemical Co., Ltd.) | 1.5 parts |
| Diamide KP (amide palmitate, produced by Nippon Chemical Co., Ltd.) | 1.5 parts |
| Diamide L-200 (amide erucate, produced by Nippon Chemical Co., Ltd.) | 1.5 parts |
| Diamide O-200 (amide oleate, produced by Nippon Chemical Co., Ltd.) | 1.5 parts |
| Nonionic surface active agent ("Chemistat 1100", produced by SANYO CHEMICAL INDUSTRIES, LTD.) | 0.4 parts |
| Rosin ("KE-311", produced by Arakawa Chemical Industries, Ltd.) | 3.0 parts |
| Surface active agent ("Megafac F-176PF"; solid content: 20%, produced by DAINIPPON INK & CHEMICALS, INC.) | 0.8 parts |
| n-Propyl alcohol | 793 parts |
| Methyl ethyl ketone | 198 parts |

[Formulation of magenta image-forming layer coating solution]

| | |
|---|---|
| Mother liquor of magenta pigment dispersion described above | 163 parts |
| Formulation 1 of magenta pigment:Formulation 2 of magenta pigment = 95:5 (by parts) | |
| Wax-based compound | |
| Neutron 2 (amide stearate, produced by (produced by Nippon Fine chemical Co., Ltd.) | 1.7 parts |
| Diamide BM (amide behenate, produced by Nippon Chemical Co., Ltd.) | 1.7 parts |
| Diamide Y (amide laurate, produced by Nippon Chemical Co., Ltd.) | 1.7 parts |
| Diamide KP (amide palmitate, produced by Nippon Chemical Co., Ltd.) | 1.7 parts |
| Diamide L-200 (amide erucate, produced by Nippon Chemical Co., Ltd.) | 1.7 parts |
| Diamide O-200 (amide oleate, produced by Nippon Chemical Co., Ltd.) | 1.7 parts |
| Nonionic surface active agent ("Chemistat 1100", produced by SANYO CHEMICAL INDUSTRIES, LTD.) | 0.7 parts |
| Rosin ("KE-311", produced by Arakawa Chemical Industries, Ltd.) | 4.6 parts |
| Pentaerythritol tetraacrylate ""NK Ester A-TMMT", produced by Shinnakamura Chemical Co., Ltd.) | 5.0 parts |
| Surface active agent ("Megafac F-176PF"; solid content: 20%, produced by DAINIPPON INK & CHEMICALS, INC.) | 1.3 parts |
| n-Propyl alcohol | 848 parts |
| Methyl ethyl ketone | 246 parts |

-continued

| [Formulation of cyan image-forming layer coating solution] | |
|---|---|
| Mother liquor of cyan pigment dispersion described above | 118 parts |
| Formulation 1 of cyan pigment:Formulation 2 of cyan pigment = 90:10 (parts) | |
| Wax-based compound | |
| Neutron 2 (amide stearate, produced by (produced by Nippon Fine chemical Co., Ltd.) | 1.9 parts |
| Diamide BM (amide behenate, produced by Nippon Chemical Co., Ltd.) | 1.9 parts |
| Diamide Y (amide laurate, produced by Nippon Chemical Co., Ltd.) | 1.9 parts |
| Diamide KP (amide palmitate, produced by Nippon Chemical Co., Ltd.) | 1.9 parts |
| Diamide L-200 (amide erucate, produced by Nippon Chemical Co., Ltd.) | 1.9 parts |
| Diamide O-200 (amide oleate, produced by Nippon Chemical Co., Ltd.) | 1.9 parts |
| Rosin ("KE-311", produced by Arakawa Chemical Industries, Ltd.) | 2.8 parts |
| Pentaerythritol tetraacrylate ("NK Ester A-TMMT", produced by Shinnakamura Chemical Co., Ltd.) | 3.0 parts |
| Surface active agent ("Megafac F-176PF"; solid content: 20%, produced by DAINIPPON INK & CHEMICALS, INC.) | 1.7 parts |
| n-Propyl alcohol | 890 parts |
| Methyl ethyl ketone | 247 parts |

Example 1-4

The same procedure as in Example 1-1 was carried out except that the composition of the mother liquor of each the pigment dispersions was changed as shown below.

The dispersing aid ("Solsperse S-20000") of black, yellow and magenta pigments was used in an amount of 2 times that in Example 1-1.

The dispersing aid ("PW-36") of cyan pigment was used in an amount of 2 times that in Example 1-1.

Comparative Example 1-1

The same procedure as in Example 1-3 was carried out except that the composition of the mother liquor of each the pigment dispersions was changed as shown below.

The dispersing aid ("Solsperse S-20000") of black, yellow and magenta pigments was used in an amount of 2 times that in Example 1-3.

The dispersing aid ("PW-36") of cyan pigment was used in an amount of 2 times that in Example 1-3.

The results of evaluation of the image thus transferred to paper are set forth in Table 2 below.

TABLE 2

| Example No. | Width of laser beam (μm) | Width of line image (μm) | Width of line image/ width of laser beam | Image quality of solid image area | Image quality of printed image area |
|---|---|---|---|---|---|
| Example 1-1 | 8.5 | 8.9 | 1.05 | G | G |
| Example 1-2 | 8.5 | 8.8 | 1.03 | G | G |
| Example 1-3 | 8.5 | 10.6 | 1.25 | F | G |
| Example 1-4 | 8.5 | 14.9 | 1.75 | F | F |

TABLE 2-continued

| Example No. | Width of laser beam (μm) | Width of line image (μm) | Width of line image/ width of laser beam | Image quality of solid image area | Image quality of printed image area |
|---|---|---|---|---|---|
| Comparative Example 1-1 | 8.5 | 19.1 | 2.25 | F | P |

In Table 2, the width of laser beam means a half of half-width (i.e., the half width at half maximum) of the energy distribution in the direction of subsidiary scanning of the integration in the direction of main scanning of binary energy distribution of laser beam spot.

The image obtained according to the foregoing system was evaluated as follows.

Evaluation of Image Quality

The image quality was visually evaluated according to the following criterion.

Solid Area:

G (good): Homogenous solid area

F (fair): Partial density unevenness exists

P (poor): Density unevenness exists on the entire surface

Line Image Area:

G (good): Line image has a sharp edge and a good resolution

F (fair): Line image has a notched edge and bridging in some portions

P (poor): Bridging exits on the entire surface

Figure 17:
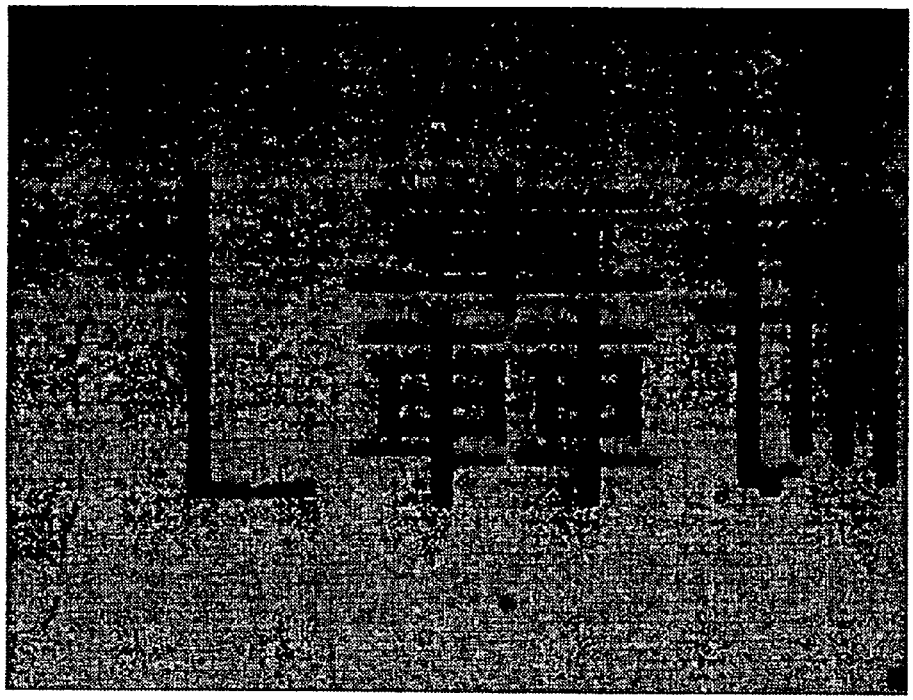
FIG. 17 illustrates the quality of 2-point letter in the image obtained in the example in a positive manner.
Figure 18:
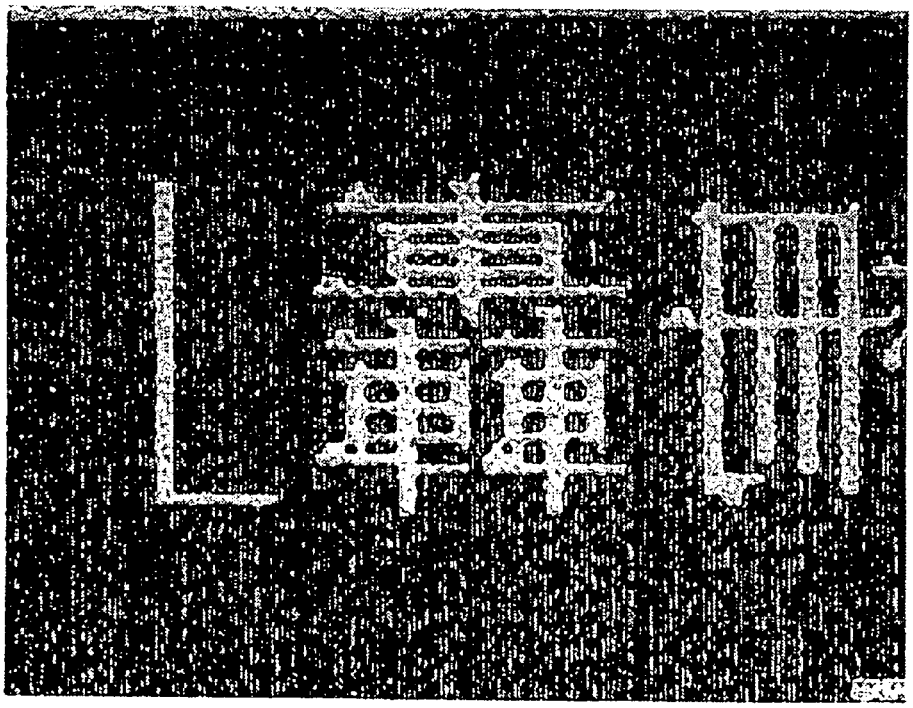
FIG. 18 illustrates the quality of 2-point letter in the image obtained in the example in a negative manner, wherein the reference numeral 1 indicates a recording device, the reference numeral 2 indicates a recording head, the reference numeral 3 indicates a subsidiary scanning rail, the reference numeral 4 indicates a recording drum, the reference numeral 5 indicates a heat transfer sheet loading unit, the reference numeral 6 indicates an image-receiving sheet roll, the reference numeral 7 indicates a conveying roll, the reference numeral 8 indicates a squeeze roller, the reference numeral 9 indicates a cutter, the reference numeral 10 indicates a heat transfer sheet, the reference numerals 10K, 10C, 10M and 10Y each indicate a heat transfer sheet roll, the reference numeral 12 indicates a support, the reference numeral 14 indicates a light-to-heat conversion layer, the reference numeral 16 indicates an image-forming layer, the reference numeral 20 indicates an image-receiving sheet, the reference numeral 22 indicates a support for image-receiving sheet, the reference numeral 24 indicates an image-receiving layer, the reference numeral 30 indicates a laminate, the reference numeral 31 indicates a discharge-receiving tray, the reference numeral 32 indicates a waste port, the reference numeral 33 indicates a discharge port, the reference numeral 34 indicates air, the reference numeral 35 indicates a waste box, the reference numeral 42 indicates printing paper, the reference numeral 43 indicates a heat roller, the reference numeral 44 indicates an insertion tray, the reference numeral 45 indicates the position of placing, the reference numeral 46 indicates an insertion roller, the reference numeral 47 indicates a guide made of a heat-resistant sheet, the reference numeral 48 indicates a peeling nail, the reference numeral 49 indicates a guide plate, and the reference numeral 50 indicates a discharge port.

A specific example of the image obtained in Example 1-1 is shown in FIGS. 17 and 18. FIG. 17 shows a positive image while FIG. 18 shows a negative image. It can be seen that these drawings reflect the foregoing results of evaluation.

The image obtained in Example 1-1 showed a resolution of from 2,400 to 2,540 dpi and thus was a halftone image corresponding to the number of printed lines. Every one of these dots had little stain or lack, giving an extremely sharp shape. Accordingly, clear halftone was formed over a wide range of from highlight to shadow (see FIGS. 5 to 12).

Figure 13:
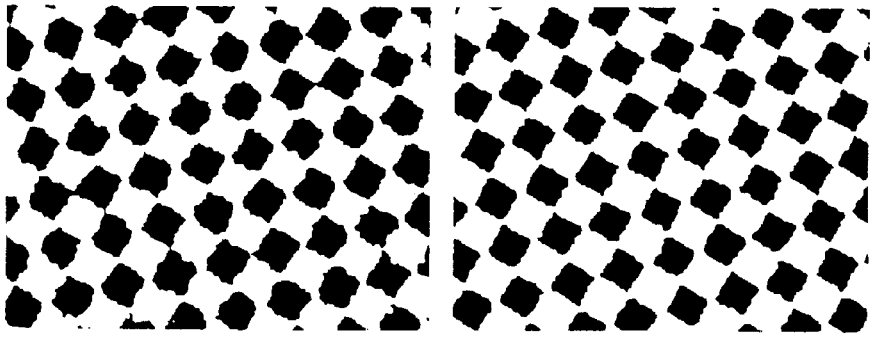
FIG. 13 illustrates the shape of dots of an image obtained in a still further example wherein the distance between the center of the dots is 125 μm.
Figure 14:
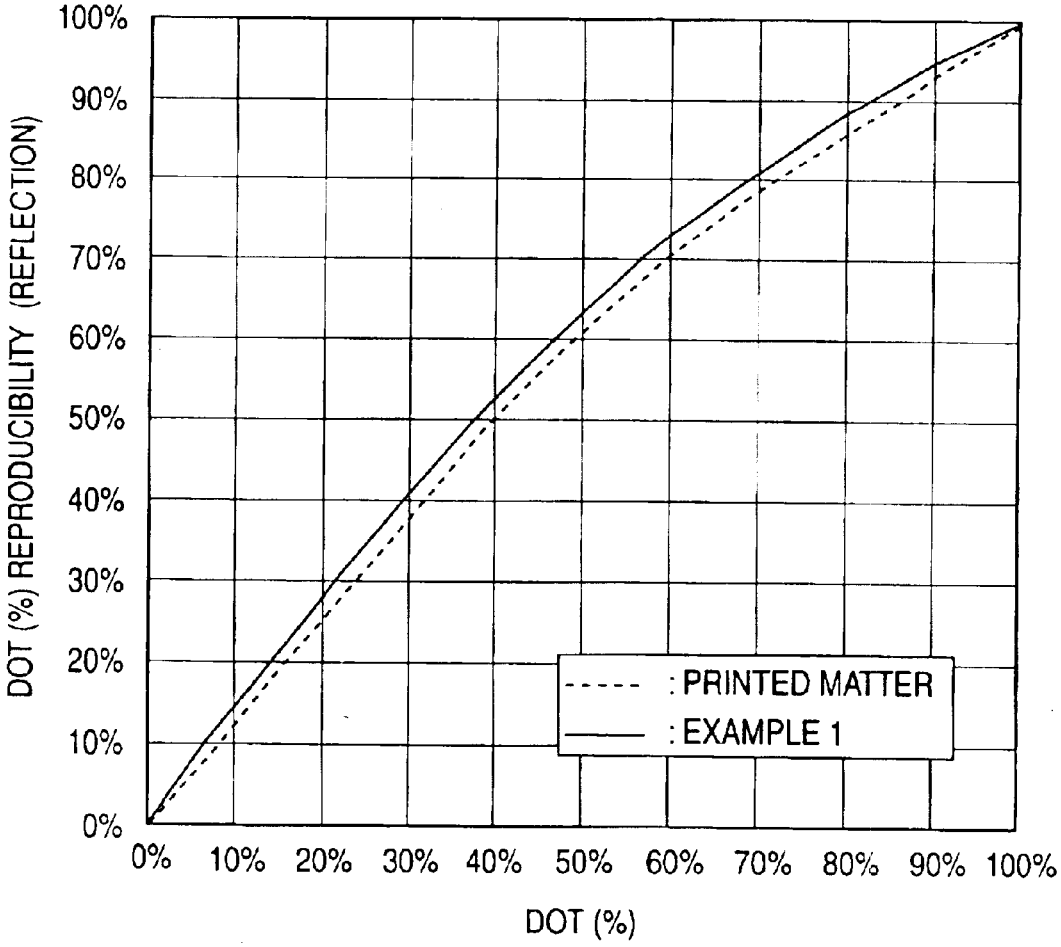
FIG. 14 illustrates the dot reproducibility of an image obtained in a still further example wherein the ordinate indicates the percent dot area calculated from the reflection density and the abscissa indicates the percent dot area of inputted signal.

The comparison of enlargement of dot shape in the image obtained in Example 1-1 and in the printed matter obtained according to the system of the present invention gives a pattern shown in FIG. 13. The dot reproducibility of the image obtained in Example 1-1 was compared with that of the printed matter (see FIG. 14). As can be seen in FIGS. 13 and 14, the shape of dot in the image of Example 1-1 is extremely close to that of the printed matter.

Figure 15:
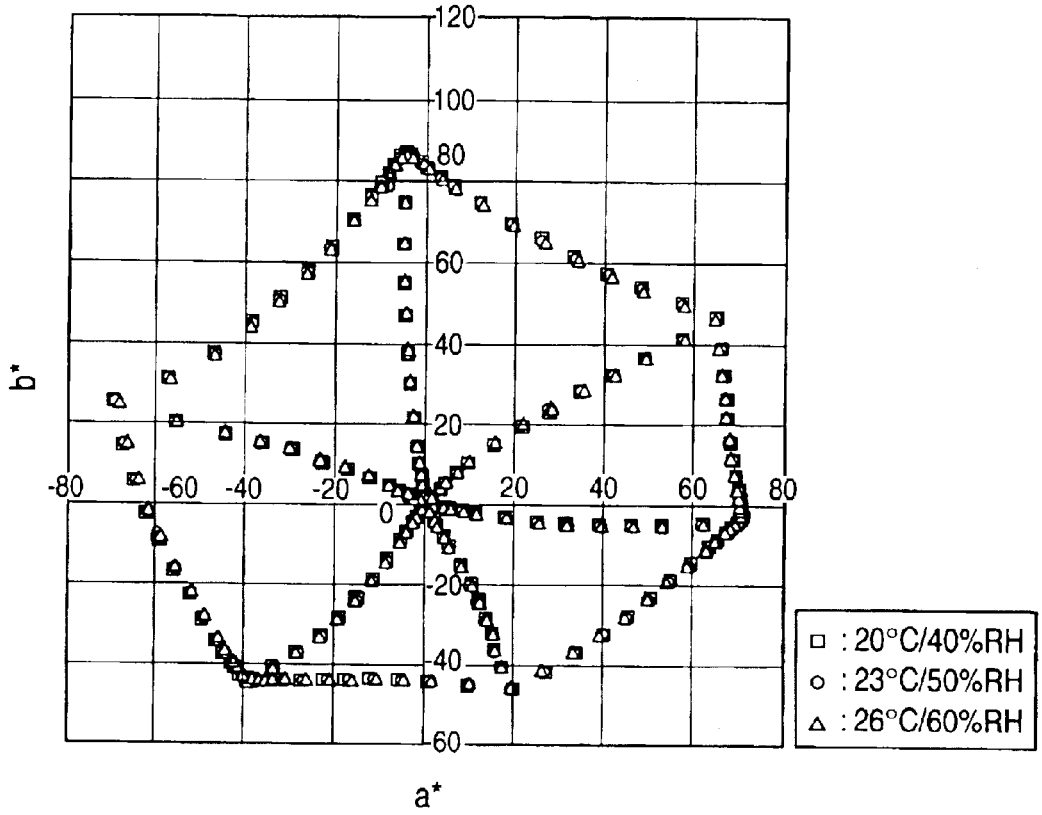
FIG. 15 illustrates the reproducibility in repetition of an image obtained in an example on a*b* plane of L*a*b* color representation system.

The image obtained in Example 1-1 is shown on a*b* plane of L*a*b* color representation system (see FIG. 15). As can be seen in FIG. 15, the image obtained in Example 1-1 showed a remarkable change of color hue also under different temperature and humidity conditions.

Example 1-3

Figure 16:
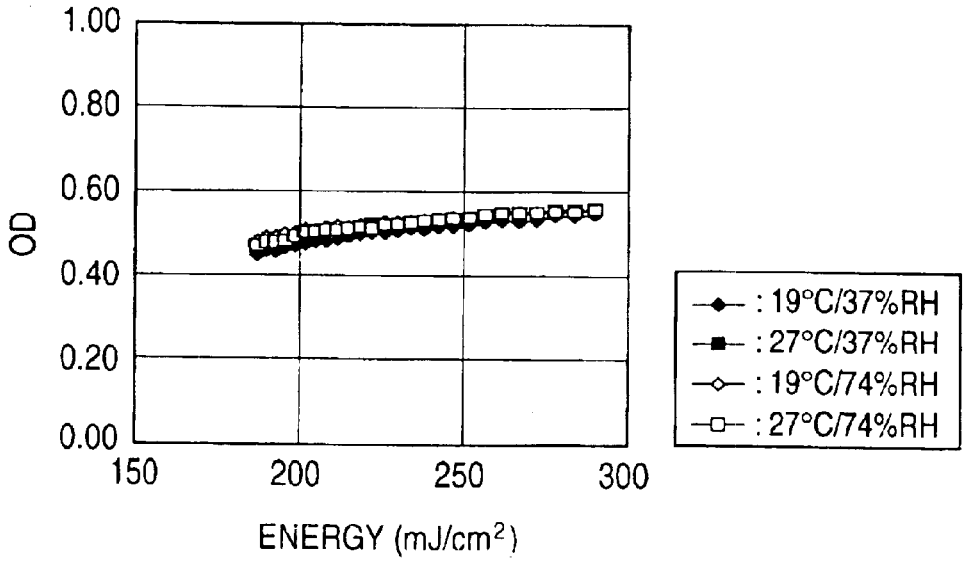
FIG. 16 illustrates the reproducibility in repetition of the image obtained in the example.

A transfer image was obtained on paper in the same manner as in Example 1 except that the image-forming material of Example 1-1 was used, the ambient temperature and humidity of the system were 19° C.—37%RH, 27° C.—38%RH, 19° C.—74%RH and 27° C.—74%RH and the laser radiation energy was changed to a range of from 180 to 290 mJ/cm$^2$. As a result, $OD_r$ (reflection optical density) shown in FIG. 16 was obtained. As can be seen in FIG. 16, the system of the present invention can provide a stable image under wide ambient temperature and humidity conditions even if the energy load shows some change.

Example 2-1

Preparation of Heat Transfer Sheet K (Black)

1) Preparation of Light-to-heat Conversion Layer Coating Solution

The following components were mixed with stirring by a stirrer to prepare a light-to-heat conversion layer coating solution.

[Formulation of light-to-heat conversion layer coating solution]

| | |
|---|---|
| Infrared-absorbing dye ("NK-2014", cyanine dye having the following structure produced by Nihon Kanko Shikiso Co., Ltd.) | 7.6 parts |
| Polyimide resin ("Rikacoat SN-20F"; thermal decomposition temperature: 510° C.; produced by New Japan Chemical Co., Ltd.) | 29.3 parts |
| N,N-dimethylformamide | 1,500 parts |
| Methyl ethyl ketone | 360 parts |
| Surface active agent ("Megafac F-177"; produced by DAINIPPON INK & CHEMICALS, INC.) | 0.5 parts |
| Matting agent ("Seahostar KEP150", particulate silica gel produced by NIPPON SHOKUBAI CO., LTD.) | 14.1 parts |

2) Formation of Light-to-heat Conversion Layer on the Surface of Support

A light-to-heat conversion layer was prepared in the same manner as in Example 1-1. The light-to-heat conversion layer thus obtained exhibited absorption in the vicinity of wavelength of 830 nm. The light-to-heat conversion layer was measured for absorbance (optical density: OD) by means of a Type UV-2400 ultraviolet spectrophotometer (produced by Shimadzu Corp.). As a result, the light-to-heat conversion layer exhibited OD of 0.9. For the measurement of the thickness of the light-to-heat conversion layer, a section of the light-to-heat conversion layer was observed under a scanning electron microscope. As a result, the light-to-heat conversion layer was confirmed to have a thickness of 0.3 μm on the average.

3) Preparation of Black Image-forming Layer Coating Solution

A black image-forming layer coating solution was prepared in the same manner as in Example 1-1 except that as the mother liquor of black pigment dispersion there was used the mother liquor of formulation 2.

The following components were mixed with stirring by a stirrer to prepare a black image-forming layer coating solution.

Formulation of Black Image-forming Layer Coating Solution

A coating solution was prepared in the same manner as in Example 1-1 except that the foregoing mother liquor of black pigment dispersion was used.

4) Formation of Black Image-forming Layer on the Surface of Light-to-heat Conversion Layer A heat transfer sheet K having a light-to-heat conversion layer and a black image-forming layer provided in this order on a support was prepared in the same manner as in Example 1-1.

Preparation of Heat Transfer Sheet Y (Yellow)

A heat transfer sheet Y was prepared in the same manner as in Example 1-1 except that as the mother liquor of yellow pigment dispersion there was used the mother liquor of formulation 1.

Preparation of Heat Transfer Sheet M (Magenta)

A heat transfer sheet M was prepared in the same manner as in Example 1-1 except that as the mother liquor of magenta pigment dispersion there was used the mother liquor of formulation 1.

Preparation of Heat Transfer Sheet C (Cyan)

A heat transfer sheet C was prepared in the same manner as the heat transfer sheet K except that the cyan image-forming layer coating solution having the following formulation was used instead of the black image-forming layer coating solution.

| | |
|---|---|
| Polyvinyl butyral ("Eslec B BL-SH", produced by SEKISUI CHEMICAL CO., LTD.) | 12.6 parts |
| Pigment (cyan pigment (Pigment Blue 15)) | 15.0 parts |
| Dispersing aid ("PW-36", produced by Kusumoto Chemicals Co., Ltd.) | 0.8 parts |
| n-Propyl alcohol | 110 parts |

Formulation of Cyan Image-forming Layer Coating Solution

A cyan image-forming layer coating solution was prepared in the same manner as in Example 1-1 except that the foregoing mother liquor of cyan pigment dispersion was used and the inorganic pigment "MEK-ST" was excluded from the formulation of Example 1-1.

Preparation of Image-receiving Sheet

An image-receiving sheet was prepared in the same manner as in Example 1-1.

Formation of Transfer Image

A transfer image was formed in essentially the same manner as in Example 1-1. In some detail, while the drum was being rotated, the surface of the laminate on the drum was externally irradiated with a beam having a wavelength of 830 nm from a semiconductor laser in such a manner that the beam was converged onto the surface of the light-to-heat conversion layer in a spot having a diameter of 7 μm. The beam was moved in the direction (subsidiary canning) perpendicular to the direction of rotation of the rotary drum (main scanning direction) In this manner, laser image (line image) recording was made on the laminate. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Main scanning speed: 6 m/sec

Subsidiary scanning pitch: 6.35 μm

The laminate on which laser recording had been made was removed from the drum. The heat transfer sheet K was peeled off the image-receiving sheet by hand. As a result, it was confirmed that only the light-irradiated area on the image-forming layer of the heat transfer sheet K had been transferred from the heat transfer sheet K to the image-receiving sheet.

An image was transferred from the various heat transfer sheets, i.e., heat transfer sheet Y, heat transfer sheet M and heat transfer sheet C to the image-receiving sheet in the same manner as described above. The four color images thus transferred were each then transferred to the recording paper to form a four-color multi-color image. Besides the multi-color image, a monochromatic recorded image was formed for each of these colors.

The width of line image was 1.04 times the laser beam width, which is defined by a half of half-width (i.e., the half width at half maximum) of the distribution in the direction of subsidiary scanning of the integration of the binary energy distribution of laser beam spot in the direction of main scanning.

Example 2-2

A recorded image was formed in the same manner as in Example 2-1 except that the yellow pigment to be incorporated in the heat transfer sheet was changed to Pigment Yellow 139.

Reference Example 2-1

A recorded image was formed in the same manner as in Example 2-2 except that the magenta pigment to be incorporated in the heat transfer sheet was changed to Pigment Red (48:3).

The reference example is an experimental example which is carried out for examining an effect at the region of the maximum absorbance (λmax) of spectral distribution of the heat transfer sheet.

The recorded images of Examples 2-1 and 2-2 and Reference Example 2-1 were then evaluated as follows.

1) Measurement of Color Difference ΔE

The monochromatic recorded images were each measured for L*, a* and b* using X-rite 938 (produced by X-rite Inc.) (measurement conditions: light source: D50; angle of view: 2°). A target printed matter obtained with Japan Color of JNC (Japan National Committee) was measured for $L_0$*, $a_0$* and $b_0$* in the same manner as described above. Then, the color difference ΔE from the target printed matter was calculated.

The smaller ΔE is, the less is the color difference from the target printed matter. In general, ΔE of from 2 to 3 is the lower limit at which there is no visual color difference.

$$\Delta E=\sqrt{(L_{0^*}-L^*)^2+(a_{0^*-a^*})^2+(b_{0^*-b^*})^2}$$

2) Evaluation of Approximation to Desired Printed Matter

The four-color multi-color recorded image was then visually evaluated by ten persons. The results were judged according to the following criterion.

G (good): Judged good by 7 to 10 of the ten persons

F (fair): Judged good by 3 to 5 of the ten persons

P (poor): Judged good by 2 or less of the ten persons

The various color heat transfer sheets were each then measured for λmax which is the maximum wavelength at which a maximum absorbance is given in the spectral distribution and half-width given when the maximum absorbance is 1.0 by means of a Type UV-2100 UV-visible spectrophotometer (produced by Shimadzu Corp.).

The results of evaluation (1) and (2) are set forth in Table 3 below.

TABLE 3

| | Yellow | | Magenta | | Cyan | | | Approximation to desired |
|---|---|---|---|---|---|---|---|---|
| Example No. | λmax | Half-width | λmax | Half-width | λmax | Half-width | ΔE | printed matter |
| Example 2-1 | 410 nm | 110 nm | 570 nm | 70 nm | 690 nm | 120 nm | 1.8 (yellow) | G |
| Example 2-2 | 435 nm | 170 nm | 570 nm | 70 nm | 690 nm | 120 nm | 5.5 (yellow) | F |
| Reference Example 2-1 | 435 nm | 170 nm | 535 nm | 70 nm | 690 nm | 120 nm | 7.5 (Magenta) | P |

Example 3-1

Preparation of Heat Transfer Sheet C (Cyan)

A heat transfer sheet C (cyan) was prepared in the same manner as in Example 1-1.

Example 3-2

Preparation of Heat Transfer Sheet M

A heat transfer sheet M was prepared in the same manner as in Example 1-1.

Example 3-3

Preparation of Heat Transfer Sheet Y

A heat transfer sheet Y was prepared in the same manner as in Example 1-1. The heat transfer sheet Y thus obtained had an image-forming layer having a thickness of 0.42 μm.

Example 3-4

A heat transfer sheet was prepared in the same manner as in Example 3-1 except that the following mother liquor of cyan pigment dispersion was used as the mother liquor of cyan pigment dispersion for the cyan image-forming layer coating solution.

| | |
|---|---|
| Mother liquor of cyan pigment dispersion | 118 parts |

Formulation 1 of cyan pigment:formulation 2 of cyan pigment=100:0 (parts)

Example 3-5

A heat transfer sheet was prepared in the same manner as in Example 3-1 except that the following mother liquor of cyan pigment dispersion was used as the mother liquor of cyan pigment dispersion for the cyan image-forming layer coating solution.

| | |
|---|---|
| Mother liquor of cyan pigment dispersion | 118 parts |

Formulation 1 of cyan pigment:formulation 2 of cyan pigment=0:100 (by parts)

Reference Example 3-1

A heat transfer sheet was prepared in the same manner as in Example 3-1 except that the formulation 1 of cyan pigment for the mother liquor of cyan pigment dispersion was changed to the following formulation and the mother liquor of cyan pigment for the cyan image-forming layer coating solution comprised the formulation 1 of cyan pigment in a proportion of 100%.

| Formulation 1 of cyan pigment: | |
|---|---|
| Polyvinyl butyral ("Eslec B BL-SH", produced by SEKISUI CHEMICAL CO., LTD.) | 12.6 parts |
| Pigment Blue 15: 6 ("Fastgen Blue EP-7S", produced by DAINIPPON INK & CHEMICALS, INC.) | 15.0 parts |
| Dispersing aid ("PW-36", produced by Kusumoto Chemicals Co., Ltd.) | 0.8 parts |
| n-Propyl alcohol | 110 parts |

Reference Example 3-2

A heat transfer sheet was prepared in the same manner as in Example 3-1 except that the formulation 1 of cyan pigment for the mother liquor of cyan pigment dispersion was changed to the following formulation and the mother liquor of cyan pigment for the cyan image-forming layer coating solution comprised the formulation 1 of cyan pigment in a proportion of 100%.

| Formulation 1 of cyan pigment: | |
|---|---|
| Polyvinyl butyral ("Eslec B BL-SH", produced by SEKISUI CHEMICAL CO., LTD.) | 12.6 parts |
| Pigment Blue 60 ("Fastgen Super Blue 6070S", produced by DAINIPPON INK & CHEMICALS, INC.) | 15.0 parts |
| Dispersing aid ("PW-36", produced by Kusumoto Chemicals Co., Ltd.) | 0.8 parts |
| n-Propyl alcohol | 110 parts |

Example 3-6

A heat transfer sheet was prepared in the same manner as in Example 3-1 except that the following mother liquor of magenta pigment dispersion was used as the mother liquor of magenta pigment dispersion for the magenta image-forming layer coating solution.

| | |
|---|---|
| Mother liquor of magenta pigment dispersion as described above | 163 parts |

Formulation 1 of magenta pigment:formulation 2 of magenta pigment=100:0 (parts)

Example 3-7

A heat transfer sheet was prepared in the same manner as in Example 3-2 except that the formulation 1 of magenta pigment for the mother liquor of magenta pigment dispersion was changed to the following formulation and the mother liquor of magenta pigment for the cyan image-forming layer coating solution comprised the formulation 1 of magenta pigment in a proportion of 100%.

| Formulation 1 of magenta pigment: | |
|---|---|
| Polyvinyl butyral ("Denkabutyral #2000-L", produced by DENKI KAGAKU KOGYO K.K.; Vicat softening point: 57° C.) | 12.6 parts |
| Pigment Red 48: 3 ("Symuler Red 3075", produced by DAINIPPON INK & CHEMICALS, INC.) | 15.0 parts |
| Dispersing aid ("Solsperse S-20000", produced by ICI Co., Ltd.) | 0.6 parts |
| n-Propyl alcohol | 80.4 parts |

Example 3-8

A heat transfer sheet was prepared in the same manner as in Example 3-2 except that the formulation 1 of magenta pigment for the mother liquor of magenta pigment dispersion was changed to the following formulation and the mother liquor of magenta pigment for the cyan image-forming layer coating solution comprised the formulation 1 of magenta pigment in a proportion of 100%.

| Formulation 1 of magenta pigment: | |
|---|---|
| Polyvinyl butyral ("Denkabutyral #2000-L", produced by DENKI KAGAKU KOGYO K. K.; Vicat softening point: 57° C.) | 12.6 parts |
| Pigment Red 146 ("Permanent Carmine FBB02", Clariant Japan Co., Ltd.) | 15.0 parts |
| Dispersing aid ("Solsperse S-20000", produced by ICI Co., Ltd.) | 0.6 parts |
| n-Propyl alcohol | 80.4 parts |

Reference Example 3-3

A heat transfer sheet was prepared in the same manner as in Example 3-2 except that the formulation 1 of magenta pigment for the mother liquor of magenta pigment dispersion was changed to the following formulation and the mother liquor of magenta pigment for the cyan image-forming layer coating solution comprised the formulation 1 of magenta pigment in a proportion of 100%.

| Formulation 1 of magenta pigment: | |
|---|---|
| Polyvinyl butyral ("Denkabutyral #2000-L", produced by DENKI KAGAKU KOGYO K. K.; Vicat softening point: 57° C.) | 12.6 parts |
| Pigment Red 213 ("Symuler Fast Red 4134A", produced by DAINIPPON INK & CHEMICALS, INC.) | 15.0 parts |
| Dispersing aid ("Solsperse S-20000", | 0.6 parts |

-continued

| Formulation 1 of magenta pigment: | |
|---|---|
| produced by ICI Co., Ltd.) | |
| n-Propyl alcohol | 80.4 parts |

Reference Example 3-3

A heat transfer sheet was prepared in the same manner as in Example 3-2 except that the formulation 1 of magenta pigment for the mother liquor of magenta pigment dispersion was changed to the following formulation and the mother liquor of magenta pigment for the cyan image-forming layer coating solution comprised the formulation 1 of magenta pigment in a proportion of 100%.

| Formulation 1 of magenta pigment: | |
|---|---|
| Polyvinyl butyral ("Denkabutyral #2000-L", produced by DENKI KAGAKU KOGYO K. K.; Vicat softening point: 57° C.) | 12.6 parts |
| Pigment Red 213 ("Symuler Fast Red 4134A", produced by DAINIPPON INK & CHEMICALS, INC.) | 15.0 parts |
| Dispersing aid ("Solsperse S-20000", produced by ICI Co., Ltd.) | 0.6 parts |
| n-Propyl alcohol | 80.4 parts |

Reference Example 3-4

A heat transfer sheet was prepared in the same manner as in Example 3-2 except that the formulation 1 of magenta pigment for the mother liquor of magenta pigment dispersion was changed to the following formulation and the mother liquor of magenta pigment for the cyan image-forming layer coating solution comprised the formulation 1 of magenta pigment in a proportion of 100%.

| Formulation 1 of magenta pigment: | |
|---|---|
| Polyvinyl butyral ("Denkabutyral #2000-L", produced by DENKI KAGAKU KOGYO K. K.; Vicat softening point: 57° C.) | 12.6 parts |
| Pigment Red 185 ("Novoperm Carmine HF4C", produced by Clariant Japan Co., Ltd.) | 15.0 parts |
| Dispersing aid ("Solsperse S-20000", produced by ICI Co., Ltd.) | 0.6 parts |
| n-Propyl alcohol | 80.4 parts |

Example 3-9

A heat transfer sheet was prepared in the same manner as in Example 3-3 except that the formulation 1 of yellow pigment for the mother liquor of magenta pigment dispersion was changed to the following formulation and the mother liquor of yellow pigment for the cyan image-forming layer coating solution comprised the formulation 1 of yellow pigment in a proportion of 100%.

| Formulation 1 of yellow pigment: | |
|---|---|
| Polyvinyl butyral ("Eslec B BL-SH", produced by SEKISUI CHEMICAL CO., LTD.) | 7.1 parts |
| Pigment Yellow 13 ("Symuler Fast Yellow GRF", produced by DAINIPPON INK & CHEMICALS, INC.) | 12.9 parts |
| Dispersing aid ("Solsperse S-20000", produced by ICI Co., Ltd.) | 0.6 parts |
| n-Propyl alcohol | 79.4 parts |

Example 3-10

A heat transfer sheet was prepared in the same manner as in Example 3-3 except that the formulation 1 of yellow pigment for the mother liquor of magenta pigment dispersion was changed to the following formulation and the mother liquor of yellow pigment for the cyan image-forming layer coating solution comprised the formulation 1 of yellow pigment in a proportion of 100%.

| Formulation 1 of yellow pigment: | |
|---|---|
| Polyvinyl butyral ("Eslec B BL-SH", produced by SEKISUI CHEMICAL CO., LTD.) | 7.1 parts |
| Pigment Yellow 14 ("Symuler Fast Yellow 4400", produced by DAINIPPON INK & CHEMICALS, INC.) | 12.9 parts |
| Dispersing aid ("Solsperse S-20000", produced by ICI Co., Ltd.) | 0.6 parts |
| n-Propyl alcohol | 79.4 parts |

Example 3-11

A heat transfer sheet was prepared in the same manner as in Example 3-3 except that the following mother liquor of yellow pigment dispersion was used as the mother liquor of yellow pigment dispersion for the yellow image-forming layer coating solution.

| | |
|---|---|
| Mother liquor of yellow pigment dispersion as described above | 126 parts |

Formulation 1 of yellow pigment:formulation 2 of yellow pigment=100:0 (by parts)

Reference Example 3-5

A heat transfer sheet was prepared in the same manner as in Example 3-3 except that the formulation 1 of yellow pigment for the mother liquor of yellow pigment dispersion was changed to the following formulation and the mother liquor of yellow pigment for the yellow image-forming layer coating solution comprised the formulation 1 of cyan pigment in a proportion of 100%.

| Formulation 1 of yellow pigment: | |
|---|---|
| Polyvinyl butyral ("Eslec B BL-SH", produced by SEKISUI CHEMICAL CO., LTD.) | 7.1 parts |
| Pigment Yellow 12 ("Symuler Fast Yellow GTF219", produced by DAINIPPON INK & CHEMICALS, INC.) | 12.9 parts |
| Dispersing aid ("Solsperse S-20000", produced by ICI Inc.) | 0.6 parts |
| n-Propyl alcohol | 79.4 parts |

Reference Example 3-6

A heat transfer sheet was prepared in the same manner as in Example 3-3 except that the formulation 1 of yellow pigment for the mother liquor of yellow pigment dispersion was changed to the following formulation and the mother liquor of yellow pigment for the yellow image-forming layer coating solution comprised the formulation 1 of cyan pigment in a proportion of 100%.

| Formulation 1 of yellow pigment: | |
|---|---|
| Polyvinyl butyral ("Eslec B BL-SH", produced by SEKISUI CHEMICAL CO., LTD.) | 7.1 parts |
| Pigment Yellow 155 ("Graphtol Yellow 3GP", produced by Clariant Japan Co., Ltd.) | 12.9 parts |
| Dispersing aid ("Solsperse S-20000", produced by ICI Inc.) | 0.6 parts |
| n-Propyl alcohol | 79.4 parts |

The image-forming layer coating solutions of Examples 3-1 to 3-11 and Reference Examples 3-1 to 3-6 were each applied to a PET base in an amount such that the thickness and OD were the same as obtained when applied to the light-to-heat conversion layer during the preparation of the various heat transfer sheets, transferred to the image-receiving layer by a heat transferring device, and then transferred to the paper (Tokubishi art paper; 128 g) with the image-receiving layer to prepare a specimen. The color hue (L1*a1*b1) of these specimens are used to calculate $\Delta E^1$ and $\Delta E^2$.

Preparation of Image-receiving Sheet

An image-receiving sheet was prepared in the same manner as in Example 1-1.

Formation of Transfer Image

A transfer image was formed in essentially the same manner as in Example 1-1. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Rotary speed of drum: 500 rpm

Subsidiary scanning pitch: 6.35 $\mu$m

Ambient temperature and humidity: 18° C./30%; 23° C./50%; 26° C./65%

The exposure drum has a diameter of preferably not smaller than 360 mm. In some detail, the exposure drum had a diameter of 380 mm.

The image size was 515 mm×728 mm. The resolution was 2,600 dpi.

The width of line image was 1.05 times the laser beam width, which is defined by a half of half-width (i.e., the half width at half maximum) of the distribution in the direction of subsidiary scanning of the integration of the binary energy distribution of laser beam spot in the direction of main scanning.

The laminate on which laser recording had been made was removed from the drum. The heat transfer sheet was then transferred to paper by means of a heat transferring device to prepare a sample to be compared in visual appreciation of color with target color hue sample under various light sources such as fluorescent lamp, incandescent lamp and sunshine. The results of evaluation were then ranked according to the following criterion.

G (good): No visual appreciation of color difference between target color hue sample and recorded sample under any light source F (fair): Some difference in visual appreciation between target sample and recorded sample under different light sources P (poor): Remarkable difference in visual appreciation under different light sources or remarkable difference from target color hue The results are set forth in the table below.

The Reference Examples 3-1 to 3-6 are an experimental example for examining an effect due to the width changed of ΔE when ΔE is the color difference between the color hue of the image-forming layer and the target color hue thereof.

| Cyan Example | $D_{65}^2$ | | | | $A^2$ | | | | | Difference in visual |
|---|---|---|---|---|---|---|---|---|---|---|
| No. | L* | a* | b* | $\Delta E^1$ | L* | a* | b* | $\Delta E^2$ | $\lvert\Delta E^1 - \Delta E^2\rvert$ | appreciation |
| Example 3-1 | 54.60 | −25.53 | −48.62 | 4.18 | 46.78 | −52.92 | −62.38 | 3.52 | 0.66 | G |
| Example 3-4 | 49.92 | −20.09 | −49.52 | 10.67 | 42.37 | −46.40 | −62.77 | 10.37 | 0.30 | G~F |
| Example 3-5 | 48.06 | −11.62 | −55.12 | 20.64 | 40.46 | −35.52 | −68.25 | 22.31 | 1.67 | F~P |
| Reference Example 3-1 | 45.05 | −2.75 | −57.60 | 30.18 | 37.95 | −32.05 | −69.20 | 26.51 | 3.67 | P |

-continued

| Cyan Example | $D_{65}^2$ | | | | $A^2$ | | | | | Difference in visual |
|---|---|---|---|---|---|---|---|---|---|---|
| No. | L* | a* | b* | $\Delta E^1$ | L* | a* | b* | $\Delta E^2$ | $\lvert\Delta E^1 - \Delta E^2\rvert$ | appreciation |
| Reference Example 3-2 | 34.40 | 14.54 | −54.17 | 48.64 | 29.73 | −12.40 | −60.03 | 45.96 | 2.68 | P |
| Target | 55.21 | −28.63 | −45.86 | — | 47.51 | −54.78 | −59.48 | — | — | — |

| Magenta Example | $D_{65}^2$ | | | | $A^2$ | | | | | Difference in visual |
|---|---|---|---|---|---|---|---|---|---|---|
| No. | L* | a* | b* | $\Delta E^1$ | L* | a* | b* | $\Delta E^2$ | $\lvert\Delta E^1 - \Delta E^2\rvert$ | appreciation |
| Example 3-2 | 44.23 | 73.23 | −9.17 | 2.10 | 52.13 | 68.88 | 7.12 | 2.02 | 0.08 | G |
| Example 3-6 | 44.69 | 74.51 | −8.64 | 2.00 | 52.72 | 69.59 | 7.89 | 1.63 | 0.37 | G |
| Example 3-7 | 46.36 | 72.87 | 6.96 | 14.17 | 54.92 | 68.78 | 24.12 | 15.24 | 1.07 | F |
| Example 3-8 | 46.52 | 73.67 | 3.58 | 10.86 | 55.00 | 69.34 | 21.24 | 12.24 | 1.38 | F |
| Reference Example 3-3 | 48.82 | 77.67 | −0.93 | 8.70 | 57.56 | 70.27 | 17.90 | 10.34 | 1.64 | F~P |
| Reference Example 3-4 | 46.90 | 72.87 | 8.73 | 16.00 | 55.50 | 68.73 | 26.68 | 17.86 | 1.86 | F~P |
| Target | 44.53 | 73.26 | −7.09 | — | 52.43 | 68.52 | 9.09 | — | — | — |

| Yellow Example | $D_{65}^2$ | | | | $A^2$ | | | | | Difference in visual |
|---|---|---|---|---|---|---|---|---|---|---|
| No. | L* | a* | b* | $\Delta E^1$ | L* | a* | b* | $\Delta E^2$ | $\lvert\Delta E^1 - \Delta E^2\rvert$ | appreciation |
| Example 3-3 | 86.94 | −12.15 | 93.89 | 3.11 | 88.19 | 2.03 | 86.67 | 2.12 | 0.99 | G |
| Example 3-9 | 87.06 | −10.85 | 89.14 | 2.86 | 89.14 | 2.01 | 85.57 | 1.40 | 1.46 | F |
| Example 3-10 | 87.68 | −13.20 | 90.99 | 1.33 | 89.60 | 0.59 | 86.34 | 2.08 | 0.75 | G |
| Example 3-11 | 87.50 | −13.90 | 95.27 | 4.57 | 89.44 | 0.87 | 87.38 | 2.80 | 1.77 | F |
| Reference Example 3-5 | 87.66 | −15.17 | 96.01 | 5.68 | 89.48 | 0.11 | 87.41 | 3.02 | 2.66 | F~P |
| Reference Example 3-6 | 88.19 | −15.06 | 96.67 | 6.37 | 90.00 | 0.09 | 88.23 | 3.94 | 2.43 | F~P |
| Target | 86.37 | −12.96 | 90.94 | — | 88.25 | 1.19 | 84.87 | — | — | — |

In the foregoing tables, L*, a* and b* in the column of examples represent the color hue (L1*a1*b1) of image-forming layer. L*, a* and b* in the column of target color hue (represented by "target") represent the color hue (L2*a2*b2*). $\Delta E^1$ represents the color difference $\{(L1^*-L2^*)^2+(a1^*-a2^*)^2+(b1^*-b2^*)^2\}^{0.5}$ measured under $D_{65}$ as a light source. $D_{65}^2$ represents measurement at a view angle of 2 degrees under $D_{65}$, which corresponds to daylight. $\Delta E^2$ represents the color difference $\{(L1^*-L2^*)^2+(a1^*-a2^*)^2+(b1^*-b2^*)^2\}^{0.5}$ measured under $A_{65}$ as a light source. $A^2$ represents measurement at a view angle of 2 degrees under A, which corresponds to incandescent lamp.

As can be seen in the foregoing tables, the examples of the present invention exhibit less difference in visual appreciation of color from the target color hue sample under various light sources such as fluorescent lamp, incandescent lamp and sunshine.

Example 4-1

Preparation of Heat Transfer Ssheet Y (Yellow)

1) Preparation of Light-to-heat Conversion Layer Coating Solution

A light-to-heat conversion layer coating solution was prepared in the same manner as in Example 1-1 except that the light-to-heat conversion layer comprised the following matting agent.

| Matting agent dispersion | |
|---|---|
| N-methyl-2-pyrrolidone (NMP) | 69 parts |
| Methyl ethyl ketone | 20 parts |
| Styrene acryl resin ("Johncryl 611", produced by Johnson Polymer Co., Ltd.) | 3 parts |
| Particulate $SiO_2$ ("Seahostar KEP150", particulate silica, produced by NIPPON SHOKUBAI CO., LTD.) | 8 parts |

2) Formation of Light-to-heat Conversion Layer on the Surface of Support

The foregoing light-to-heat conversion layer coating solution was applied to one surface of a polyethylene terephthalate film having a thickness of 75 μm (support) comprising the same back layer as in Example 1-1 by means of a wire bar. The coated material was then dried in a 120° C. oven for 2 minutes to form a light-to -heat conversion layer on the support. The light-to-heat conversion layer thus obtained had absorption at a wavelength of 808 nm. The light-to-heat conversion layer was then measured for absorbance (optical density: OD) by means of a Type UV-2400 ultraviolet spectrophotometer (produced by Shimadzu Corp.). As a result, the light-to-heat conversion layer exhibited OD of 0.9. For the measurement of the thickness of the light-to-heat conversion layer, a section of the light-to-heat conversion layer was observed under a scanning electron microscope. As a result, the light-to-heat conversion layer was confirmed to have a thickness of 0.3 μm on the average.

3) Preparation of Yellow Image-forming Layer Coating Solution

A yellow image-forming layer coating solution was prepared in the same manner as in Example 1-1.

4) Formation of Yellow Image-forming Layer on the Surface of Light-to-heat Conversion Layer A heat transfer sheet Y having a light-to-heat conversion layer and a yellow image-forming layer provided in this order on a support was prepared in the same manner as in Example 1-1.

Example 4-2

A heat transfer sheet Y was prepared in the same manner as in Example 4-1 except that the amount of the polyvinyl butyral ("Eslec B BL-SH", produced by SEKISUI CHEMICAL CO., LTD.) in the formulation of the yellow image-forming layer coating solution was changed from 4.6 parts to 17.0 parts.

Reference Example 4-1

A heat transfer sheet Y was prepared in the same manner as in Example 4-1 except that the amount of the polyvinyl butyral ("Eslec B BL-SH", produced by SEKISUI CHEMICAL CO., LTD.) in the formulation of the yellow image-forming layer coating solution was changed from 4.6 parts to 37.5 parts.

Example 4-3

Preparation of Heat Transfer Sheet M

A heat transfer sheet M was prepared in the same manner as in Example 1-1.

Example 4-4

A heat transfer sheet M was prepared in the same manner as in Example 4-3 except that the amount of the polyvinyl butyral ("Denkabutyral #2000-L", produced by DENKI KAGAKU KOGYO K.K.; Vicat softening point: 57° C.) in the formulation of the magenta image-forming layer coating solution was changed from 4.0 parts to 49.7 parts.

Reference Example 4-2

A heat transfer sheet M was prepared in the same manner as in Example 4-3 except that the amount of the polyvinyl butyral ("Denkabutyral #2000-L", produced by DENKI KAGAKU KOGYO K.K.; Vicat softening point: 57° C.) in the formulation of the magenta image-forming layer coating solution was changed from 4.0 parts to 80.0 parts.

Example 4-5

Preparation of Heat Transfer Sheet C

A heat transfer sheet C was prepared in the same manner as in Example 1-1.

Example 4-6

A heat transfer sheet C was prepared in the same manner as in Example 4-5 except that the formulation of cyan image-forming layer coating solution was changed to the following formulation.

| [Formulation of cyan image-forming layer coating solution] | |
|---|---|
| Mother liquor of cyan pigment dispersion described above | 118 parts |
| Formulation 1 of cyan pigment: Formulation 2 of cyan pigment = 90:10 (parts) | |
| Polyvinyl butyral ("Eslec B BL-SH", produced by SEKISUI CHEMICAL CO., LTD.) | 5.2 parts |
| Wax-based compound | |
| Neutron 2 (amide stearate, produced by (produced by Nippon Fine chemical Co., Ltd.) | 1.0 parts |
| Diamide BM (amide behenate, produced by Nippon Chemical Co., Ltd.) | 1.0 parts |
| Diamide Y (amide laurate, produced by Nippon Chemical Co., Ltd.) | 1.0 parts |
| Diamide KP (amide palmitate, produced by Nippon Chemical Co., Ltd.) | 1.0 parts |
| Diamide L-200 (amide erucate, produced by Nippon Chemical Co., Ltd.) | 1.0 parts |
| Diamide O-200 (amide oleate, produced by Nippon Chemical Co., Ltd.) | 1.0 parts |
| Rosin ("KE-311", produced by Arakawa Chemical Industries, Ltd.) | 2.8 parts |
| Pentaerythritol tetraacrylate ("NK Ester A-TMMT", produced by Shinnakamura Chemical Co., Ltd.) | 1.7 parts |
| Surface active agent ("Megafac F-176PF"; solid content: 20%, produced by DAINIPPON INK & CHEMICALS, INC.) | 1.7 parts |
| n-Propyl alcohol | 890 parts |
| Methyl ethyl ketone | 247 parts |

Example 4-7

A heat transfer sheet C was prepared in the same manner as in Example 4-5 except that the amount of the polyvinyl butyral ("Eslec B BL-SH", produced by SEKISUI CHEMICAL CO., LTD.) in the formulation of the cyan image-forming layer coating solution was changed from 5.2 parts to 22.0 parts.

Reference Example 4-3

A heat transfer sheet C was prepared in the same manner as in Example 4-5 except that the amount of the polyvinyl butyral ("Eslec B BL-SH", produced by SEKISUI CHEMICAL CO., LTD.) in the formulation of the cyan image-forming layer coating solution was changed from 5.2 parts to 37.0 parts.

Example 4-8

Preparation of Heat Transfer Sheet K

A heat transfer sheet K was prepared in the same manner as in Example 1-1.

Example 4-9

A heat transfer sheet K was prepared in the same manner as in Example 4-8 except that the amount of the polyvinyl butyral ("Eslec B BL-SH", produced by SEKISUI CHEMICAL CO., LTD.) in the formulation of the black image-forming layer coating solution was changed from 11.9 parts to 26.0 parts.

Reference Example 4-4

A heat transfer sheet K was prepared in the same manner as in Example 4-8 except that the amount of the polyvinyl butyral ("Eslec B BL-SH", produced by SEKISUI CHEMICAL CO., LTD.) in the formulation of the black image-forming layer coating solution was changed from 11.9 parts to 52.0 parts.

Preparation of Image-receiving Sheet

An image-receiving sheet was prepared in the same manner as in Example 1-1.

Formation of Transfer Image

A transfer image was formed in essentially the same manner as in Example 1-1. In some detail, while the drum was being rotated, the surface of the laminate on the drum was externally irradiated with a beam having a wavelength of 830 nm from a semiconductor laser in such a manner that the beam was converged onto the surface of the light-to-heat conversion layer in a spot having a diameter of 7 $\mu$m. The beam was moved in the direction (subsidiary canning) perpendicular to the direction of rotation of the rotary drum (main scanning direction). In this manner, laser image (line image) recording was made on the laminate. Laser image recording was made to form a solid image and an ordinary image for each of the various samples. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Main scanning speed: 6 m/sec

Subsidiary scanning pitch: 6.35 $\mu$m

Ambient temperature and humidity: 23° C./50%;

The exposure drum has a diameter of preferably not smaller than 360 mm. In some detail, the exposure drum had a diameter of 380 mm.

The width of line image was 1.03 times the laser beam width, which is defined by a half of half-width (i.e., the half width at half maximum) of the distribution in the direction of subsidiary scanning of the integration of the binary energy distribution of laser beam spot in the direction of main scanning.

The laminate on which laser recording had been made was removed from the drum. The heat transfer sheet was peeled off the image-receiving sheet by hand. The image on the image-receiving layer was then transferred to paper by the following heat transferring device.

The heat transferring device used had a dynamic friction coefficient of from 0.1 to 0.7 with respect to the material of the insertion table, i.e., polyethylene terephthalate and a conveying speed of from 15 to 50 mm/sec. The Vickers hardness of the material of the heat roll of the heat transferring device is preferably from 10 to 100. In some detail, the heat roll had a Vickers hardness of 70.

Measurement of Reflection Optical Density $OD_r$

The solid image which had been transferred to paper was measured according to the foregoing method. The ordinary image which had been transferred to paper was evaluated for quality according to the following criterion.

G (good): A good dot shape and line shape is obtained;

GF (good-fair): An almost good dot shape and line shape is obtained;

F (fair): Defective dot is seen in some area, but acceptable;

P (poor): Unacceptable

The results are set forth in the table below.

Reference Examples 4-1 to 4-4 are an experimental example for examining an effect of the value "X" in which the OD (Optical Density) of the reflection due to the blue filter of image-forming layer in the heat transfer sheet for yellow color, the OD (Optical Density) of the reflection due to the green filter of image-forming layer in the heat transfer sheet for magenta color, the OD (Optical Density) of the reflection due to the red filter of image-forming layer in the heat transfer sheet for cyan color, and the OD (Optical Density) of the reflection due to the visual filter of image-forming layer in the heat transfer sheet for black color, each is divided by the thickness of each the image-forming layers.

TABLE 7

| Example No. | Thickness of image-forming layer ($\mu$m) | Reflection optical density $OD_r$ of image-forming layer | $OD_r$/thickness | Image quality |
|---|---|---|---|---|
| Example 4-1 | 0.42 | 1.01 | 2.40 | G |
| Example 4-2 | 0.61 | 1.07 | 1.75 | F |
| Example 4-3 | 0.38 | 1.51 | 3.97 | G |
| Example 4-4 | 0.80 | 1.46 | 1.83 | F |
| Example 4-5 | 0.45 | 1.59 | 3.53 | G |
| Example 4-6 | 0.44 | 1.35 | 3.07 | G |
| Example 4-7 | 0.70 | 1.53 | 2.19 | F |
| Example 4-8 | 0.60 | 1.82 | 3.03 | GF |
| Example 4-9 | 0.80 | 1.76 | 2.20 | F |
| Reference Example 4-1 | 0.84 | 1.01 | 1.20 | P |
| Reference Example 4-2 | 1.06 | 1.50 | 1.41 | P |
| Reference Example 4-3 | 0.87 | 1.57 | 1.81 | P |
| Reference Example 4-4 | 1.00 | 1.80 | 1.80 | P |

As can be seen in the foregoing table, the examples of the present invention, X ($OD_r$/thickness) of which falls within the range defined herein, exhibit a good image quality as compared with the reference examples.

Example 5-1

Preparation of Heat Transfer Sheet K (Black)

A heat transfer sheet K was prepared in the same manner as in Example 1-1 except that the 2nd back layer coating solution was prepared according to the following formulation.

| [2nd back layer coating solution] | |
|---|---|
| Polyolefin (Chemipearl S-120; 27% by mass, produced by Mitsui Petrochemical Industries, Ltd.) | 3.0 parts |
| Antistatic agent (aqueous dispersion of tin 2.0 parts oxide-antimony oxide) (average particle diameter: 0.1 μm; 17% by mass) | |
| Colloidal silica (Snowtex C; 20% by mass; produced by Nissan Chemical Industries, Ltd.) | 2.0 parts |
| Epoxy compound (Dinacoal EX-614B, produced by Nagase Kasei Co., Ltd.) | 0.3 parts |
| Sodium polystyrene sulfonate | 0.1 parts |
| Distilled water to make | 100 parts |

Preparation of Heat Transfer Sheet Y

A heat transfer sheet Y was prepared in the same manner as in Example 1-1.

Preparation of Heat Transfer Sheet M

A heat transfer sheet M was prepared in the same manner as in Example 1-1.

Preparation of Heat Transfer Sheet C

A heat transfer sheet C was prepared in the same manner as in Example 1-1.

Preparation of Image-receiving Sheet

An image-receiving sheet was prepared in the same manner as in Example 1-1.

Formation of Transfer Image

As an image-forming system there was used one shown in FIG. 4 having as a recording device Luxel FINALPROOF 5600. Using the image forming sequence of the system and the transferring process of the system, an image was transferred to paper.

The image-receiving sheet (567 cm×79 cm) prepared as described above was wound on a rotary drum having a diameter of 38 cm having vacuum section holes having a diameter of 1 mm formed therein (face density of 1 hole per area of 3 cm×8 cm) so that it was vacuum-sucked thereby. Subsequently, the foregoing heat transfer sheet K (black) which had been cut into an area of 61 cm×84 cm was superimposed on the foregoing image-receiving sheet in such an arrangement that it protruded uniformly from the image-receiving sheet. While being squeezed by a squeeze roller, the two sheets were adhered to and laminated with each other by air suction through the section holes. The vacuum degree developed when the section holes are blocked was −150 mmHg (approximately equal to 81.13 kPa) with respect to 1 atm. While the drum was being rotated, the surface of the laminate on the drum was externally irradiated with a beam having a wavelength of 808 nm from a semiconductor laser in such a manner that the beam was converged onto the surface of the light-to-heat conversion layer in a spot having a diameter of 7 μm. The beam was moved in the direction (subsidiary canning) perpendicular to the direction of rotation of the rotary drum (main scanning direction). In this manner, laser image (line image) recording was made on the laminate. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Rotary speed of drum: 500 rpm

Subsidiary scanning pitch: 6.35 μm

Ambient temperature and humidity: 18° C./30% (20° C./40% if FIG. 15 is used); 23° C./50%; 26° C./65%

The exposure drum has a diameter of preferably not smaller than 360 mm. In some detail, the exposure drum had a diameter of 380 mm.

The image size was 515 mm×728 mm. The resolution was 2,600 dpi.

The width of line image was 1.03 times the laser beam width, which is defined by half-width of the distribution in the direction of subsidiary scanning of the integration of the binary energy distribution of laser beam spot in the direction of main scanning.

The laminate on which laser recording had been made was removed from the drum. The heat transfer sheet K was peeled off the image-receiving sheet by hand. As a result, it was confirmed that only the light-irradiated area on the image-forming layer of the heat transfer sheet K had been transferred from the heat transfer sheet K to the image-receiving sheet.

An image was transferred from the various heat transfer sheets, i.e., heat transfer sheet Y, heat transfer sheet M and heat transfer sheet C to the image-receiving sheet in the same manner as described above. The four color images thus transferred were each then transferred to the recording paper to form a multi-color image. As a result, even when laser recording was effected with a laser beam comprising a binary multi-beam arrangement at a high energy under different temperature and humidity conditions, a multi-color image having a high quality and a stable transfer density was formed.

In order to transfer the image to paper, a heat transferring device having a dynamic friction coefficient of from 0.1 to 0.7 with respect to the material of the insertion table, i.e., polyethylene terephthalate and a conveying speed of from 15 to 50 mm/sec was used. The Vickers hardness of the material of the heat roll of the heat transferring device is preferably from 10 to 100. In some detail, the heat roll had a Vickers hardness of 70.

The image thus obtained exhibited good properties under all the three ambient temperature and humidity conditions.

For the evaluation of the optical density of the image-forming layer of the various heat transfer sheets, the image transferred to Tokubishi art paper was measured for optical density of Y, M, C and K with Y mode, M mode, C mode and K mode, respectively, using a Type X-rite 938 densitometer (produced by X-rite Inc.).

The optical density and the ratio of optical density to thickness of image-forming layer (μm) of the various colors are set forth in Table 8 below.

TABLE 8

| Color | Optical density | Optical density/thickness of image-forming layer |
|---|---|---|
| Y | 1.01 | 2.40 |
| M | 1.51 | 3.97 |
| C | 1.59 | 3.03 |
| K | 1.82 | 3.03 |

The reference example is an experimental example for examining an effect of high molecular pigment dispersant and phosphoric acid ester-based pigment dispersant.

A multi-color image was obtained in the same manner as in Example 5-1 except that the K, Y, M and C image-forming layers were free of high molecular pigment dispersant and phosphoric acid ester-based pigment dispersant.

TABLE 9

| | Constitution Pigment dispersant | Evaluation: Coincidence with desired printed matter in color hue | Evaluation: Resolving power | Evaluation: Stability of coating solution |
|---|---|---|---|---|
| Example 5-1 | Solsperse 20000, PW36 | G | G | G |
| Reference Example 5-1 | Disparlon #1210 | F~P | F~P | F~P |

The images obtained according to the foregoing system were evaluated as follows.

For the evaluation of coincidence with the desired printed matter in color hue, the multi-color image thus obtained was compared with Japan Color Version 2, which is a standard color sample for the printed matter, visually and by a Type X-RITE938 calorimeter (produced by X-rite Inc.). The measurements were then comprehensively evaluated.

G (good): Substantial coincidence in color hue both visually and by colorimeter

F (fair): Some deviation of color hue

P (poor): Remarkable deviation of color hue

For the evaluation of resolving power, the provision of fine lines and sharpness of dots in the image thus obtained were observed and organoleptically evaluated.

G (good): Sharply-shaped dots are formed over a range of from highlighted area to shadow. No extra bur and other defectives are observed in edge.

F (fair): Although dots are reproduced over a range of from highlighted area to shadow, the dots don't reproduce faithfully the shape of the original image data and have bur and lack.

P (poor): The highlighted area or shadow has no dots or deformed dots. The dots have many burs or lacks.

For the evaluation of the stability of coating solution, the image-forming layer coating solution was allowed to stand for 1 week. The coating solution was then observed for how the supernatant liquid or precipitates are formed.

G (good): Little or no supernatant liquid or precipitates are observed even after 1 week F (fair): Some supernatant liquid or precipitates are observed P (poor): Remarkable supernatant liquid or precipitates are observed Example 6-1

*Preparation of Heat Transfer Sheet

Preparation of Heat Transfer Sheet K

The same 1st back layer coating solution as used in Example 1-1 was applied to one surface of the same polyethylene terephthalate film support (Ra on both sides: 0.01 μm) having a thickness of 75 μm and a width of 65 cm as used in Example 1-1 by means of a wire bar. The coated material was dried in a 100° C. oven for 2 minutes to form a 1st back layer on the support to a thickness of 0.04 μm.

The same 2nd back layer coating solution as used in Example 1-1 but free of antistatic agent was applied to the 1st back layer by means of a wire bar. The coated material was then dried in a 100° C. oven for 2 minutes to form a 2nd back layer on the 1st back layer to a thickness of 0.03 μm.

1) Preparation of Light-to-heat Conversion Layer Coating Solution

The same components as used in Example 1-1 were mixed with stirring by a stirrer to prepare a light-to-heat conversion layer coating solution in the same manner as in Example 1-1 except that the formulation of the matting agent was changed to the following formulation.

| Matting agent dispersion | |
|---|---|
| N-methyl-2-pyrrolidone (NMP) | 69 parts |
| Methyl ethyl ketone | 20 parts |
| Styrene acryl resin ("Johncryl 611", produced by Johnson Polymer Co., Ltd.) | 3 parts |
| Particulate $SiO_2$ ("Seahostar KEP150", particulate silica, produced by NIPPON SHOKUBAI CO., LTD.) | 8 parts |

2) Formation of Light-to-heat Conversion Layer on the Surface of Support

The foregoing light-to-heat conversion layer coating solution was applied to one surface of a polyethylene terephthalate film having a thickness of 75 μm (support) by means of a wire bar. The coated material was then dried in a 120° C. oven for 2 minutes to form a light-to-heat conversion layer on the support. The light-to-heat conversion layer thus obtained had absorption at a wavelength of 808 nm. The light-to-heat conversion layer was then measured for absorbance (optical density: OD) by means of a Type UV-2400 ultraviolet spectrophotometer (produced by Shimadzu Corp.). As a result, the light-to-heat conversion layer exhibited OD of 0.9. For the measurement of the thickness of the light-to-heat conversion layer, a section of the light-to-heat conversion layer was observed under a scanning electron microscope. As a result, the light-to-heat conversion layer was confirmed to have a thickness of 0.3 μm on the average.

3) Preparation of Black Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill until the average particle diameter of carbon black and the coefficient of variation of particle diameter reached 202 nm and 35.5%, respectively, to obtain a mother liquor of black pigment dispersion (1).

| [Formulation of mother liquor of black pigment dispersion (1)] | |
|---|---|
| Polyvinyl butyral ("Eslec B BL-SH", produced by SEKISUI CHEMICAL CO., LTD.) | 12.6 parts |
| Pigment Black 7 (Carbon Black C. I. No. 77266) ("Mitsubishi Carbon Black MA100", PVC blackness: 10, produced by Mitsubishi Chemical Corporation) | 10.5 parts |
| Dispersing aid dispersant) ("Solsperse S-20000", produced by ICI Co., Ltd.) | 0.8 parts |
| n-Propyl alcohol | 79.4 parts |

A black image-forming layer coating solution was prepared in the same manner as in the formulation of black image-forming layer coating solution of Example 1-1 except that the foregoing mother liquor of black pigment dispersion (1) was used. The black image-forming layer coating solution thus prepared was applied to the surface of the light-to-heat conversion layer by means of a wire bar in the same manner as in Example 1-1. The coated material was then dried in a 100° C. for 2 minutes to form a black image-forming layer on the light-to-heat conversion layer. The thickness of the black image-forming layer thus formed was then measured. As a result, it was 0.60 μm on the average.

Example 6-2

A heat transfer sheet K was prepared in the same manner as in Example 6-1 except that as the black image-forming layer coating solution there was used the following coating solution.

Preparation of Black Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill until the average particle diameter of carbon black and the coefficient of variation of particle diameter reached 289 nm and 24.4%, respectively, to obtain a mother liquor of black pigment dispersion (2).

| [Formulation of mother liquor of black pigment dispersion (2)] | |
|---|---|
| Polyvinyl butyral ("Eslec B BL-SH", produced by SEKISUI CHEMICAL CO., LTD.) | 12.6 parts |
| Pigment Black 7 (Carbon Black C. I. No. 77266) ("Mitsubishi Carbon Black #5", PVC blackness: 1, produced by Mitsubishi Chemical Corporation) | 4.5 parts |
| Dispersing aid dispersant) ("Solsperse S-20000", produced by ICI Co., Ltd.) | 0.8 parts |
| n-Propyl alcohol | 79.4 parts |

A black image-forming layer coating solution was prepared in the same manner as in the formulation of black image-forming layer coating solution of Example 1-1 except that the foregoing mother liquor of black pigment dispersion (2) was used. A heat transfer sheet K was then prepared in the same manner as in Example 1-1.

Example 6-3

A heat transfer sheet was prepared in the same manner as in Example 6-1 except that the mother liquor of black pigment dispersion (1) for the black image-forming layer coating solution was replaced by the following mother liquor of black pigment dispersion.

| | |
|---|---|
| Mother liquor of black pigment dispersion (30:70 (parts) mixture of mother liquor of black pigment dispersion (1) of Example 6-1 and mother liquor of black pigment dispersion (2) of Example 6-2) | 185.7 parts |

Example 6-4

Preparation of Heat Transfer Sheet Y

A heat transfer sheet Y was prepared in the same manner as in the foregoing preparation of heat transfer sheet K except that the black image-forming layer coating solution was replaced by the following yellow image-forming layer coating solution. The heat transfer sheet Y thus obtained comprised an image-forming layer having a thickness of 0.42 μm.

In some detail, the following components were subjected to sand mill dispersion in the same manner as in Example 6-1 until the average particle diameter of yellow pigment and the coefficient of variation of particle diameter reached 392 μm and 28.5%, respectively, to obtain a mother liquor of yellow pigment dispersion (1).

| [Formulation of mother liquor of yellow pigment dispersion (1)] | |
|---|---|
| Polyvinyl butyral ("Eslec B BL-SH", produced by SEKISUI CHEMICAL CO., LTD.) | 7.1 parts |
| Pigment Yellow 180 (C. I. No. 21290) ("Novoperm Yellow P-HG", Clariant Japan Co., Ltd.) | 12.9 parts |
| Dispersing aid ("Solsperse S-20000", produced by ICI Co., Ltd.) | 0.6 parts |
| n-Propyl alcohol | 79.4 parts |

A yellow image-forming layer coating solution was prepared in the same manner as in the formulation of yellow image-forming layer coating solution of Example 1-1 except that the foregoing mother liquor of yellow pigment dispersion (1) was used. A heat transfer sheet Y was then prepared in the same manner as in Example 1-1.

Example 6-5

A heat transfer sheet y was prepared in the same manner as in Example 6-4 except that as the yellow image-forming layer coating solution there was used the following coating solution.

Preparation of Yellow Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill until the average particle diameter of yellow pigment and the coefficient of variation of particle diameter reached 631 nm and 35.0%, respectively, to obtain a mother liquor of yellow pigment dispersion (2).

| [Formulation of mother liquor of yellow pigment dispersion (2)] | |
|---|---|
| Polyvinyl butyral ("Eslec B BL-SH", produced by SEKISUI CHEMICAL CO., LTD.) | 7.1 parts |
| Pigment Yellow 139 (C.I. No. 56298) ("Novoperm Yellow M2R 70", Clariant Japan Co., Ltd.) | 12.9 parts |
| Dispersing aid ("Solsperse S-20000", produced by ICI Co., Ltd.) | 0.6 parts |
| n-Propyl alcohol | 79.4 parts |

A yellow image-forming layer coating solution was prepared in the same manner as in the formulation of yellow image-forming layer coating solution of Example 1-1 except that the foregoing mother liquor of yellow pigment dispersion (2) was used. A heat transfer sheet Y was then prepared in the same manner as in Example 1-1.

Example 6-6

A heat transfer sheet was prepared in the same manner as in Example 6-4 except that the mother liquor of yellow pigment dispersion (1) for the yellow image-forming layer coating solution was replaced by the following mother liquor of yellow pigment dispersion.

| | |
|---|---|
| Mother liquor of yellow pigment dispersion (95:5 (parts) mixture of mother liquor of yellow pigment dispersion (1) of Example 6-4 and mother liquor of yellow pigment dispersion (2) of Example 6-5) | 126 parts |

Example 6-7

Preparation of Heat Transfer Sheet M

A heat transfer sheet M was prepared in the same manner as in the foregoing preparation of heat transfer sheet K except that the black image-forming layer coating solution was replaced by the following magenta image-forming layer coating solution. The heat transfer sheet M thus obtained comprised an image-forming layer having a thickness of 0.38 μm.

In some detail, the following components were subjected to sand mill dispersion in the same manner as in Example 6-1 until the average particle diameter of magenta pigment and the coefficient of variation of particle diameter reached 368 μm and 32.4%, respectively, to obtain a mother liquor of magenta pigment dispersion (1).

| [Formulation of mother liquor of magenta pigment dispersion (1)] | |
|---|---|
| Polyvinyl butyral ("Denkabutyral #2000-L, produced by DENKI KAGAKU KOGYO K.K.; Vicat softening point: 57° C.) | 12.6 parts |
| Pigment Red 57:1 (C.I. No. 15850:1) ("Symuler Brilliant Carmine 6B-229", produced by DAINIPPON INK & CHEMICALS, INC.) | 15.0 parts |
| Dispersing aid ("Solsperse S-20000", produced by ICI Co., Ltd.) | 0.6 parts |
| n-Propyl alcohol | 80.4 parts |

A magenta image-forming layer coating solution was prepared in the same manner as in the formulation of magenta image-forming layer coating solution of Example 1-1 except that the foregoing mother liquor of magenta pigment dispersion (1) was used. A heat transfer sheet M was then prepared in the same manner as in Example 1-1.

Example 6-8

A heat transfer sheet M was prepared in the same manner as in Example 6-7 except that as the magenta image-forming layer coating solution there was used the following coating solution.

Preparation of Magenta Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill until the average particle diameter of magenta pigment and the coefficient of variation of particle diameter reached 258 nm and 37.0%, respectively, to obtain a mother liquor of magenta pigment dispersion (2).

| [Formulation of mother liquor of magenta pigment dispersion (2)] | |
|---|---|
| Polyvinyl butyral ("Denkabutyral #2000-L, produced by DENKI KAGAKU KOGYO K. K.; Vicat softening point: 57° C.) | 12.6 parts |
| Pigment Red 57:1 (C.I. No. 15850:1) ("Lionel Red 6B-4290F", produced by TOYO INK MFG. CO., LTD.) | 15.0 parts |
| Dispersing aid ("Solsperse S-20000", produced by ICI Co., Ltd.) | 0.6 parts |
| n-Propyl alcohol | 79.4 parts |

A magenta image-forming layer coating solution was prepared in the same manner as in the formulation of magenta image-forming layer coating solution of Example 1-1 except that the foregoing mother liquor of magenta pigment dispersion (2) was used. A heat transfer sheet M was then prepared in the same manner as in Example 1-1.

Example 6-9

A heat transfer sheet was prepared in the same manner as in Example 6-7 except that the mother liquor of magenta pigment dispersion for the magenta image-forming layer coating solution was replaced by the following mother liquor of magenta pigment dispersion.

| | |
|---|---|
| Mother liquor of magenta pigment dispersion (95:5 (parts) mixture of mother liquor of magenta pigment dispersion (1) of Example 6-7 and mother liquor of magenta pigment dispersion (2) of Example 6-8) | 163 parts |

Example 6-10

Preparation of Heat Transfer Sheet C

A heat transfer sheet C was prepared in the same manner as in the foregoing preparation of heat transfer sheet K except that the black image-forming layer coating solution was replaced by the following cyan image-forming layer coating solution. The heat transfer sheet C thus obtained comprised an image-forming layer having a thickness of 0.45 μm.

In some detail, the following components were subjected to sand mill dispersion in the same manner as in Example 6-1 until the average particle diameter of cyan pigment and the coefficient of variation of particle diameter reached 183 μm and 36.3%, respectively, to obtain a mother liquor of cyan pigment dispersion (1).

| [Formulation of mother liquor of cyan pigment dispersion (1)] | |
|---|---|
| Polyvinyl butyral ("Eslec B BL-SH", produced by SEKISUI CHEMICAL CO., LTD.) | 12.6 parts |
| Pigment Blue 15:4 (C.I. No. 74160) ("Cyanine Blue 700-10FG", produced by TOYO INK MFG. Co., Ltd.) | 15.0 parts |
| Dispersing aid ("PW-36", phosphoric acid ester-based surface active agent, produced Kusumoto Chemicals Co., Ltd.) | 0.8 parts |
| n-Propyl alcohol | 110 parts |

A cyan image-forming layer coating solution was prepared in the same manner as in the formulation of cyan image-forming layer coating solution of Example 1-1 except that the foregoing mother liquor of cyan pigment dispersion (1) was used. A heat transfer sheet C was then prepared in the same manner as in Example 1-1.

Example 6-11

A heat transfer sheet C was prepared in the same manner as in Example 6-10 except that the cyan image-forming layer coating solution was replaced by the following cyan layer-forming layer coating solution.

Preparation of Cyan Image-forming Layer Coating Solution

The following components were put in the mill of a kneader where they were then subjected to pretreatment for dispersion while being given a shearing force with a small amount of a solvent being added thereto. To the dispersion thus obtained was then added the solvent until the following formulation was finally obtained. The dispersion was then subjected to dispersion in a sand mill until the average particle diameter of cyan pigment and the coefficient of variation of particle diameter reached 258 nm and 41.3%, respectively, to obtain a mother liquor of cyan pigment dispersion (2).

| [Formulation of mother liquor of cyan pigment dispersion (2)] | |
|---|---|
| Polyvinyl butyral ("Eslec B BL-SH", produced by SEKISUI CHEMICAL CO., LTD.) | 12.6 parts |
| Pigment Blue 15 (C.I. No. 74160) ("Lionel Blue 7027)", produced by TOYO INK MFG. Co., LTD.) | 15.0 parts |
| Dispersing aid ("PW-36", phosphoric acid ester-based surface active agent, produced Kusumoto Chemicals Co., Ltd.) | 0.8 parts |
| n-Propyl alcohol | 110 parts |

A cyan image-forming layer coating solution was prepared in the same manner as in the formulation of cyan image-forming layer coating solution of Example 1-1 except that the foregoing mother liquor of cyan pigment dispersion (2) was used. A heat transfer sheet C was then prepared in the same manner as in Example 1-1.

Example 6-12

A heat transfer sheet was prepared in the same manner as in Example 6-10 except that the mother liquor of cyan pigment dispersion for the cyan image-forming layer coating solution was replaced by the following mother liquor of cyan pigment dispersion.

| | |
|---|---|
| Mother liquor of cyan pigment dispersion (90:10 (parts) mixture of mother liquor of cyan pigment dispersion (1) of Example 6-10 and mother liquor of cyan pigment dispersion (2) of Example 6-11) | 118 parts |

Reference Example 6-1

The same components as in the formulation of mother liquor of magenta pigment dispersion of Example 6-7 were subjected to sand mill dispersion until the average particle diameter of magenta pigment and the coefficient of variation of particle diameter reached 525 nm and 52.0%, respectively, to obtain a mother liquor of magenta pigment dispersion (3).

Subsequently, a heat transfer sheet was prepared in the same manner as in Example 6-7 except that the mother liquor of magenta pigment dispersion (1) for the magenta image-forming layer coating solution was replaced by the foregoing mother liquor of magenta pigment dispersion (3).

Reference Example 6-2

A heat transfer sheet was prepared in the same manner as in Example 6-9 except that the mother liquor of magenta pigment dispersion for the magenta image-forming layer coating solution was replaced by the following mother liquor of magenta pigment dispersion.

| | |
|---|---|
| Mother liquor of magenta pigment dispersion (95:5 (parts) mixture of mother liquor of magenta pigment dispersion (3) of Example 6-1 and mother liquor of magenta pigment dispersion (2) of Example 6-8) | 163 parts |

Reference Example 6-3

The same components as in the formulation of mother liquor of cyan pigment dispersion of Example 6-10 were subjected to sand mill dispersion until the average particle diameter of cyan pigment and the coefficient of variation of particle diameter reached 425 nm and 55.0%, respectively, to obtain a mother liquor of cyan pigment dispersion (3).

Subsequently, a heat transfer sheet was prepared in the same manner as in Example 6-10 except that the mother liquor of cyan pigment dispersion (1) for the cyan image-forming layer coating solution was replaced by the foregoing mother liquor of cyan pigment dispersion (3).

Reference Example 6-4

A heat transfer sheet was prepared in the same manner as in Example 6-12 except that the mother liquor of cyan pigment dispersion for the cyan image-forming layer coating solution was replaced by the following mother liquor of cyan pigment dispersion.

| | |
|---|---|
| Mother liquor of cyan pigment dispersion (90:10 (parts) mixture of mother liquor of cyan pigment dispersion (3) of Example 6-3 and mother liquor of cyan pigment dispersion (2) of Example 6-11) | 118 parts |

Preparation of Image-receiving Sheet

An image-receiving sheet was prepared in the same manner as in Example 1-1.

The foregoing heat transfer sheets were each evaluated for properties. The results are set forth in Table 10 below.

Properties of Heat Transfer Sheet

Formation of Transfer Image

A transfer image was formed in essentially the same manner as in Example 1-1. In some detail, while the drum was being rotated, the surface of the laminate on the drum was externally irradiated with a beam having a wavelength of 830 nm from a semiconductor laser in such a manner that the beam was converged onto the surface of the light-to-heat conversion layer in a spot having a diameter of 7 $\mu$m. The beam was moved in the direction (subsidiary canning) perpendicular to the direction of rotation of the rotary drum (main scanning direction). In this manner, laser image (line image) recording was made on the laminate. The laser irradiation conditions will be described below. As the laser beam there was used one formed by a binary multi-beam arrangement made of a parallelogram comprising five lines in the main scanning direction and three rows in the subsidiary scanning direction.

Laser power: 110 mW

Main scanning speed: 6 m/sec

Subsidiary scanning pitch: 6.35 $\mu$m

Ambient temperature and humidity: 18° C./30%; 23° C./50%; 26° C./65%

The laminate on which laser recording had been made was removed from the drum. The heat transfer sheet K was peeled off the image-receiving sheet by hand. As a result, it was confirmed that only the light-irradiated area on the image-forming layer of the heat transfer sheet K had been transferred from the heat transfer sheet K to the image-receiving sheet.

The exposure drum has a diameter of preferably not smaller than 360 mm. In some detail, the exposure drum had a diameter of 380 mm.

The width of line image was 1.04 times the laser beam width, which is defined by a half of half-width (i.e., the half width at half maximum) of the distribution in the direction of subsidiary scanning of the integration of the binary energy distribution of laser beam spot in the direction of main scanning.

An image was transferred from the heat transfer sheet K of Example 6-2, the various heat transfer sheets, i.e., heat transfer sheet Y, heat transfer sheet M and heat transfer sheet C of Examples 6-3 to 6-12 and the various heat transfer sheets of Reference Examples 6-1 to 6-4 to the image-receiving sheet in the same manner as described above.

The images thus transferred were each then transferred to the recording paper. These transfer images were each measured for resolution visually under a microscope, and then evaluated according to the following criterion.

G (good): Dots are clearly and uniformly recorded;

P (poor): Dots are observed to have lacks or separation

In order to transfer the image to paper, a heat transferring device having a dynamic friction coefficient of from 0.1 to 0.7 with respect to the material of the insertion table, i.e., polyethylene terephthalate and a conveying speed of from 15 to 50 mm/sec was used. The Vickers hardness of the material of the heat roll of the heat transferring device is preferably from 10 to 100. In some detail, the heat roll had a Vickers hardness of 70.

The reference examples are an experimental example for examining an effect due to the dispersion degree and the variation coefficient of particle diameter, of the colorant of the image-forming layer.

TABLE 10

| | Pigment | | | |
|---|---|---|---|---|
| Example No. | Kind | Average particle diameter (nm) | Variation coefficient (%) | Resolution |
| Example 6-1 | Black 1 | 202 | 35.5 | G |
| Example 6-2 | Black 2 | 289 | 24.4 | G |
| Example 6-3 | Black 1 | 202 | 35.5 | G |
| | Black 2 | 289 | 24.4 | |
| Example 6-4 | Yellow 1 | 392 | 28.5 | G |
| Example 6-5 | Yellow 2 | 631 | 35.0 | G |
| Example 6-6 | Yellow 1 | 392 | 28.5 | G |
| | Yellow 2 | 631 | 35.0 | |
| Example 6-7 | Magenta 1 | 368 | 32.4 | G |
| Example 6-8 | Magenta 2 | 258 | 37.0 | G |
| Example 6-9 | Magenta 1 | 368 | 32.4 | G |
| | Magenta 2 | 258 | 37.0 | |
| Example 6-10 | Cyan 1 | 183 | 36.3 | G |
| Example 6-11 | Cyan 2 | 258 | 41.3 | G |
| Example 6-12 | Cyan 1 | 183 | 36.3 | G |
| | Cyan 2 | 258 | 41.3 | |
| Reference Example 6-1 | Magenta 3 | 525 | 52.0 | P |
| Reference Example 6-2 | Magenta 3 | 525 | 52.0 | P |
| | Magenta 2 | 258 | 37.0 | |
| Reference Example 6-3 | Cyan 3 | 425 | 55.0 | P |
| Reference Example 6-4 | Cyan 3 | 425 | 55.0 | P |
| | Cyan 2 | 258 | 41.3 | |

As can be seen in the foregoing table, the heat transfer sheets comprising the monodisperse organic pigment and/or carbon black of the present invention exhibit an excellent resolution as compared with the reference examples comprising pigments other than those of the present invention.

The proof product developed in the present invention can give solution to new problems in the laser heat transfer system on the basis of a thin film transfer technique and realize a sharp halftone by a thin film heat transfer process involving the various techniques to provide a higher image quality. It was thus made possible to develop a laser heat transfer recording system for DDCP comprising an image-forming material having a size of B2 of the type allowing transfer to printing paper, output of actual halftone and use of pigment, an outputting machine and a high quality CMS soft ware. Accordingly, the present invention realized a system arrangement that allows a high resolving material to accomplish its performance sufficiently. In some detail, a contract proof which substitutes for proof sheet or analog color proof can be provided to meet the CTP age's requirement for filmless system. This proof can realize a color reproducibility providing a good coincidence with printed matter or analog color proof for approval by customers. A DDCP system which allows the use of the same pigment-based colorant as used in printing ink and transfer to printing paper without having Moire pattern can be provided. The present invention also can provide a digital direct color proof system having a size as large as not smaller than A2/B2 which allows the transfer to printing paper and use of the same pigment-based colorant as used in printing ink and provides a high approximation to desired printed matter. The present invention provides a system which allows the transfer to printing paper by recording actual halftone with a pigment colorant using a laser thin heat transfer process. The present invention can provide a multi-color image-forming process which can form an image having a good quality and a stable transfer density on an image-receiving sheet even when laser recording is effected with a multiple laser beam in a binary arrangement having a high energy under different temperature and humidity conditions.

The entitle disclosure of each and every foreign patent application from which the benefit of foreign priority has been claimed in the present application is incorporated herein by reference, as if fully set forth herein.

While the present invention has been described in detail and with reference to specific embodiments thereof, it will be apparent to one skilled in the art that various changes and modifications can be made therein without departing from the spirit and scope thereof.

What is claimed is:

1. A multi-color image-forming material comprising image-receiving sheets each having an image-receiving layer and heat transfer sheets for at least four colors, including yellow, magenta, cyan and black, each having at least a light-to-heat conversion layer and an image-forming layer on a support, said heat transfer sheets and said image-receiving sheets being respectively laminated such that the image-forming layer of said heat transfer sheet and the image-receiving layer of said image-receiving sheet are opposed to each other, whereby the irradiation with laser beam causes the area irradiated with laser beam on the image-forming layer to be transferred onto the image-forming layer in the image-receiving sheet to effect image recording, wherein the thickness of the image-forming layer in said heat transfer sheets is from 0.01 $\mu$m to 1.5 $\mu$m and the width of lines in laser-transferred image is from 0.8 to 2.0 times a half of the half-width (the half width at half maximum) of the distribution in the direction of subsidiary scanning of the integration of the binary energy distribution of laser beam spot in the direction of main scanning.

2. The multi-color image-forming material comprising image-receiving sheets each having an image-receiving layer and heat transfer sheets for at least four colors, including yellow, magenta, cyan and black, each having at least a light-to-heat conversion layer and an image-forming layer on a support, said heat transfer sheets and said image-receiving sheets being respectively laminated such that the image-forming layer of said heat transfer sheet and the image-receiving layer of said image-receiving sheet are opposed to each other, whereby the irradiation with laser beam causes the area irradiated with laser beam on the image-forming layer to be transferred onto the image-forming layer in the image-receiving sheet to effect image recording, wherein said heat transfer sheets are a yellow heat transfer sheet the maximum absorbance ($\lambda$max) of which in spectral distribution falls within a range of from 380 nm to 460 nm, a magenta heat transfer sheet the maximum absorbance ($\lambda$max) of which in spectral distribution falls within a range of from 540 nm to 600 nm, a cyan heat transfer sheet the maximum absorbance ($\lambda$max) of which in spectral distribution falls within a range of from 610 nm to 730 nm and a black heat transfer sheet.

3. The multi-color image-forming material as in claim 2, wherein the half-width measured when the maximum absorbance ($\lambda$max) is 1.0 is from 90 nm to 160 nm for said yellow heat transfer sheet, from 40 nm to 130 nm for said magenta heat transfer sheet and from 90 nm to 160 nm for said cyan heat transfer sheet.

4. The multi-color image-forming material as in claim 1, wherein the change of $\Delta E$ measured with $D_{65}$ or A as a light source is not greater than 2.0 for said cyan heat transfer sheet supposing that $\Delta E$ is the color difference between the color hue (L1*a1*b1) and the desired color hue (L2*a2*b2*) of said image-forming layer represented by the following equation:

$$\Delta E=\{(L1^*-L2^*)^2+(a1^*-a2^*)^2+(b1^*-b2^*)^2\}^{0.5}.$$

5. The multi-color image-forming material as in claim 4, wherein $\Delta E$ of said cyan heat transfer sheet is not greater than 15.0.

6. The multi-color image-forming material as in claim 1, wherein the change width of $\Delta E$ measured with $D_{65}$ or A as a light source is not greater than 1.5 for said magenta heat transfer sheet supposing that $\Delta E$ is the color difference between the color hue (L1*a1*b1) and the desired color hue (L2*a2*b2*) of said image-forming layer represented by the following equation:

$$\Delta E=\{(L1^*-L2^*)^2+(a1^*-a2^*)^2+(b1^*-b2^*)^2\}^{0.5}.$$

7. The multi-color image-forming material as in claim 6, wherein $\Delta E$ of said magenta heat transfer sheet is not greater than 16.0.

8. The multi-color image-forming material as in claim 1, wherein the change width of $\Delta E$ measured with $D_{65}$ or A as a light source is not greater than 2.0 for said yellow heat transfer sheet supposing that $\Delta E$ is the color difference between the color hue (L1*a1*b1) and the desired color hue (L2*a2*b2*) of said image-forming layer represented by the following equation:

$$\Delta E=\{(L1^*-L2^*)^2+(a1^*-a2^*)^2+(b1^*-b2^*)^2\}^{0.5}.$$

9. The multi-color image-forming material as in claim 8, wherein $\Delta E$ of said yellow heat transfer sheet is not greater than 5.0.

10. The multi-color image-forming material as in claim 1, wherein the value X obtained by dividing the reflection optical density ($OD_r$) of the image-forming layer constituting said yellow heat transfer sheet comprising at least one yellow organic pigment in the image-forming layer measured through a blue filter by the thickness (unit: $\mu$m) of said image-forming layer is not smaller than 1.6.

11. The multi-color image-forming material as in claim 10, wherein said value X is not smaller than 2.0.

12. The multi-color image-forming material as in claim 1, wherein the value X obtained by dividing the reflection optical density ($OD_r$) of the image-forming layer constituting said magenta heat transfer sheet comprising at least one magenta organic pigment in the image-forming layer measured through a green filter by the thickness (unit: $\mu$m) of said image-forming layer is not smaller than 1.6.

13. The multi-color image-forming material as in claim 12, wherein said value X is not smaller than 3.0.

14. The multi-color image-forming material as in claim 1, wherein the value X obtained by dividing the reflection optical density ($OD_r$) of the image-forming layer constituting said cyan heat transfer sheet comprising at least one cyan organic pigment in the image-forming layer measured through a red filter by the thickness (unit: $\mu$m) of said image-forming layer is not smaller than 2.0.

15. The multi-color image-forming material as in claim 14, wherein said value X is not smaller than 2.9.

16. The multi-color image-forming material as in claim 1, wherein the value X obtained by dividing the reflection optical density ($OD_r$) of the image-forming layer constituting said black heat transfer sheet comprising at least one black carbon in the image-forming layer measured through a visual filter by the thickness (unit: $\mu$m) of said image-forming layer is not smaller than 2.0.

17. The multi-color image-forming material as in claim 16, wherein said value X is not smaller than 2.7.

18. The multi-color image-forming material as in claim 1, wherein the ratio of the optical density (OD) of the image-forming layer in said various heat-transfer sheets to the thickness of the image-forming layer is not smaller than 1.50, the recording area of multi-color image in said various heat transfer sheets has a size of 515 mm×728 mm, the resolution of said transferred image is not smaller than 2,400 dpi, the image-forming layer in said heat transfer sheets each comprise a polymer pigment dispersant and/or phosphoric acid ester-based pigment dispersant incorporated therein, and said polymer pigment dispersant is a copolymer or polymer blend comprising ($(C_2H_5)_2N—(CH_2)_z—O—$) (in which z represents an integer of 2 or 3), ethylene glycol and propylene glycol at a ratio of 1:X:Y in which X and Y represent a number of from 10 to 20 and from 25 to 40, respectively.

19. The multi-color image-forming material as in claim 1, wherein said heat transfer sheets each comprise an organic pigment and/or carbon black incorporated as a colorant in the image-forming layer and said organic pigment and/or carbon black is monodisperse and has a particle diameter variation coefficient of not greater than 50%.

20. The multi-color image-forming material as in claim 19, wherein said organic pigment and/or carbon black has an average particle diameter of from 50 nm to 1,000 nm.

21. The multi-color image-forming material as in claim 1, where in said transferred image has a resolution of not smaller than 2,400 dpi.

22. The multi-color image-forming material as in claim 21, wherein said transferred image has a resolution of not smaller than 2,600 dpi.

23. The multi-color image-forming material as in claim 1, wherein the image-forming layer in said various heat transfer sheets and the image-receiving layer in said image-receiving sheets each exhibit a contact angle of from 7.0° to 120.0° with respect to water.

24. The multi-color image-forming material as in claim 1, wherein the ratio of the optical density (OD) of the image-forming layer in said various heat transfer sheets to the thickness of the image-forming layer is not smaller than 1.80 and said image sheets each exhibit a contact angle of not more than 86° with respect to water.

25. The multi-color image-forming material as in claim 1, wherein the recorded area of multi-color image has a size of 515 mm×728 mm.

26. The multi-color image-forming material as in claim 25, wherein the recorded area of multi-color image has a size of 594 mm×841 mm.

27. The multi-color image-forming material as in claim 1, wherein said image-forming layer comprises a pigment and an amorphous organic polymer having a softening point of from 40° to 150° incorporated therein each in an amount of from 20% to 80% by mass.

28. A multi-color image-forming process which comprises laminating an image-receiving sheet as defined in claim 1 with each of at least four different color heat transfer sheets as defined in claim 1 such that the image-forming layer of said heat-transfer sheet and the image-receiving layer of said image-receiving sheet are opposed to each other, irradiating the laminate with laser beam, and then transferring the laser beam-irradiated area on the image-forming layer onto the image-receiving layer in the image-receiving sheet to effect image recording, wherein the image-forming layer on the laser beam-irradiated area is transferred to the image-receiving sheet in the form of thin film.

29. The multi-color image-forming process as in claim 28, wherein when irradiated with laser beam, said light-to-heat conversion layer softens so that the image-forming layer on the light-to-heat conversion layer is pushed up and transferred to the image-receiving sheet in the form of thin film.

30. The multi-color image-forming process as in claim 1, wherein the thickness of the image-forming layer in said heat transfer sheets is from 0.01 $\mu$m to 0.9 $\mu$m.

31. The multi-color image-forming process as in claim 1, wherein the width of lines in laser-transferred image is from 0.8 to 1.7 times a half of the half-width (the half width at half maximum) of the distribution in the direction of subsidiary scanning of the integration of the binary energy distribution of laser beam spot in the direction of main scanning.

32. The multi-color image-forming process as in claim 1, wherein the width of lines in laser-transferred image is from 0.8 to 1.2 times a half of the half-width (the half width at half maximum) of the distribution in the direction of subsidiary scanning of the integration of the binary energy distribution of laser beam spot in the direction of main scanning.

* * * * *